US008465349B2

(12) United States Patent
Nishida

(10) Patent No.: US 8,465,349 B2
(45) Date of Patent: Jun. 18, 2013

(54) COIN DEPOSITING AND DISPENSING MACHINE

(75) Inventor: Eisei Nishida, Himeji (JP)

(73) Assignee: Glory Ltd., Himeji-Shi, Hyogo (JP)

( * ) Notice: Subject to any disclaimer, the term of this patent is extended or adjusted under 35 U.S.C. 154(b) by 0 days.

(21) Appl. No.: 11/813,061

(22) PCT Filed: Dec. 15, 2005

(86) PCT No.: PCT/JP2005/023008

§ 371 (c)(1),
(2), (4) Date: Jun. 28, 2007

(87) PCT Pub. No.: WO2006/070606

PCT Pub. Date: Jul. 6, 2006

(65) Prior Publication Data

US 2008/0085671 A1 Apr. 10, 2008
US 2009/0004959 A2 Jan. 1, 2009

(30) Foreign Application Priority Data

Dec. 28, 2004 (JP) ..... 2004-378778
Dec. 28, 2004 (JP) ..... 2004-378779
Feb. 25, 2005 (JP) ..... 2005-051608

(51) Int. Cl.
*G07D 1/00* (2006.01)

(52) U.S. Cl.
USPC ..... 453/57

(58) Field of Classification Search
USPC ..... 194/350; 453/18, 49, 50, 33, 34, 453/35, 57; 221/237
See application file for complete search history.

(56) References Cited

U.S. PATENT DOCUMENTS 3,788,334 A * 1/1974 Saraceno et al. ..... 453/57
4,396,029 A * 8/1983 Anderson ..... 453/15
4,558,711 A * 12/1985 Yoshiaki et al. ..... 453/3
5,021,026 A * 6/1991 Goi ..... 453/40
5,285,883 A * 2/1994 Le Hong et al. ..... 194/317
5,295,900 A * 3/1994 Tsuchida et al. ..... 453/57
5,306,206 A * 4/1994 Abe ..... 453/32
5,462,480 A * 10/1995 Suzukawa ..... 453/49
5,525,104 A * 6/1996 Adams et al. ..... 453/10

(Continued)

FOREIGN PATENT DOCUMENTS

JP 61-19879 2/1986
JP 62-58392 3/1987

(Continued)

*Primary Examiner* — Mark Beauchaine
(74) *Attorney, Agent, or Firm* — Renner, Kenner, Greive, Bobak, Taylor & Weber

(57) ABSTRACT

A coin depositing and dispensing machine includes a partition frame arranged in front of a denomination-specific coin accumulating and ejecting portion. A pooling hopper portion and a coin identifying and sorting passage are provided on the front face of the partition frame. The partition frame can be moved between a position at which the denomination-specific coin accumulating and ejecting portion is partitioned from the outside of the machine body 11 and a position at which it is exposed to the outside of the machine body. A lock locks the partition frame at a desired partition position. Coins located at pooling hopper portion or coin identifying and sorting passage can be freely accessed, while coins at the denomination-specific coin accumulating and ejecting portion may only be accessed by unlocking the lock. As a result, coins jammed near the pooling hopper portion or coin identifying and sorting passage may be readily cleared.

7 Claims, 23 Drawing Sheets

U.S. PATENT DOCUMENTS

| | | | | |
|---|---|---|---|---|
| 6,146,274 | A * | 11/2000 | Salour et al. | 463/29 |
| 6,196,913 | B1 | 3/2001 | Geib et al. | |
| 6,264,545 | B1 * | 7/2001 | Magee et al. | 453/3 |
| 6,352,472 | B1 * | 3/2002 | Tsuchida et al. | 453/50 |
| 6,685,552 | B2 * | 2/2004 | Nomura | 453/33 |
| 6,709,324 | B1 * | 3/2004 | Beadell | 453/29 |
| 6,783,452 | B2 * | 8/2004 | Hino et al. | 453/3 |
| 6,913,131 | B2 * | 7/2005 | Fletcher | 194/217 |
| 7,066,807 | B2 * | 6/2006 | Abe et al. | 453/7 |
| 7,144,318 | B2 * | 12/2006 | Wei | 453/57 |
| 2002/0072319 | A1 * | 6/2002 | Abe | 453/49 |

FOREIGN PATENT DOCUMENTS

| | | |
|---|---|---|
| JP | 7-49573 | 11/1995 |
| JP | 2002-260054 A | 9/2002 |
| JP | 2004-341676 A | 12/2004 |
| JP | 2006-048407 | 2/2006 |
| WO | WO 93/07592 | 4/1993 |

* cited by examiner (a) (b)

(a) (b)

(a)

(b)

(a)

(b)

(a)

(b)

COIN DEPOSITING AND DISPENSING MACHINE

CROSS-REFERENCE TO RELATED APPLICATIONS

This application is the national phase under 37 U.S.C. §371 of International Patent Application No. PCT/JP2005/023008, which has an International filing date of Dec. 15, 2005 and designates the United States of America, International Patent Application No. PCT/JP2005/023008 which claims priority from Japanese Patent Application Nos. 2004-378778, filed Dec. 28, 2004, 2004-378779, filed Dec. 28, 2004, and 2005-051608, filed Feb. 25, 2005. Each of the priority applications and the International patent application is hereby incorporated by reference in its entirety herein.

TECHNICAL FIELD

The present invention relates to a coin depositing and dispensing machine for depositing and dispensing coins.

BACKGROUND OF THE INVENTION

In a conventional coin depositing and dispensing machine, a coin receiving portion for receiving deposited coins input into a machine body and dispensed coins sent out from the machine body is provided on the upper front face of the machine body, a pooling and feeding portion for receiving coins released from the coin receiving portion and feeding the coins one by one is provided below the coin receiving portion, and a coin passage for receiving the coins fed from the pooling and feeding portion and conveying them is provided along an anteroposterior direction of the machine body. A denomination-specific coin temporary storage portion for temporarily storing coins diverged through the coin passage in accordance with the denominations and a denomination-specific coin accumulating and ejecting portion for accommodating coins temporarily stored at the denomination-specific coin temporary storage portion in an accumulated manner are provided below the coin passage along an anteroposterior direction of the machine body. A conveyor for receiving overflow coins when deposited, dispensed coins, recovered coins, replenished coins and feeding them to the pooling and feeding portion is disposed on one lower side of the denomination-specific coin accumulating and ejecting portion. Further, a coin cassette for accommodating the replenished coins to release them to the conveyor and accommodating overflow coins during deposit and recovered coins during recovery through the coin passage is arranged so as to be detachably attached at the posterior part of the machine body.

Then, in a deposited-coin identification and temporary storage process during deposit, deposited coins input into the coin receiving portion are fed one by one to the coin passage through the pooling and feeding portion and identified by the coin passage and these deposited coins are sorted in accordance with the denominations and stored temporarily at the denomination-specific coin temporary storage portion. Regarding denominations of coins which are full at the denomination-specific coin temporary storage portion or the denomination-specific coin accumulating and ejecting portion, they are regarded as overflow coins and sent to the conveyor for a collective and temporary storage. In a deposited-coin accommodating process through approval of deposited coins after completion of the deposited-coin identification and temporary storage process, coins which are deposited and temporarily stored at the denomination-specific coin temporary storage portion are accommodated at the denomination-specific coin accumulating and ejecting portion, and the coins deposited and temporarily stored on the conveyor are conveyed through the pooling and feeding portion and the coin passage to coin cassettes for accommodation. In a deposited-coin returning process through non-approval of deposited coins after completion of the deposited-coin identification and temporary storage process, coins which are deposited and returned at the denomination-specific coin temporary storage portion are released to the conveyor, and the coins which are deposited and returned on the conveyor are conveyed from the conveyor through the pooling and feeding portion and the coin passage to the coin receiving portion for returning the coins. During dispensing coins, coins to be dispensed from the denomination-specific coin accumulating and ejecting portion are ejected to the conveyor, and these dispensed coins are conveyed from the conveyor through the pooling and feeding portion and the coin passage to the coin receiving portion for paying out the coins (see, e.g., Japanese Laid-Open Patent Publication No. 2004-341676, pages 13 to 15 and FIGS. 11 to 15).

Further, the above-described coin depositing and dispensing machine includes a coin depositing and dispensing machine to be operated by employees in which a bank employee (teller) or an employee at a supermarket and a department store conducts a coin depositing process and a coin dispensing process (a process of ejecting change coins at a supermarket or a department store, which is also handled as a coin-dispensing process). Regarding this coin depositing and dispensing machine, in a deposited-coin identification and temporary storage process during deposit, where coins are jammed at a site such as a pooling and feeding portion region or a coin passage region, an employee uses a key to unlock and open the cover of a machine body, thereby removing coins jammed at the pooling and feeding portion region or the coin passage region. Thereafter, the employee closes and locks the cover to resume the deposited-coin identification and temporary storage process. The key is managed by a supervisor of the coin depositing and dispensing machine or kept at a predetermined custodial site.

However, in a conventional coin depositing and dispensing machine, in order to eliminate jamming of coins at a pooling and feeding portion region or a coin passage region when deposited coins are identified and temporarily stored, it is necessary that an employee borrows the key from a supervisor, etc., of the coin depositing and dispensing machine or brings the key from a predetermined custodial site. Further, in order to open the cover of the machine body, the employee must unlock the cover and lock it after removal of jammed coins by using the key, thus needing a longer time and a greater amount of labor for removing the jammed coins, which is a problem. There is another problem that the cover of the machine body is unlocked and opened, thereby, coins at the pooling and feeding portion region and the coin passage region in the deposited-coin identification and temporary storage process, that is, coins prior to deposit and accommodation and coins at the denomination-specific coin accumulating and ejecting portion are also exposed to free access, and coins prior to deposit and accommodation outside the machine body are not differentiated in terms of cash management from coins inside the machine body which have been accommodated at the denomination-specific coin accumulating and ejecting portion.

SUMMARY OF THE INVENTION

Conventionally, a coin depositing and dispensing machine in which deposited coins are used as dispensed coins in a cyclical manner include a coin depositing and dispensing machine for employees in which a bank employee (teller) or an employee at a supermarket and a department store conducts a coin depositing process and a coin dispensing process (a process of ejecting change coins at a supermarket or a department store, which is also handled as a coin-dispensing process). As described in Japanese Patent Publication No. 3549784, for example, the coin depositing and dispensing machine is provided with a pooling hopper portion mounted on the front face of the machine body and a coin identifying and sorting passage which accepts coins released from the pooling hopper portion and conveys them one by one. The coin identifying and sorting passage is provided with an identification passage region which moves from a pooling hopper portion to the left side in a width direction of the machine body, a rear passage region which moves toward the back part of the machine body from the terminal end of the identification passage region along the vicinity of the left end of the machine body, and a denomination-specific coin-sorting passage region which is arranged in a width direction of the machine body on the back part side of the machine body from the vicinity on the left end of the machine body at the terminal end of the rear passage region toward the right end of the machine body. A rejected-coin diverging portion for diverging rejected coins is formed at the rear passage region, and a plurality of denomination-specific coin diverging portions for diverging coins according to the denominations are arranged at the denomination-specific coin sorting passage region. A plurality of denomination-specific temporary storage portions for temporarily storing diverged coins are juxtaposed in a width direction of the machine body at lower parts corresponding to a plurality of denomination-specific coin diverging portions on the coin identifying and sorting passage. Each of denomination-specific coin accommodation and ejection portions for accommodating coins at each of the denomination-specific temporary storage portions during approval of deposited coins in a backward direction of each of the denomination-specific temporary storage portions is juxtaposed in a width direction of the machine body. A conveyor, which is able to convey dispensed coins ejected from each of the denomination-specific coin accommodation and ejection portions either to the left end region or to the right end region in a width direction of the machine body, is provided at the lower front part of each of the denomination-specific coin accommodation and ejection portions juxtaposed in a width direction of the machine body. A left-side conveying portion for conveying forward dispensed coins which are conveyed to the left end by the conveyor is provided at the left end of the conveyor, and a left-side coin dispensing box which receives and accommodates dispensed coins is arranged so as to face the front edge of the left-side conveying portion. A right-side conveying portion for conveying forward dispensed coins which are conveyed to the right end by the conveyor is provided at the right end of the conveyor, and a right-side coin dispensing box which receives and accommodates dispensed coins is arranged so as to face the front end of the right-side conveying portion.

However, the coin identifying and sorting passage is arranged so as to move toward the left end in a width direction of the machine body from the pooling hopper portion arranged at the front face of the machine body, further move toward a backward direction of the machine body along the vicinity of the left end of the machine body and still further move toward the right end of the machine body from the vicinity of the left side of the machine body at the back part of the machine body, and formed approximately in the shape of a letter U on a horizontal plane. Further, dispensed coins are to be sent from each of denomination-specific coin accommodation and ejection portions juxtaposed in a width direction of the machine body to a conveyor in front thereof and conveyed from the conveyor respectively to a right-side coin dispensing box via a right-side conveying portion and to a left-side coin dispensing box via a left-side conveying portion. Therefore, such a problem is posed that the machine body is made larger in a width direction and a depth direction and also provided with a conveyor, a right-side conveying portion and a left-side conveying portion for dispensing coins, by which the machine body is complicated in structure, larger in size and higher in cost. Further, another problem is posed that dispensed coins ejected from each of the denomination-specific coin accommodation and ejection portions are paid out through the conveyor, the right-side conveying portion, the left-side conveying portion or the like, coins may remain due to standing of dispensed coins on the conveyor, at the right-side conveying portion and the left-side conveying portion, and when the dispensed coins remain, a difference may be found in calculation between a specified amount of dispensed coins and an actual amount of coins paid out at the right-side coin dispensing box or the left-side coin dispensing box.

Equipment of feeding/separating/conveying pooled coin type often include, for example, equipment of feeding/separating/conveying pooled coins as described in the Japanese Laid-Open Patent Publication No. 2003-187288, in which a tilted disk is used to feed coins and also convey them one by one separately. This equipment of feeding/separating/conveying pooled coins is provided with a pooling hopper portion which is constituted with a tilted disk disposed in such a posture that the upper part thereof is tilted toward the back part and a hopper frame for pooling coins between the hopper frame and the front face of the tilted disk and also provided with a coin passage for accepting coins fed from the tilted disk at the pooling hopper portion one by one and conveying them. An internal circular face region is formed at the tilted disk from a rotational central axis of the tilted disk to a predetermined radial region, and a ring-shaped outer-ring face region is formed from an outer periphery of the internal circular face region to an outer periphery of the tilted disk. The face of the internal circular face region is projected to the front face side by a predetermined thickness from the outer-ring face region (thickness slightly smaller than a minimum thickness of the coin to be handled), and a boundary circumference portion placing one coin in a thickness direction is formed on a boundary face between the internal circular face region and the outer-ring face region. Through holes are formed at a predetermined pitch along the circumferential direction at a predetermined radial region at the outer-ring face region on the tilted disk. Coin picking-up projections are individually arranged at each through hole, and each of the coin picking-up projections is urged in a direction projecting to the front face of the outer-ring face region by each blade spring fixed on the back face of the tilted disk. Then, the tilted disk is rotated, by which coins at the lower region on the tilted disk are picked up to the upper part region of the rotating circular plate and fed to the starting end of the coin passage, with the coins retained by the coin picking-up projection between the projection and the boundary circumference portion. Where the coin picking-up projection undergoes an excessive load due to jammed coins during picking up of the coins, the coin picking-up projection retracts from the outer-ring face region against a force resulting from the blade spring.

The starting end of a coin passage is formed at a region which is an upper region of the tilted disk and in which coins are moved by keeping them with a coin picking-up projection and a boundary circumference portion. The coin passage is provided with a coin guide member which receives coins from the boundary circumference portion in a close proximity to the front face of an outer-ring face region and guides the coins outside the circumference of the tilted disk, with the coins kept between the coin guide member and the coin picking-up projection. Further, a conveyor belt which is opposed to the front face of the outer-ring face region at the upper part region from the coin guide member and also opposed along the front face region of the coin passage is stretched to be installed, thereby conveying coins one by one separately by the conveyor belt. Then, the tilted disk is rotated, by which coins are retained and elevated by the boundary circumference and the coin picking-up projection and received on a coin guide member, and the received coins are then retained by the coin guide member and the coin picking-up projection. Thereby, the coins are conveyed along the coin passage one by one separately on the rotating conveyor belt.

For the purpose of feeding coins one by one reliably to a space between the outer-ring face region of the tilted disk and the conveyor belt, a one-coin regulating portion for regulating the coins so that only one coin is allowed to pass in a thickness direction opposite the front face of the outer-ring face region of the tilted disk is provided in close proximity to the front step at the starting end of the coin passage.

However, there is a chance that two overlapped coins which are brought to the one-coin regulating portion may not be separated into one layer at the one-coin regulating portion and jammed. There is also a chance that when coins advance into a space between the outer-ring face region of the tilted disk and the conveyor belt at the starting end of the coin passage, the coins move stagnantly and may be jammed at the space. As described above, coins may be easily jammed at the one-coin regulating portion and the starting end of the coin passage, which is a first problem of a conventional coin-depositing and dispensing machine. Further, such a jamming of coins will affect the capacity of coins to be accommodated at a pooling hopper portion constituted with the tilted disk and the hopper frame, and if coins are accommodated approximately by ½ of the lower region of the tilted disk, the coins are fed to the one-coin regulating portion, with the coins being overlapped in multiple layers not separated by a single layer, and may be jammed frequently. In order for the coins not to be jammed frequently, they can be accommodated approximately by ⅓ of the lower region of the tilted disk. Therefore, if coins are to be accommodated at the pooling hopper portion in a greater capacity, the tilted disk must be made larger in diameter to result in a larger dimension of the pooling hopper portion. As described above, an increased capacity of the pooling hopper portion for accommodating coins will inevitably result in a larger dimension of the pooling hopper portion, which is a second problem of a conventional machine.

In addition, coins may be accommodated into the coin collector 21 of the coin-collector installing portion 22 in place of the ejected-coin temporary storage portion 121.

Next, a description will be made for other objects and features of the coin depositing and dispensing machine.

The present invention has been made in view of the above problems, an object of which is to provide a coin depositing and dispensing machine capable of clearly differentiating coins outside a machine body from those inside the machine body to manage cash, and easily eliminate jamming of coins in a deposited-coin identification and temporary storage process when coins are deposited.

A coin depositing and dispensing machine according to the first aspect of the invention is provided with a machine body; a pooling hopper portion arranged on the front face side of the machine body, and provided with a rotatable tilted disk disposed in such a posture that the upper part is tilted toward the back part and a hopper frame for pooling coins between the hopper frame and the front face of the tilted disk, and in which a movable hopper frame portion capable of being opened and closed by movable hopper-frame portion opening/closing means is mounted at least at a lower region of the hopper frame; a coin identifying and sorting passage which accepts coins fed from the pooling hopper portion and conveys them and is arranged so as to correspond to the width direction of the front face of the machine body, and in which a coin identification portion, a denomination-specific diverging portion and a temporary storage coin taking-out portion are provided to diverge coins in accordance with the denominations at the denomination-specific diverging portion during replenishment of coins; a coin collective and temporary storage portion which is provided below a temporary storage coin taking-out portion on the coin identifying and sorting passage, collectively and temporarily storing coins taken out from the temporary storage coin taking-out portion to the coin identifying and sorting passage, and releasing the deposited and temporarily stored coins during storage and returning of the coins; control means for sending coins at the coin collective and temporary storage portion to an accommodating route during accommodation of coins and to a returning route during returning of coins; a coin collective accommodation portion which is constituted with coin cassettes detachably attached inside the machine body, thereby accommodating coins sent from the coin temporary storage portion to the accommodating route; a denomination-specific coin accumulating and ejecting portion which is arranged so as to correspond to a width direction of the front face of the machine body in the back part region on the coin identifying and sorting passage and having a denomination-specific accommodating portion for accommodating coins diverged from each of the denomination-specific diverging portions in accordance with the denominations in an accumulated state and also having a coin ejecting portion for ejecting coins at these denomination-specific accommodating portions; a partition frame having the pooling hopper portion and the coin identifying and sorting passage on the front face, which is provided so as to be opened and closed between a partitioning position which is located in front of the denomination-specific coin accumulating and ejecting portion inside the machine body to partition the denomination-specific coin accumulating and ejecting portion from the outside of the machine body and an open position at which the denomination-specific coin accumulating and ejecting portion is exposed to the outside of the machine body; locking means for locking the partition frame at the partition position; and a coin-collector installing portion mounted on the lower front face side of the machine body, and in which a coin collector for collecting coins ejected from the denomination-specific coin accumulating and ejecting portion and deposited/returned coins released below through the returning route is arranged so as to be detachably attached; wherein coins located in the pooling hopper portion region and the coin identifying and sorting passage region are given as those outside the machine body which can be operated even in a state that the partition frame is locked by the locking means, and coins at the denomination-specific coin accumulating and ejecting portion are given as those inside the machine body which can be operated by opening the partition frame by unlocking the locking means.

The partition frame having the pooling hopper portion and the coin identifying and sorting passage on the front face is configured so as to be opened and closed between a partition position which is located in front of the denomination-specific coin accumulating and ejecting portion inside the machine body to partition the denomination-specific coin accumulating and ejecting portion from the outside of the machine body and an open position at which the denomination-specific coin accumulating and ejecting portion is exposed to the outside of the machine body. The partition frame is locked by the locking means at the partition position, thereby, coins located in the pooling hopper portion region and the coin identifying and sorting passage region are given as those outside the machine body which can be operated even in a state that the partition frame is locked by the locking means, whereas coins at the denomination-specific coin accumulating and ejecting portion are given as those inside the machine body which can be operated by opening the partition frame by unlocking the locking means, thus making it possible to clearly differentiate the former from the latter. As a result, it is possible to easily eliminate jamming of coins in the pooling hopper portion region, the coin identifying or the sorting passage region in a deposited-coin identification and temporary storage process during deposit of coins without an unlocking operation.

A coin depositing and dispensing machine according to a second aspect of the invention employs a coin depositing and dispensing machine according to the first aspect of the invention, wherein a coin collective and temporary storage portion and a coin collective accommodation portion are provided on either one side or the other side of the machine body in the width direction of the front face thereof, coins at the coin collective and temporary storage portion are given as those outside the machine body and coins at the coin collective accommodation portion are given as those inside the machine body.

Coins at the coin collective and temporary storage portion can be operated so as to be taken out as those outside the machine body without an unlocking operation. Further, the coins at the coin collective accommodation portion constituted by coin cassettes detachably attached to the machine body can be easily recovered as those inside the machine body.

In the coin depositing and dispensing machine according to the first aspect of the invention, the partition frame having the pooling hopper portion and the coin identifying and sorting passage on the front face is provided so as to be opened and closed between a partition position which is located in front of the denomination-specific coin accumulating and ejecting portion inside the machine body to partition the denomination-specific coin accumulating and ejecting portion from the outside of the machine body and an open position at which the denomination-specific coin accumulating and ejecting portion is exposed to the outside of the machine body, and the partition frame is locked by the locking means at the partition position. Thereby, coins in the pooling hopper portion region, the coin identifying and sorting passage region are given as those outside the machine body which can be operated even in a state that the partition frame is locked by the locking means, whereas coins at the denomination-specific coin accumulating and ejecting portion are given as those inside the machine body which can be operated by opening the partition frame by unlocking the locking means, thus making it possible to clearly differentiate the former from the latter. As a result, it is possible to easily eliminate jamming of coins in the pooling hopper portion region or the coin identifying and sorting passage region in a deposited-coin identification and temporary storage process during deposit of coins without an unlocking operation.

In the coin depositing and dispensing machine according to the second aspect of the invention, coins at the coin collective and temporary storage portion can be taken out as those outside the machine body and coins at the coin collective accommodation portion constituted by coin cassettes detachably attached to the machine body can be easily recovered as those inside the machine body.

BRIEF DESCRIPTION OF THE DRAWINGS

The invention will become more readily apparent from the Detailed Description of the Invention, which proceeds with reference to the drawings, in which:

FIG. 4(*a*) provides a sectional view and FIG. 4(*b*) provides a front view.

DETAILED DISCLOSURE OF THE INVENTION

Figure 1:
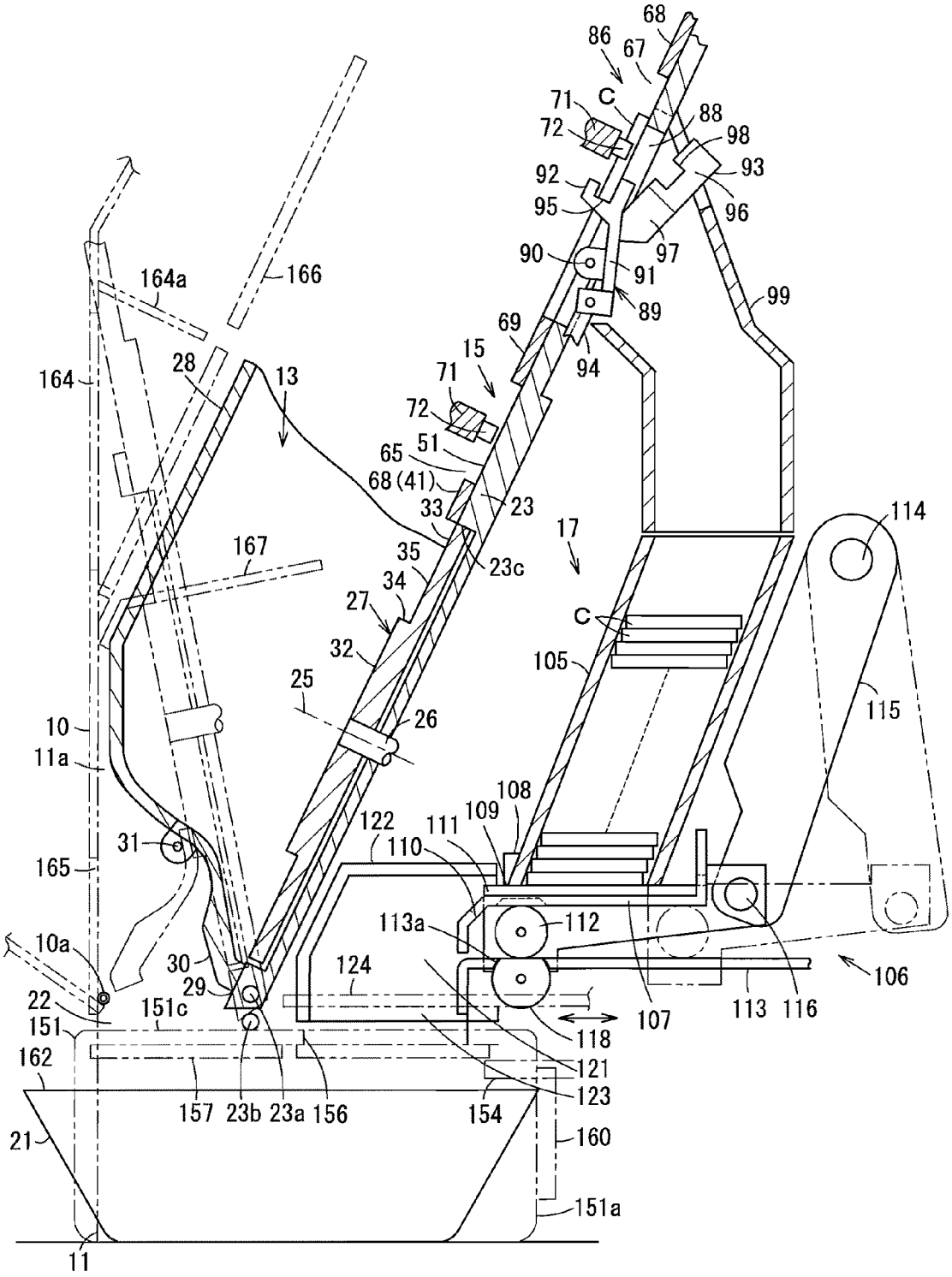
FIG. 1 provides a sectional view of a coin depositing and dispensing machine of the present invention indicated by the arrow A-A in FIG. 2.

Hereinafter, a description will be made for embodiments of the present invention by referring to drawings.

The following table provides a key to a number of significant reference elements illustrated in the drawings.

11: machine body
13: pooling hopper portion
15: coin identifying and sorting passage
17: denomination-specific coin accumulating and ejecting portion
18: coin collective and temporary storage portion
20: coin collective storage portion
21: coin collector
22: coin-collector installing portion
23: partition frame
24: locking means
27: tilted disk
28: hopper frame
30: movable hopper frame portion
80: coin identification portion
86: denomination-specific diverging portion
87: temporary storage coin taking-out portion
105: denomination-specific accommodating portion
106: coin ejecting portion
151: coin cassette
175: control means
C: coin
M8: movable hopper frame portion motor as a means for opening and closing the movable hopper frame portion FIG. 1 through FIG. 30 illustrate a first embodiment of the present invention.

Figure 2:
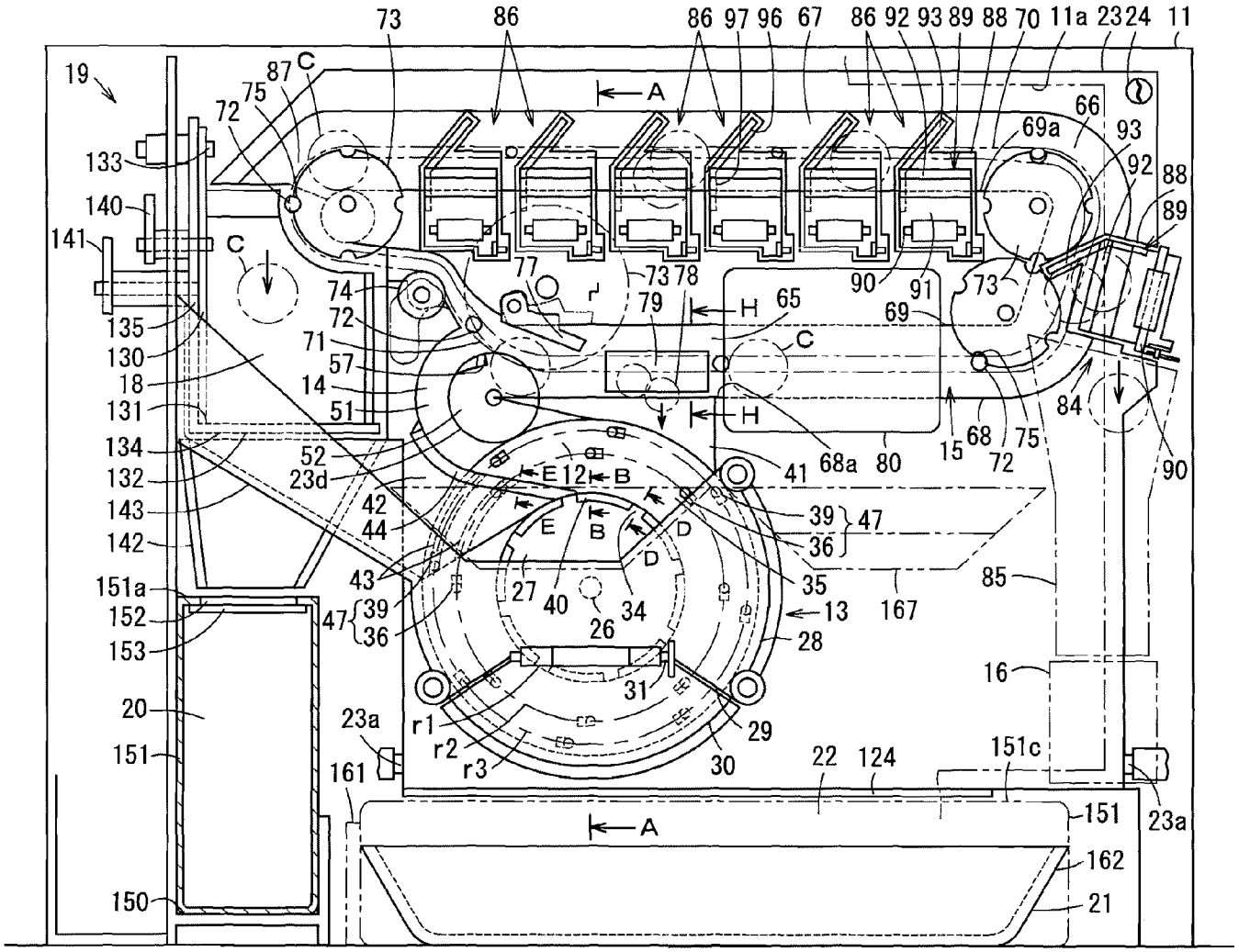
FIG. 2 provides a front view illustrating an inner structure of the coin depositing and dispensing machine of FIG. 1.
Figure 16:
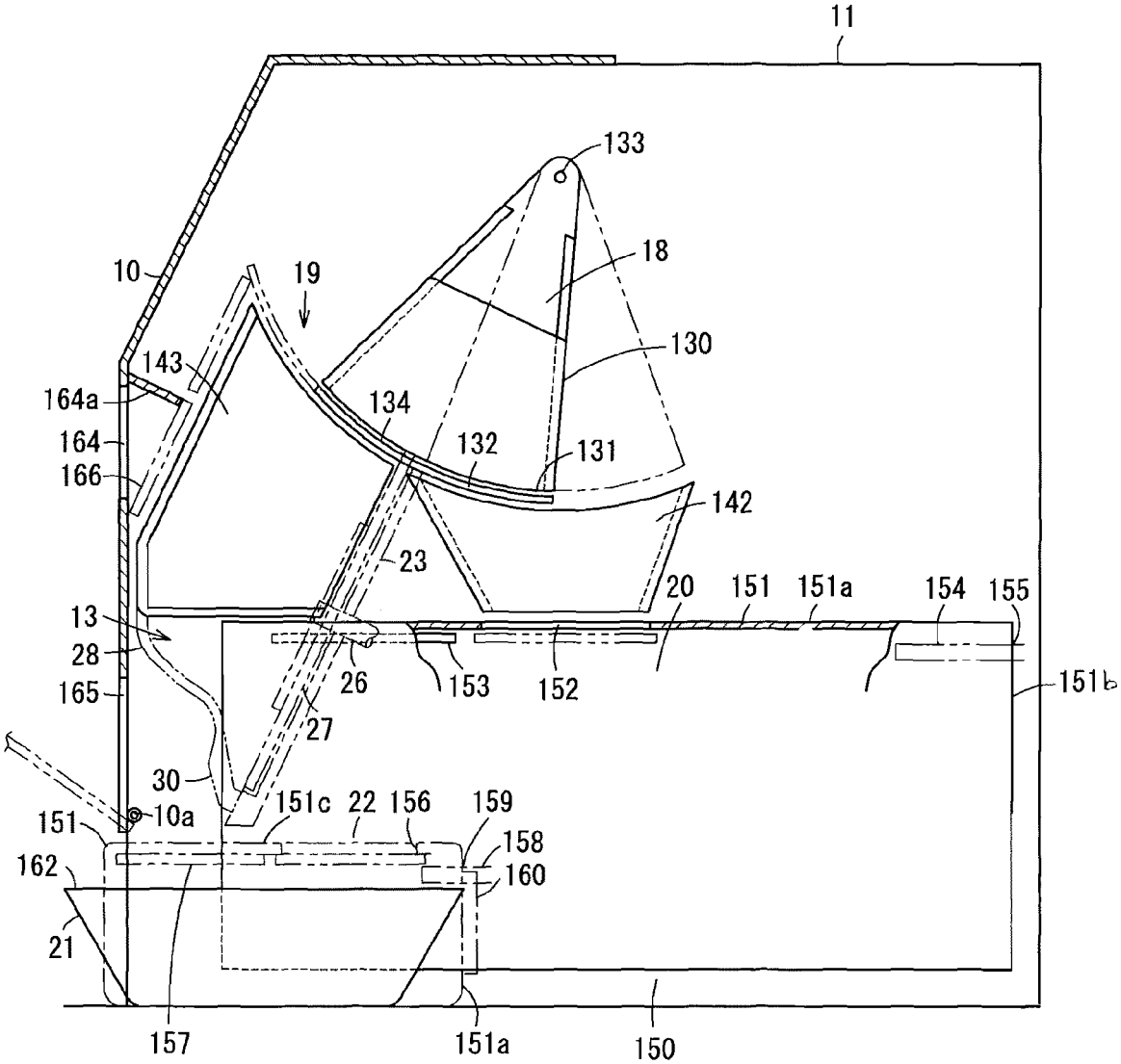
FIG. 16 provides a side view of the coin depositing and dispensing machine of FIG. 2 as viewed from the right side, or a side view showing a case where coins temporarily stored at a coin collective and temporary storage portion are released to a coin collective accommodation portion.

As illustrated in FIG. 1, FIG. 2 and FIG. 16, the coin depositing and dispensing machine is provided with a machine body 11, in which a front opening 11*a* opened outside the machine body is formed on the front face facing an employee (teller) in charge of the machine body 11 (the front face on the left side in FIG. 1 and FIG. 16 or the forward side in FIG. 2) and an opening and closing cover 10 capable of opening and closing an anterior region of the front opening 11*a* is also arranged.

The opening and closing cover 10 is formed in such a configuration as to integrally cover the front opening 11*a* from the front face of the machine body 11 to the upper front face in a width direction corresponding to a whole region in the lateral width direction of the front face of the machine body 11, and the lower end of the opening and closing cover 10 is supported so as to move rotationally on an opening and closing cover shaft 10*a* with respect to the lower front face of the machine body 11. In other words, the opening and closing cover 10 is supported so as to be opened and closed between a closed position which has closed an anterior region of the front opening 11*a* on the machine body 11 and an open position which is tilted in front of the machine body 11 and opened with the opening and closing cover shaft 10*a* as a support point.

Then, inside the machine body 11, arranged in the central region in the width direction of the front face of the machine body 11 (in the central region in the lateral direction) is a pooling hopper portion 13 which accepts coins (indicated in drawings as a reference symbol of C and omitted hereinafter) and feeds them one by one from a coin feeding port 12 at the upper part region, arranged is a coin-sending-direction changing passage 14 which conveys coins fed from the coin feeding port 12 at the pooling hopper portion 13 after the coins are changed in direction to a region immediately above the pooling hopper portion 13, arranged along the width direction of the machine body 11 is a coin identifying and sorting passage 15 which identifies and diverges coins sent above the pooling hopper portion 13 one by one through the coin-sending-direction changing passage 14 while conveying them, arranged on the right side of the machine body 11 is a deposited/rejected coin accommodating portion 16 which accommodates deposited/rejected coins diverged from the coin identifying and sorting passage 15, arranged along the width direction of machine body 11 is a denomination-specific coin accumulating and ejecting portion 17 which receives from the upper part coins diverged according to the denominations at the coin identifying and sorting passage 15 and accommodates the coins at the back side of the coin identifying and sorting passage 15 and also ejects the coins one by one from the lower part during dispensing or recovering the coins, arranged on the left side of the machine body 11 is a coin collective and temporary storage portion 18 which temporarily stores the coins conveyed to the terminal end of the coin identifying and sorting passage 15, arranged is a release means 19 which releases coins stored temporarily at the coin collective and temporary storage portion 18 by changing over to a first release side below the coin collective and temporary storage portion and to a second release side at the pooling hopper portion 13, and arranged below the coin collective and temporary storage portion 18 is a coin collective accommodation portion 20 which collectively accommodates the temporarily stored coins released from the coin collective and temporary storage portion 18 by the release means 19. Further, a coin-collector installing portion 22 in which a coin collector 21 for collecting coins ejected from the denomination-specific coin accumulating and ejecting portion 17 and deposited/returned coins released from the pooling hopper portion 13 is arranged so as to be detachably attached is provided in the central region in a width direction on the lower front face side of the machine body 11.

Figure 3:
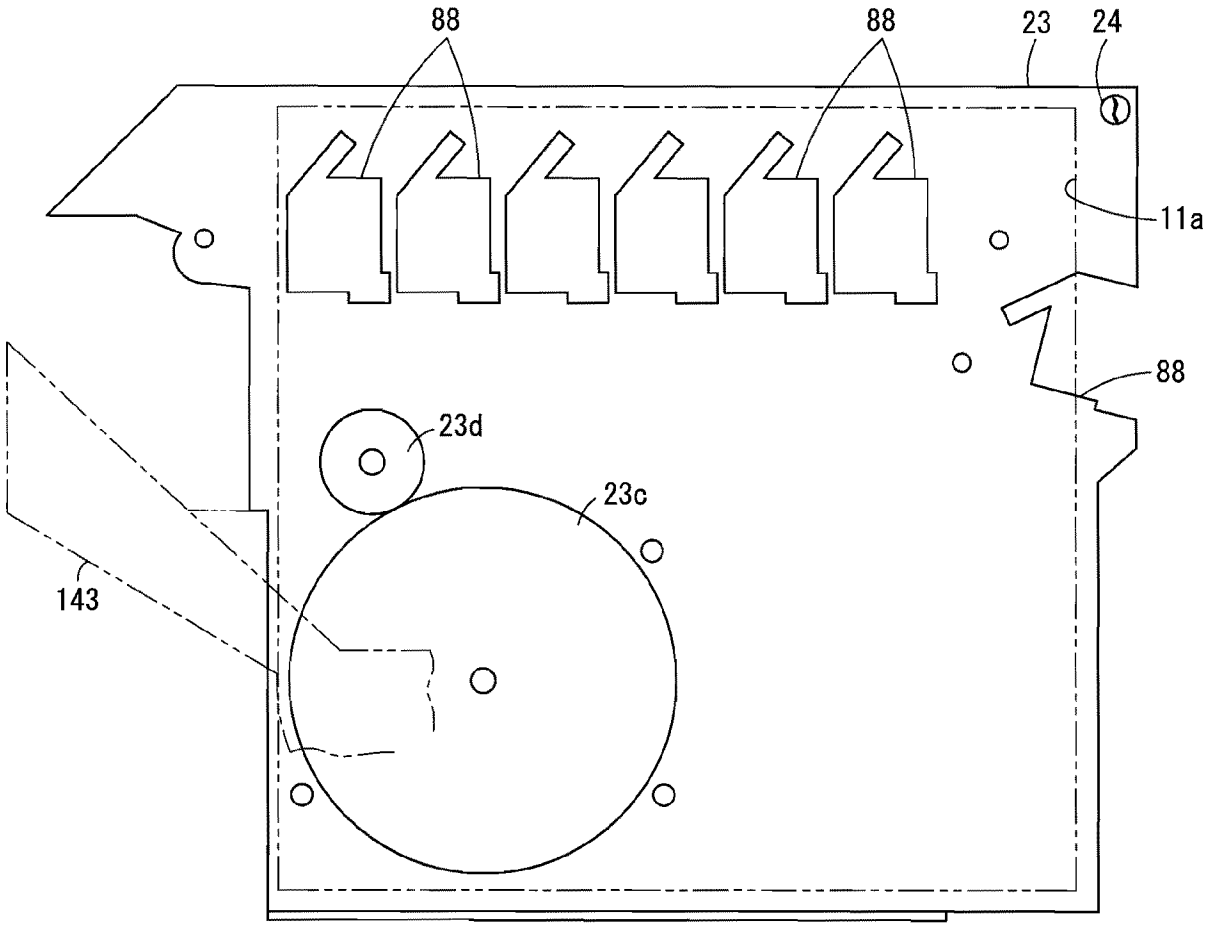
FIG. 3 provides a front view illustrating a partition frame of the coin depositing and dispensing machine of FIG. 2.

A partition frame 23 capable of opening and closing the front opening 11*a* is disposed at the front opening 11*a* of the machine body 11. As illustrated in FIG. 1 to FIG. 3, the partition frame 23 is constituted with a partition plate shaped so as to cover substantially a whole region of the front opening 11*a* on the machine body 11 excluding the region of the coin collective and temporary storage portion 18 and the coin collective accommodation portion 20, and the lower end of the partition frame 23 is supported so as to move rotationally on a partition frame shaft 23*a* with respect to the lower front face side of the machine body 11. In other words, the partition frame 23 is supported so as to be opened and closed between a partition position which closes the front opening 11*a* of the machine body 11 with the partition frame shaft 23*a* as a support point, also positioning in front of the denomination-specific coin accumulating and ejecting portion 17 inside the machine body 11 to partition the denomination-specific coin accumulating and ejecting portion 17 from the outside of the machine body 11 and an open position which moves to the front of the machine body 11 and opens the front opening 11*a* on the machine body 11, thereby exposing the denomination-specific coin accumulating and ejecting portion 17 to the outside of the machine body 11. An open stopper 23*b* for restricting the forward movement and opening action by the partition frame 23 is provided on the machine body 11 side.

The partition frame 23 is provided with locking means 24 for locking the partition frame 23 at the partition position. The locking means 24 is constituted with a key cylinder body capable of locking and unlocking the partition frame by inserting the key to make a rotational movement.

Therefore, coins located in a region of the pooling hopper portion 13, a region of the coin-sending-direction changing passage 14 and a region of the coin identifying and sorting passage 15 on the front face of partition frame 23 are handled as coins outside the machine body which can be freely operated upon release of the opening and closing cover 10 by an employee. Further, coins at the denomination-specific coin accumulating and ejecting portion 17 are handled as coins inside the machine body which can be operated upon release of the partition frame 23 by unlocking the locking means 24. Still further, coins at the coin collective and temporary storage portion 18 are handled as those outside the machine body, whereas coins at the coin collective accommodation portion 20 are handled as those inside the machine body.

Then, the pooling hopper portion 13, the coin-sending-direction changing passage 14, the coin identifying and sorting passage 15, the deposited/rejected coin accommodating portion 16, the coin collective and temporary storage portion 18, the coin collective accommodation portion 20 and the coin-collector installing portion 22 are arranged on the front face side of the machine body 11.

Next, as illustrated in FIG. 1 and FIG. 2, the pooling hopper portion 13 is provided with a tilted disk 27 which can rotate at the center of a rotational axis 26, which is a rotational axis line 25, with the upper part thereof in a tilted posture toward the direction of the back part and a hopper frame 28 which pools coins between the hopper frame and the front face of the tilted disk 27. A coin feeding port 12 for feeding coins by a normal rotation of the tilted disk 27 is formed at the upper part region on the circumferential face of the tilted disk 27. The tilted disk 27 is arranged at a circular recess 23*c* formed on the front face of the partition frame 23 and also arranged so as to be flush with the front face side of the partition frame 23. The tilted disk 27 is rotated and driven by a tilted disk motor M1 (refer to FIG. 19) in a normal rotating direction or in a feeding and rotating direction (in a counter-clockwise direction shown in FIG. 2) and in a reverse rotating direction (in a clockwise direction shown in FIG. 2). The hopper frame 28 is formed in such a way that the center of the upper brim of the hopper frame 28 is lower than the both sides region of the upper brim for easily inputting coins into the pooling hopper portion 13, and attached to the front face of the partition frame 23.

A release port 29 is formed at least at a lower region of the hopper frame 28, and a movable hopper frame portion 30 for closing the release port 29 is provided in such a way that the lower part side can be opened and closed with the shaft 31 on the upper edge side as a support point. The movable hopper frame portion 30 is driven to be opened and closed by using a movable hopper frame portion motor M8 (refer to FIG. 19) as a means for opening and closing the movable hopper frame portion.

A circular high position 32 is formed in the central region on the front face of the tilted disk 27, and a low position 33 lower only by the dimension slightly smaller than a minimum coin thickness among coins to be handled at the high position 32 is formed at an outer circumferential region of the high position 32. A coin circumference retaining portion 34, which is a first predetermined radial region r1 from the rotational axis line 25 of the tilted disk 27, at which the circumference of one coin is placed in a thickness direction is formed at a step portion between the high position 32 and the low position 33 (refer to FIG. 5(*b*)). A coin face retaining portion 35 for retaining the back face of a coin in which the radial dimension from the coin circumference retaining portion 34 is slightly larger than a maximum coin diameter among coins to be handled is formed at the low position 33, which is outside the radial direction from the coin circumference retaining portion 34.

Figure 4:
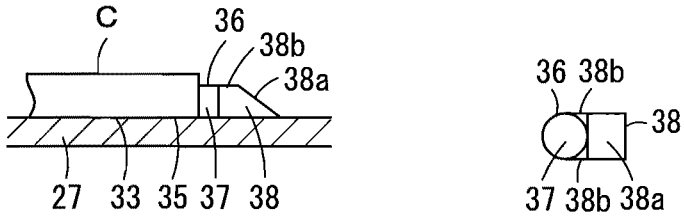
FIGS. 4(*a*) and 4(*b*) illustrate a coin picking-up projection provided on a tilted disk of the coin depositing and dispensing machine of the same as the above.

A plurality of coin picking-up projections 36 projected toward the front face side of the tilted disk 27 are fixed and arranged at a predetermined pitch in a circumferential direction at a second predetermined radial region r2 from the rotational axis line 25 in the coin face retaining portion 35. Each of the coin picking-up projections 36 is able to retain one coin between the projection and the coin circumference retaining portion 34, regardless of any dimension of the coin from a maximum diameter to a minimum diameter, thereby picking up the coin to an upper part region of the tilted disk 27 when the tilted disk 27 is rotated in a normal direction. As illustrated in FIG. 4, the coin picking-up projection 36 is provided with a metal pin 37 in contact with a coin on a normal rotation of the tilted disk 27 in opposition to the rotating direction and a following guide portion 38, and the coin picking-up projection 36 can be decreased in friction by the metal pin 37. The guide portion 38 on the side opposite to the pin 37 against the normal rotating direction is constituted with a resin-made guide portion 38*a* tilted from the coin face retaining portion 35 to the leading end of the pin 37 and connecting portions 38*b* and 38*b* which are also made with a resin as with the guide portion 38*a* to connect the guide portion 38*a* with the pin 37. The guide portion 38 prevents coins from being caught by the pin 37 during a reverse rotation of the tilted disk 27, thereby making it possible to prevent the occurrence of jamming of coins.

A plurality of coin collapsing projections 39 which project to the front face side of the tilted disk 27 are fixed and arranged at a predetermined pitch in a circumferential direction at a third predetermined radial region r3 in a radial direction further outside from the second predetermined radial region r2 at the coin face retaining portion 35. A plurality of these coin collapsing projections 39 are arranged at a position deviated backward at a predetermined angle with respect to a normal rotating direction at the center of the rotational axis line 25 from the coin picking-up projections 36 so as to individually correspond to each of the plurality of coin picking-up projections 36. It is noted that the coin collapsing projection 39 is constituted with a pin 37 and a guide portion 38, as with the coin picking-up projection 36.

Then, a coin picking-up and feeding projected portion 47 for picking up and feeding coins are constituted with the coin picking-up projection 36 and the coin collapsing projection 39.

Figure 5:
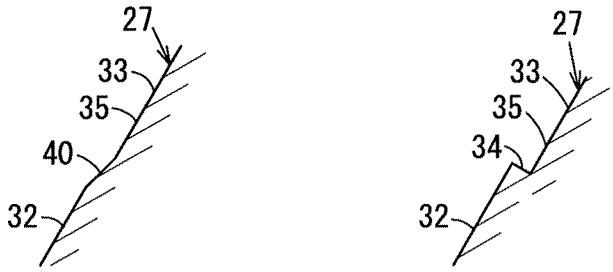
FIGS. 5(*a*) and 5(*b*) illustrate a partial sectional view of the tilted disk of the same as the above, FIG. 5(*a*) provides a sectional view indicated by the arrow B-B in FIG. 2 and FIG. 5(*b*) provides a sectional view indicated by the arrow D-D in FIG. 2.

The coin circumference retaining portion 34 is formed at a predetermined pitch in a circumferential direction corresponding to a plurality of circumferential coin picking-up projections 36, and the length in a circumferential direction of each of these coin circumference retaining portions 34 is given as a length of retaining one coin between the portion 34 and the coin picking-up projection 36 corresponding at a time when the tilted disk 27 is rotated in a normal direction. As illustrated in FIG. 2 and FIG. 5 (*a*), a sliding portion 40 for sliding coins downward, with a step portion between the high position 32 and the low position 33 being given as a tilted face, is formed between a plurality of these coin circumference retaining portions 34.

Upper and lower coin guide members 41 and 42 which constitute a coin feeding port 12 for feeding coins outside the circumference of the tilted disk 27, in other words, to the left direction corresponding to the normal rotation of the tilted disk 27, are arranged at an upper part region of the tilted disk 27. The upper coin guide member 41 is arranged so as to project from the front face of the tilted disk 27 in a region from the upper part of the tilted disk 27 which projects from the hopper frame 28 to the coin feeding port 12.

The lower coin guide member 42 is able to receive coins continuously from the coin circumference retaining portion 34 in proximity to and also in opposition to the front face of the coin face retaining portion 35, retaining the coins received from the coin circumference retaining portion 34 between the member 42 and the coin picking-up projection 36 and guiding them outside the circumference of the tilted disk 27. A groove 43 through which the coin picking-up projection 36 and the coin collapsing projection 39 are allowed to pass, while moving rotationally, is formed on the face opposing the coin face retaining portion 35 of the coin guide member 42.

Figure 6:
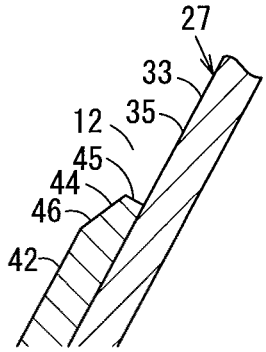
FIG. 6 provides a sectional view of the tilted disk and a coin guide member as indicated above by the arrow E-E in FIG. 2.

Formed on the coin guide member 42 is a thickness-direction regulating guide portion 44 for sliding down into the pooling hopper portion 13 coins left and accumulated in a multi-layered manner unlike one-layered coins in contact with the coin face retaining portion 35 among multi-layered coins sent to the coin feeding port 12 in a thickness direction. As illustrated in FIG. 6, the thickness-direction regulating guide portion 44 is constituted with a guide face 45 large enough to place one coin in contact with the coin face retaining portion 35 on the upper brim of the coin guide member 42 in a thickness direction and a tilted face 46 which slides down coins, with the guide face 45 kept. Then, as illustrated in FIG. 2, a coin-sending-direction changing passage 14 is formed approximately in the shape of a letter U between the coin feeding port 12 of the pooling hopper portion 13 and the coin identifying and sorting passage 15 in such a way that coins fed from the coin feeding port 12 to the left, which is one side of the lateral direction in the machine body 11, are changed in direction by 180 degrees and sent out to the right, which is the other side of the lateral direction. The coin-sending-direction changing passage 14 is provided with a passage face 51 which is formed on the front face of the partition frame 23 to guide the back face of a coin flush with the face of the coin face retaining portion 35 of the tilted disk 27. The coin guide member 41 and the coin guide member 42 for guiding the circumference of the coin continuously from the coin feeding port 12 are arranged both on the outer and the inner circumferences of the passage face 51.

A delivery circular plate 52 which is brought into contact with coins fed from the coin feeding port 12 between the coin feeding port 12 and the vicinity of the inlet of the coin identifying and sorting passage 15 to convey these coins one by one separately to a subsequent step of the coin identifying and sorting passage 15 is disposed on the coin-sending-direction changing passage 14. The delivery circular plate 52 is arranged at a circular recess 23*d* formed on the front face of the partition frame 23 and rotated and driven by a passage motor M2 (refer to FIG. 19) only in one direction, that is, in a counter-clockwise direction as shown in FIG. 2.

Figure 7:
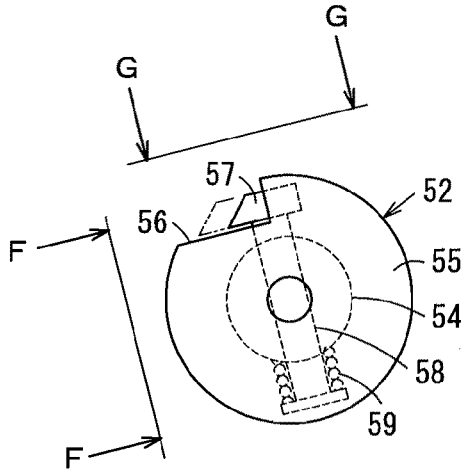
FIG. 7 provides a front view of the delivery circular plate of the same as the above.
Figure 8:
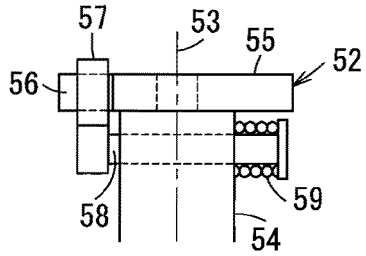
FIG. 8 provides a side view of the delivery circular plate of the same as the above indicated by the arrow F-F in FIG. 7.
Figure 9:
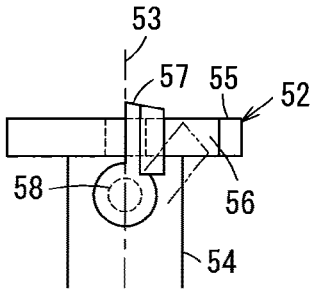
FIG. 9 provides a side view of the delivery circular plate of the same as the above indicated by the arrow G-G in FIG. 7.

As illustrated in FIG. 7 to FIG. 9, the delivery circular plate 52 is provided with a rotational face portion 55 which can be rotated at the center of the rotational axis 54 or a rotational axis line 53 which is approximately flush with the coin face retaining portion 35 of the tilted disk 27 and the passage face 51 and parallel with the rotational axis line 25 of the tilted disk 27.

A notch 56 is formed at a predetermined radial region from the rotational axis line 53 at the rotational face portion 55, and at least one delivery projection 57 which is brought into contact with coins fed from the coin feeding port 12 to convey the coins one by one separately to the coin identifying and sorting passage 15 is arranged on the notch 56.

The delivery projection 57 is supported pivotally by a shaft 58 passing through the rotational axis 54 orthogonally so as to swing in response to the rotational direction of the delivery circular plate 52, urged by a spring 59 as urging means attached to the shaft 58 toward a direction projecting from the rotational face portion 55, that is, a rotational direction of the delivery circular plate 52, thereby brought into contact with the brim of the notch 56 in a state projected from the rotational face portion 55 approximately in a perpendicular manner, and keeping the projected state.

Then, the delivery projection 57 can be projected in such a dimension that is smaller than a minimum thickness of the coin to be handled to the front face side of the rotational face portion 55 and also can be buried inside the rotational face portion 55 at the time when pressed to the rotational face portion 55 side or when pressed to a direction opposite to the rotational direction of the delivery circular plate 52.

Further, as illustrated in FIG. 1, FIG. 2, FIG. 10 and FIG. 11, the coin identifying and sorting passage 15 is formed approximately in an U-letter shape and provided with a first passage region 65 which conveys coins at a region above the pooling hopper portion 13 from the left, or one side of the machine body 11 to the right, or the other side thereof in a width direction, a return passage region 66 which conveys the coins from the terminal end of the first passage region 65 to the above direction and returns to the left of the machine body 11 in a width direction, and a second passage region 67 which conveys the coins from the terminal end of the return passage region 66 to the left of the machine body 11 in a width direction.

These passage regions 65 to 67 are provided with a passage face 51 formed on the front face of the partition frame 23 for guiding continuously the back face of a coin from a coin-sending-direction changing passage 14. Coin guide members 68 and 69 for continuously guiding the circumference of a coin from the coin-sending-direction changing passage 14 are arranged on both sides of the passage face 51. One of the coin guide member 68 on the starting end side of the first passage region 65 also acts as the coin guide member 41 of the coin-sending-direction changing passage 14.

A coin conveyor 70 for conveying one by one separately coins fed one by one separately from the delivery circular plate 52 is provided along these passage regions 65 to 67. The coin conveyor 70 is constituted with an endless belt 71, and a plurality of projections 72 are provided on the face opposing the passage face 51 of the belt 71 at a predetermined interval larger than a maximum diameter of the coin to be handled in a longitudinal direction of the belt 71. The belt 71 is arranged in opposition to the passage face 51 in a dimension larger than a maximum thickness of the coin to be handled, and the projection 72 is arranged in opposition to the passage face 51 in a dimension smaller than a minimum thickness of the coin to be handled.

The belt 71 is stretched to be installed for rotational movement along pulleys 73, 73, 73, and 73 arranged so as to move rotationally on the respective inner circumferences at the starting end portion and the last end portion of the first passage region 65 as well as at the starting end portion and the last end portion of the second passage region 67 and given tension from a tension roller 74 which is arranged on the outer periphery between the pulley 73 at the last end portion of the second passage region 67 and the pulley 73 at the starting end portion of the first passage region 65 to press the belt 71. A semi-circular engagement groove 75 with which the projection 72 of the belt 71 is engaged is formed on each of the pulleys 73, 73, 73, and 73.

The belt 71 moves rotationally in conjunction with the rotation of a delivery circular plate 52 by a passage motor M2 common to the delivery circular plate 52, receives coins sent from the delivery circular plate 52 one by one separately between projections 72 in a longitudinal direction of the belt and presses the coins one by one separately by the projection 72 located behind the coins, thereby conveying these coins. It is noted that the speed of conveying coins by the delivery circular plate 52 and the belt 71 is set to be slightly faster than the speed of feeding coins by the tilted disk 27.

A pulling-over member 77 for pressing a coin to a coin-supporting brim portion 68*a* of the lower coin guide member 68 (acting also as the coin guide member 41), a foreign object separating portion 79 for separating a foreign object 78 (such as a foreign coin smaller in diameter than a minimum-sized coin to be handled or a clip) and receiving and accommodating them at the pooling hopper portion 13, and a coin identification portion 80 for identifying the coins are sequentially arranged at the first passage region 65 on the coin identifying and sorting passage 15 along the conveying direction.

The starting end region of the first passage region 65 on the coin identifying and sorting passage 15 is a lateral passage region moving to the right side following the coin-sending-direction changing passage 14 on the left side. The pulling-over member 77 and the foreign object separating portion 79 are arranged at the lateral passage region. The pulling-over member 77 is projected into the passage by an urging force resulting from a spring (not illustrated) arranged on the upper coin guide member 69 side, thereby pressing coins to the coin-supporting brim portion 68*a* on the lower coin guide member 68 (acting also as the coin guide member 41).

Figure 10:
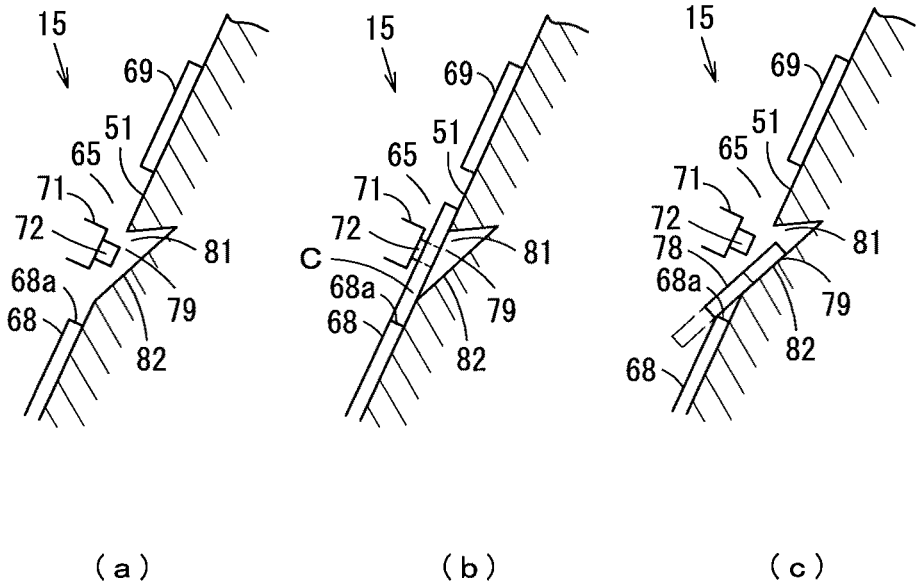
FIGS. 10(*a*)-10(*c*) provide sectional views as indicated above by the arrow H-H in FIG. 2, in which FIG. 10(*a*) provides a sectional view showing a case where no coins are conveyed, FIG. 10(*b*) provides a sectional view showing a case where authentic coins are conveyed, and FIG. 10(*c*) provides a sectional view showing a case where a foreign object is found.

As illustrated in FIG. 10, the foreign object separating portion 79 is provided on the passage face 51 with a separation groove 81 so as to oppose the belt 71, and a separation guide face 82 having a larger tilted angle than the passage face 51 is formed inside the separation groove 81. A downward extended face of the separation guide face 82 is arranged to the left further from the coin-supporting brim portion 68*a* of the coin guide member 68. As illustrated in FIG. 10 (*b*), authentic coins to be handled are not advanced into the separation groove 81 but allowed to pass through the separation groove 81, with the lower part of the coin being placed on the coin-supporting brim portion 68*a* of the coin guide member 68, and can be conveyed to a subsequent step. Further, as illustrated in FIG. 10 (*c*), regarding a foreign object such as a small-sized coin, the upper part of the foreign object is advanced into the separation groove 81, and the lower part of the foreign object is dropped after removal from the coin-supporting brim portion 68*a* of the coin guide member 68 and received and accommodated into the pooling hopper portion 13.

The coin identification portion 80 identifies authentic coins in accordance with the denominations and rejected coins such as a blemished coin, unidentified coin and foreign coin.

Further, as illustrated in FIG. 2, a deposited/rejected coin diverging portion 84 for diverging deposited/rejected coins is provided at the return passage region 66. It is noted that the structure of the deposited/rejected coin diverging portion 84 maybe the same as that of the denomination-specific diverging portion 86 provided at the second passage region 67 and the structure will be described by referring to the denomination-specific diverging portion 86.

A deposited/rejected coin chute 85 for guiding deposited/rejected coins which have been diverged to the deposited/rejected coin accommodating portion 16 below is arranged at the lower part of the deposited/rejected coin diverging portion 84. The deposited/rejected coins which have been guided to the deposited/rejected coin accommodating portion 16 can be taken out from the front face side of the machine body 11.

Further, as illustrated in FIG. 2, the second passage region 67 is able to convey coins, with these coins placed on the coin-supporting brim portion 69*a* of the lower coin guide member 69. The second passage region 67 is provided with a denomination-specific diverging portion 86 for diverging coins according to the denominations. A temporary storage coin taking-out portion 87 for taking out temporarily stored coins from the second passage region 67 to the coin collective and temporary storage portion 18 is provided at the terminal end are of the second passage region 67.

Figure 11:
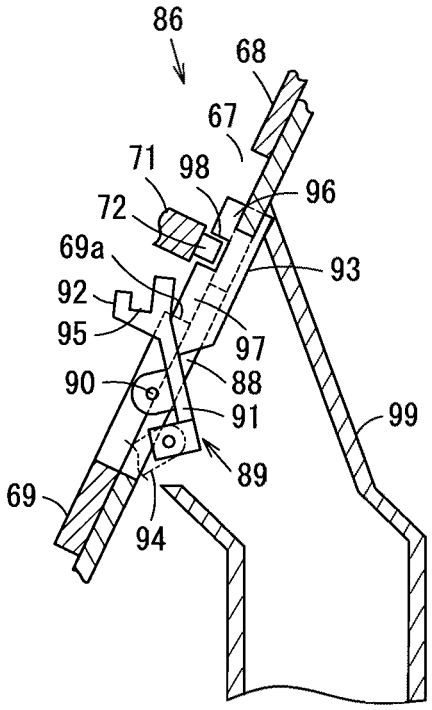
FIG. 11 provides a sectional view illustrating a state that coins are sorted by the coin sorting portion of the same as the above.

As illustrated in FIG. 1, FIG. 2 and FIG. 11, at each of the denomination-specific diverging portions 86, an opening 88 is formed from the passage face 51 to the lower coin guide member 69. A diverging member 89 is arranged inside the opening 88 so as to swing in an anteroposterior direction with a shaft 90 as a support point which is parallel with the passage direction (conveying direction).

The diverging member 89 is provided with a supporting portion 91 which is supported by the shaft 90, a passing guide portion 92 for allowing non-diverged corresponding denomination coins to pass is provided at the upper edge of the supporting portion 91, and a diverging guide portion 93 for taking the diverged corresponding denomination coins into the back part side of the opening 88 and diverging these coins is provided at the back part of the supporting portion 91. A driving force derived from each of diverging motors M5-1 to M5-6 (refer to FIG. 19) is transmitted via each of arms 94 to the supporting portion 91 of each of the diverging members 89, and the passing guide portion 92 is changed over to a passing position located at the opening 88, and the diverging guide portion 93 is changed over to a diverging position which retracts in front of the opening 88.

The passing guide portion 92 is shaped so as to give approximately an overturned letter U cross section when viewed from the passage direction, provided with a passing groove 95 for supporting coins and allowing them to pass. When the passing guide portion 92 is at the passing position as shown in FIG. 1, the right face and the bottom face on the passing groove 95 are approximately flush with the passage face 51 and the coin-supporting brim portion 69*a* of the coin guide member 69, guiding the back face and the circumference at the lower part of a coin, together with the passage face 51 and the coin-supporting brim portion 69*a* of the coin guide member 69, and allowing the coin to pass. It is noted that the left face of the passing groove 95 is made slightly larger than a maximum thickness of a coin, as compared with the right face, thereby allowing the coin to pass. Further, when it is at the diverging position as shown in FIG. 11, the passing guide portion 92 retracts in front of the opening 88.

A diverging guide portion 93 is shaped so as to give approximately a letter L cross section when viewed from the front face side, and provided with a tilted portion 96 arranged to be tilted with respect to the second passage region 67, with the upper part side being positioned at the upstream side in a passage direction of the second passage region 67, and also provided with a perpendicular portion 97 which is perpendicular to the passage direction of the second passage region 67 from the lower part of the tilted portion 96. The diverging guide portion 93 is provided with a notch 98 for preventing interference with a projection 72 of a belt 71. Then, the diverging guide portion 93 projects to the front face side from the passage face 51, when it is at the diverging position shown in FIG. 11, and takes into the opening 88 coins conveyed at the second passage region 67 through the tilted portion 96, the perpendicular portion 97, and the back face side of the support portion 91. Further, the diverging guide portion 93 retracts into the back of the opening 88, when it is at the passing position shown in FIG. 1.

Figure 19:
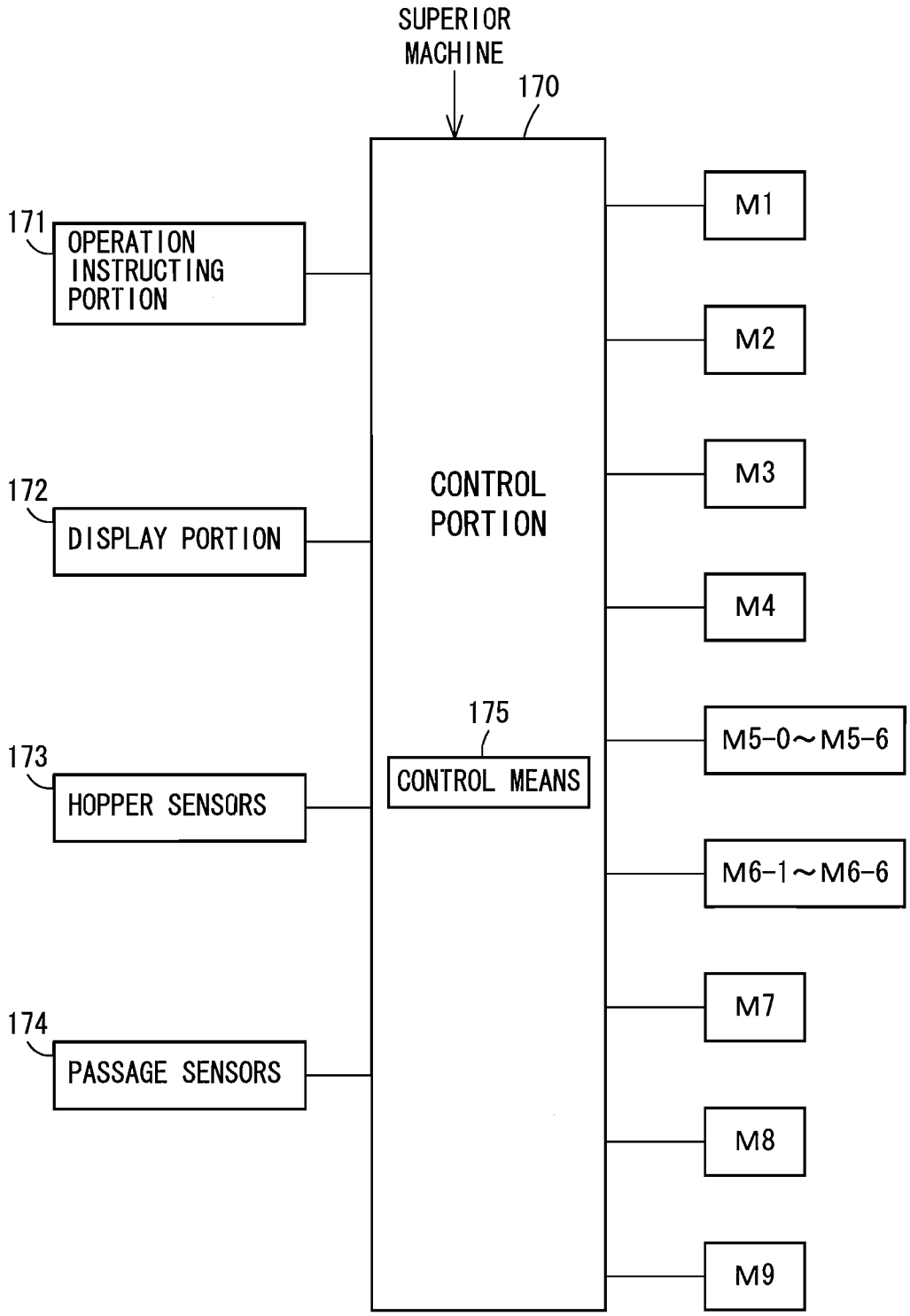
FIG. 19 illustrates a block diagram showing the control of the coin depositing and dispensing machine of FIG. 2.

Further, as described above, the deposited/rejected coin diverging portion 84 is the same in structure as the denomination-specific diverging portion 86, and driven by a diverging motor M5-0 (refer to FIG. 19).

A denomination-specific chute 99 which accepts coins diverged to the back side of the opening 88 at each of the denomination-specific diverging portions 86 and guiding them to the denomination-specific coin accumulating and ejecting portion 17 is arranged at the back side of each of the denomination-specific diverging portions 86.

Figure 12:
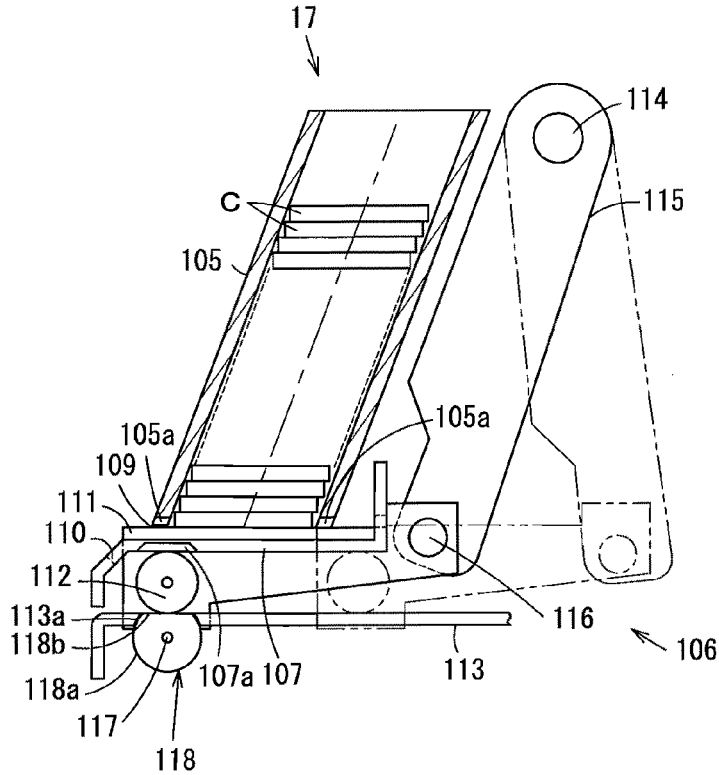
FIGS. 12(*a*), (*b*) provide sectional views of a denomination-specific coin accumulating and ejecting portion in which FIG. 12(*a*) provides a sectional view showing a case where coins are ejected and FIG. 12(*b*) provides a sectional view showing a case where vibration is given to coins.
Figure 12:
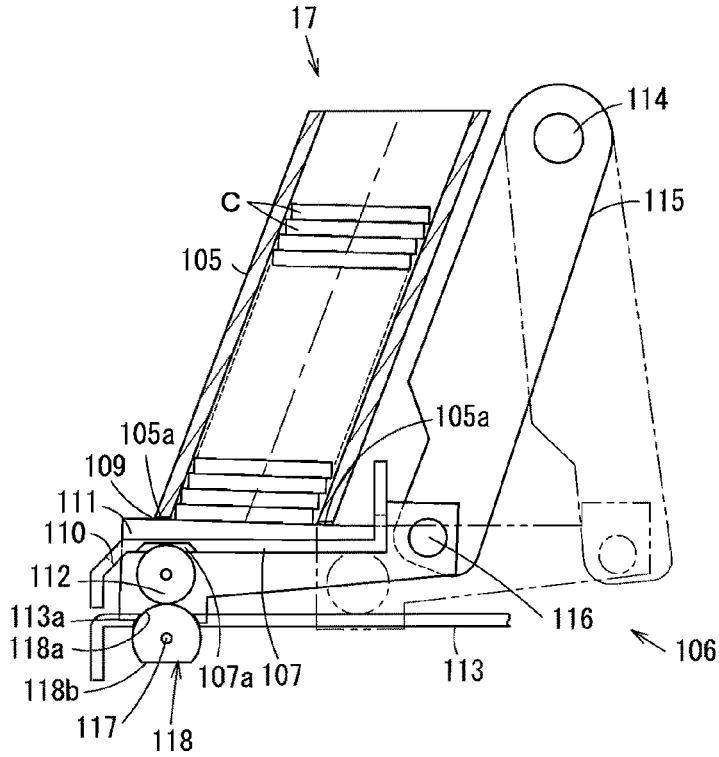
Figure 14:
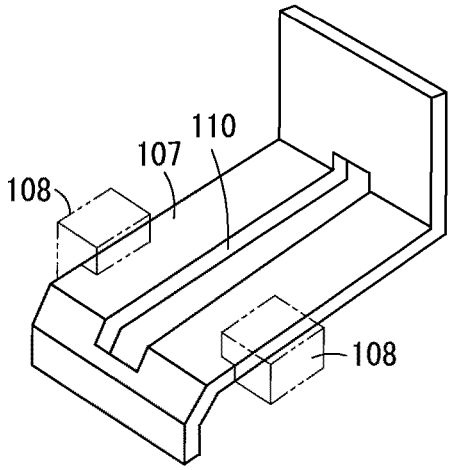
FIG. 14 is a perspective view of a bottom member of a denomination-specific accommodating portion in the denomination-specific coin accumulating and ejecting portions of FIGS. 12(*a*), 12(*b*).

Next, as illustrated in FIG. 1, FIG. 12(*a*) to FIG. 14, the denomination-specific coin accumulating and ejecting portion 17 is arranged at the back part region of the coin identifying and sorting passage 15 along the width direction of the machine body 11 and provided with a denomination-specific accommodating portion 105 which accommodates coins diverged at each of the denomination-specific diverging portions 86 and guided by a denomination-specific chute 99 in accordance with the denominations in an accumulated state. The denomination-specific accommodating portion 105 is a cylinder in which coins are deposited from the upper part and delivered from the lower part, in other words, coins diverged from the denomination-specific diverging portion 86 are accommodated from the upper part in an accumulated state and the accumulated and accommodated coins are ejected forward one by one from the lower part, and constituted with a cylinder arranged so that the upper part is tilted toward the back part.

A denomination-specific coin ejecting portion 106 which supports coins accommodated inside the denomination-specific accommodating portion 105 to accumulate them in a horizontal state and also ejects forward the accumulated and accommodated coins one by one from the lower part is disposed below each of the denomination-specific accommodating portions 105.

Each of the coin ejecting portions 106 is provided with a bottom face guide 107 which is arranged at such an interval that one coin is allowed to pass from the lower end of the denomination-specific accommodating portion 105, and side face guides 108 and 108 on both sides which guide the both sides in the width direction of coins ejected forward on the bottom face guide 107 are arranged above the bottom face guide 107. A coin ejecting port 109 for ejecting coins forward is formed between the lower end of the denomination-specific accommodating portion 105 and the bottom face guide 107 and side face guides 108 and 108 on both sides.

A slit-like guide groove 110 is formed at the center of the bottom face guide 107 in an anteroposterior direction, and an ejection member 111 which can move back and forth from the rear part with respect to the lower region of the denomination-specific accommodating portion 105, thereby ejecting coins at the lowest level placed on the bottom face guide 107, is arranged on the guide groove 110. A guide roller 112 is supported pivotally so as to rotate on the front edge side of the ejection member 111 on the front edge side thereof, and the guide roller 112 is arranged so as to move rotationally on a guide plate 113 arranged in parallel below the bottom face guide 107, and the front edge side of the ejection member 111 is supported so as to move horizontally.

A swing lever 115 which swings in an anteroposterior direction at the center of the rotationally-moving support point 114 of the upper edge is arranged on the back part side of the denomination-specific accommodating portion 105. The rear end of the ejection member 111 is connected by a connecting shaft 116 to the leading end on the lower edge side of the swing lever 115 away from the rotationally-moving support point 114 so as to move rotationally. The rotationally-moving support point 114 of each of the swing levers 115 is driven so as to move rotationally by using the ejection motors M6-1 to M6-6 (refer to FIG. 19) in accordance with the denominations, thereby swinging each of the swing levers 115. Then, as illustrated in FIG. 12 (*a*), the ejection member 111 advances into the lower region of the denomination-specific accommodating portion 105, retracts backward from the lower region of the denomination-specific accommodating portion 105 upon ejection of coins at a fixed position where coins accumulated inside the denomination-specific accommodating portion 105 are placed, and again advances into the lower region, thereby pressing and ejecting from a coin ejecting port 109 coins at the lowest level among the accumulated coins.

Further, an opening 113*a* is formed on the guide plate 113 below the guide roller 112 of each of the ejection members 111 at a fixed position, and a vibration cam 118 supported by a supporting shaft 117 arranged in parallel with the axial direction of the guide roller 112 is disposed on the opening 113*a* so as to rotate. An ascent-acting face portion 118*a* which is constituted with an outer circumferential face and projects above the upper face of the guide plate 113, thereby pushing up the guide roller 112, and a descent-acting face portion 118*b* in which the outer circumferential face is notched in a flat manner and allowed to be flush with the upper face of the guide plate 113 is formed on the circumferential face of the vibration cam 118. A position at which the descent-acting face portion 118*b* of the vibration cam 118 is flush with the upper face of the guide plate 113 is given as a position at which the vertical position of the ejection member 111 is regulated, and the regulating position is given as a rotation-halting position. Then, the vibration cam 118 is rotated, by which the guide roller 112 and the ejection member 111 are moved vertically, with the connecting shaft 116 given as a support point, thereby giving a vertical vibration directly to coins accumulated on the ejection member 111.

It is noted that a groove 107*a* is formed on the lower face of the bottom face guide 107 so as not to interfere with the ascending guide roller 112, and a groove 105*a* is formed at the denomination-specific accommodating portion 105 so as not to interfere with the ascending ejection member 111. Further, the guide roller 112 is securely kept in contact with the circumferential face of the vibration cam 118 due to the own weight of the ejection member 111 and the guide roller 112.

Figure 15:
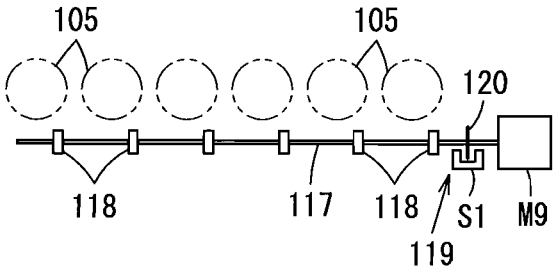
FIG. 15 provides a plan view of driving means for a vibration cam at the denomination-specific coin accumulating and ejecting portions of FIGS. 12(*a*), 12(*b*).

As illustrated in FIG. 15, a supporting shaft 117 is provided commonly along a plurality of denomination-specific accommodating portions 105 in accordance with the denominations, and each of the vibration cams 118 at each denomination-specific accommodating portion 105 is supported by the supporting shaft 117 and rotated in an integrated manner. The supporting shaft 117 is driven and rotated toward one direction by a vibration motor M9 as an electrical driving portion. Then, vibration-cam driving means which rotates the vibration cam 118 during acceptance of coins to the denomination-specific accommodating portion 105 is constituted by the supporting shaft 117, the vibration motor M9 and others.

Provided is a vibration-cam position detecting means 119 for detecting a regulated position at which the descent-acting face portion 118*b* of the vibration cam 118 is flush with the upper face of the guide plate 113. Then, the vibration cam position detecting means 119 is provided with a detection plate 120 having, for example, a slit attached to the supporting shaft 117, and a fixed-position detecting sensor S1 for detecting the slit of the detection plate 120, thereby detecting the position of the vibration cam 118 on the basis of detection by the fixed-position detecting sensor S1.

Figure 13:
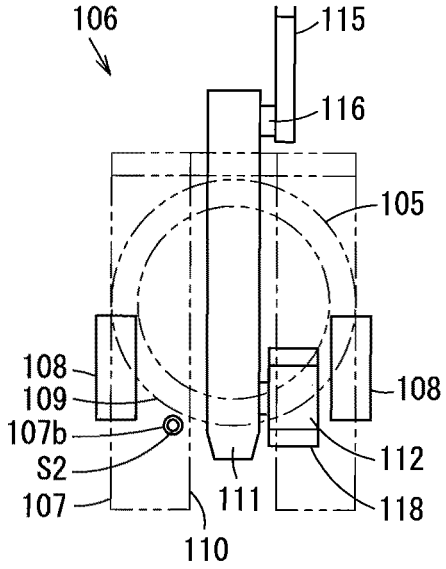
FIG. 13 provides a plan view of the denomination-specific coin accumulating and ejecting portion of FIGS. 12(*a*), (*b*).

As shown in FIG. 13, the coin ejecting port 109 is provided with a count sensor S2 for detecting the passage of ejected coins. The count sensor S2 is to detect a passage of coins ejected from a sensor hole 107*b* formed on the bottom face guide 107.

As shown for example in FIG. 2, at the lower part of the denomination-specific coin accumulating and ejecting portion 17, provided is an ejected-coin temporary storage portion 121 which temporarily stores coins ejected from the denomination-specific coin accumulating and ejecting portion 17 and releases the ejected coins temporarily stored at a coin-collector installing portion 22 facing the lower part thereof. The ejected-coin temporary storage portion 121 is provided with an ejected-coin temporary storage frame 122 arranged at the lower front region of the denomination-specific coin accumulating and ejecting portion 17 and a shutter 124 for opening and closing the release port 123 on the bottom face of the ejected-coin temporary storage frame 122, accepting at the ejected-coin temporary storage frame 122 coins ejected from the lower part of the denomination-specific coin accumulating and ejecting portion 17 and storing temporarily these coins on the shutter 124. The shutter 124 is opened and closed by being driven by an ejected-coin temporary storage portion motor M7 (refer to FIG. 19).

Figure 17:
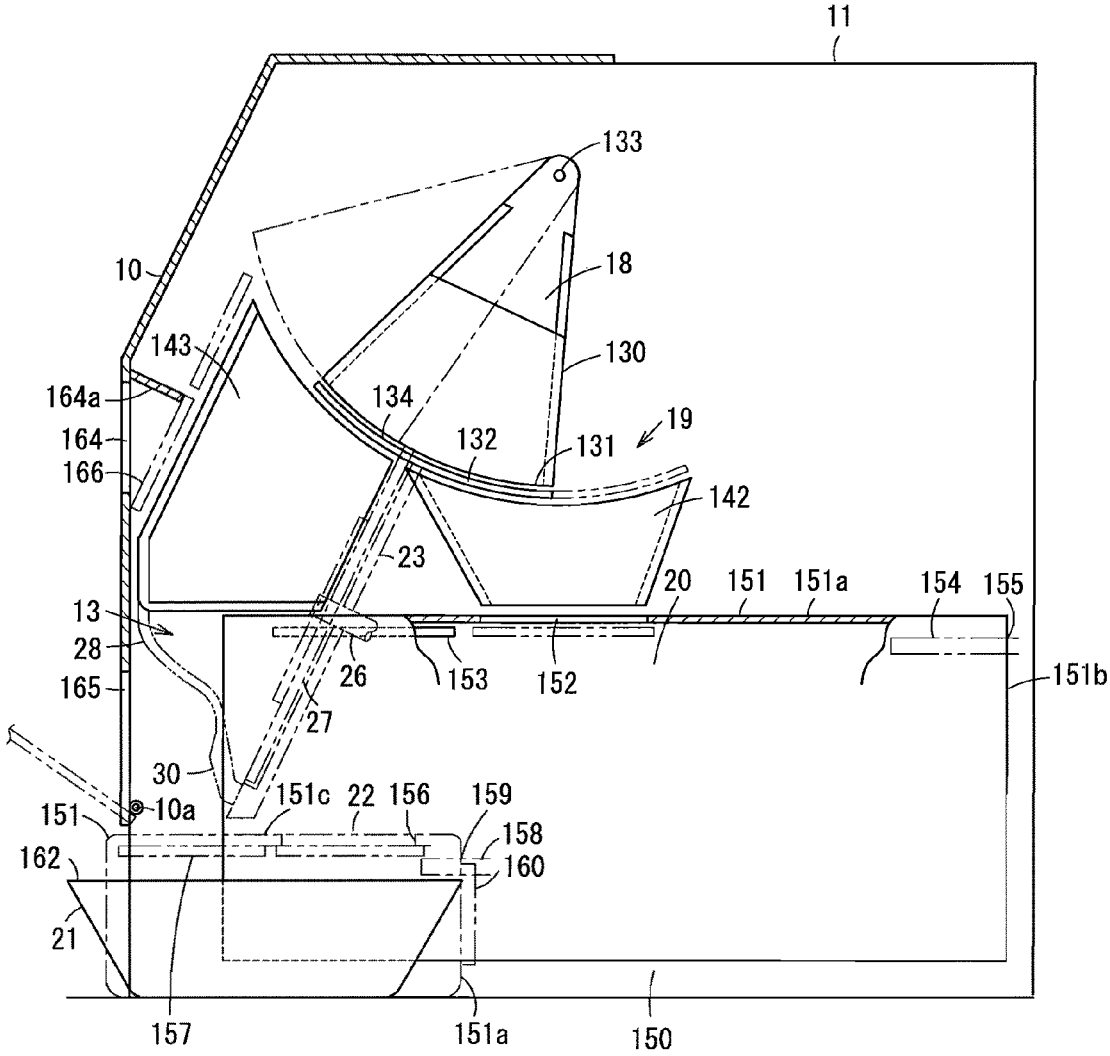
FIG. 17 provides a side view of the coin depositing and dispensing machine of FIG. 2 as viewed from the right side, or a side view showing a case where coins temporarily stored at the coin collective and temporary storage portion are released to a pooling hopper portion.
Figure 18:
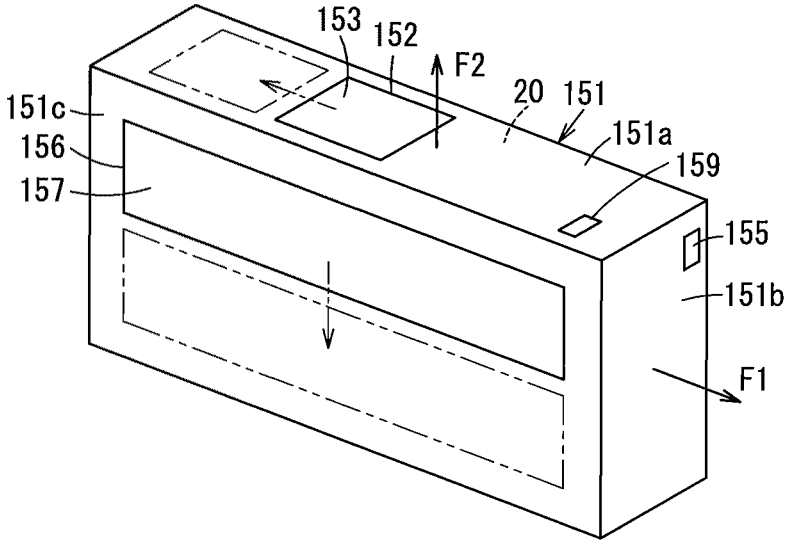
FIG. 18 provides a perspective view illustrating a coin cassette of the coin depositing and dispensing machine of FIG. 2.

Next, as illustrated in FIG. 2, FIG. 16 and FIG. 17, the coin collective and temporary storage portion 18 is arranged on the left side of the machine body 11 and below the temporary storage coin taking-out portion 87 of the coin identifying and sorting passage 15 and able to store collectively and temporarily coins taken out from the temporary storage coin taking-out portion 87 and also release deposited and temporarily-stored coins when instructions are given for accommodating deposited coins or for returning the deposited coins. The coin collective and temporary storage portion 18 is provided with a bar-like coin collective and temporary storage frame 130 which opens in a vertical direction and a shutter 132 which opens and closes a release port 131 on the bottom face of the coin collective and temporary storage frame 130, accepting inside the coin collective and temporary storage frame 130 coins taken out from the temporary storage coin taking-out portion 87 and temporarily storing these coins on the shutter 132 which closes the release port 131 on the bottom face.

The coin collective and temporary storage frame 130 is supported so as to swing in an anteroposterior direction, with the shaft 133 on the upper edge being given as a support point. It is shaped to be a fan-like frame at the center of the shaft 133, with the lower face being formed on the circular-arc face at the center of the shaft 133.

The shutter 132 is provided with a shutter portion 134 for opening and closing the release port 131 on the bottom face of the coin collective and temporary storage frame 130 and a shutter supporting portion 135 for supporting the shutter portion 134. The upper edge of the shutter supporting portion 135 is supported so as to swing in an anteroposterior direction, with the same shaft 133 as the coin collective and temporary storage frame 130 being given as a support point. The shutter portion 134 is formed on the circular-arc face at the center of the shaft 133.

Then, as illustrated in FIG. 2, FIG. 16 and FIG. 17, release means 19 is allowed to release coins at the coin collective and temporary storage portion 18 after being changed over to a first release side at the coin collective accommodation portion 20 and to a second release side at the pooling hopper portion 13. The release means 19 is provided with a coin collective and temporary storage frame moving mechanism 140 which moves the coin collective and temporary storage frame 130 in an anteroposterior direction by being driven by the coin collective and temporary storage frame motor M3 (refer to FIG. 19) and a shutter moving mechanism 141 which moves the shutter 132 in an anteroposterior direction by being driven by the shutter motor M4 (refer to FIG. 19).

A first release chute 142 for accepting coins released from the coin collective and temporary storage portion 18 and guiding them to the coin collective accommodation portion 20 is arranged on the first release side at the coin collective accommodation portion 20 side, whereas a second release chute 143 for accepting coins released from the coin collective and temporary storage portion 18 and guiding them to the pooling hopper portion 13 is arranged on the second release side at the pooling hopper portion 13.

Then, as illustrated in FIG. 16 and FIG. 17, a position at which the coin collective and temporary storage frame 130 is located halfway at the anteroposterior direction to close the release port 131 on the bottom face of the coin collective and temporary storage frame 130 by using the shutter 132 is given as a temporary storage position at which coins taken out from the temporary storage coin taking-out portion 87 are collectively and temporarily stored at the coin collective and temporary storage portion 18.

Where coins at the coin collective and temporary storage portion 18 are released to the first release side at the coin collective accommodation portion 20, as illustrated in FIG. 16, at first, the coin collective and temporary storage frame 130 is allowed to swing backward and face onto the first release chute 142. Then, the shutter 132 is allowed to swing forward, by which the release port 131 on the bottom face of the coin collective and temporary storage frame 130 is opened, thereby releasing the coins at the coin collective and temporary storage portion 18 to the first release chute 142. This state is given as a first release side position at the coin collective and temporary storage portion 18. Further, where coins at the coin collective and temporary storage portion 18 are released to the second release side at the pooling hopper portion 13, as illustrated in FIG. 17, at first, the coin collective and temporary storage frame 130 is allowed to swing forward and face onto the second release chute 143. Then, the shutter 132 is allowed to swing backward, by which the release port 131 on the bottom face of the coin collective and temporary storage frame 130 is opened, thereby releasing the coins at the coin collective and temporary storage portion 18 to the second release chute 143. This state is given as a second release side position at the coin collective and temporary storage portion 18.

Next, as illustrated in FIG. 2, FIG. 16 and FIG. 17, the coin collective accommodation portion 20 is constituted with a coin cassette 151 which is detachably attached to an attaching portion 150 mounted inside the machine body 11 from the front face of the machine body 11. The coin cassette 151 is shaped in a rectangular parallelepiped with six rectangular planes, arranged at the attaching portion 150 inside the machine body 11, and used as the coin collective accommodation portion 20. It is also arranged at the coin-collector installing portion 22 and used as a coin collector 21 which accepts coins recovered from the denomination-specific coin accumulating and ejecting portion 17.

In other words, the coin cassette 151 is available in a first arrangement posture (first acceptance posture) at which the longest side is along the anteroposterior direction of the machine body 11, the cassette is erected so as to be kept high in height and arranged by being inserted from forward into the attaching portion 150 inside the machine body 11, thereby accepting coins collectively accommodated from the coin collective and temporary storage portion 18, and in a second arrangement posture (second acceptance posture) at which the longest side is along the width direction of the machine body 11, the cassette is tilted so as to be kept low in height and arranged by being inserted from forward into the coin-collector installing portion 22, thereby accepting coins recovered from the denomination-specific coin accumulating and ejecting portion 17.

A first coin acceptance port 152 located below the first release chute 142 to accept coins is formed at the center of a face 151a which is given as the upper face when the coin cassette 151 is in the first arrangement posture. A first shutter 153 is arranged inside the first coin acceptance port 152 so as to be opened and closed, and a first opening/closing mechanism (not illustrated) for opening and closing the first shutter 153 is arranged inside the coin cassette 151. A first insertion hole 155 into which a first shutter opening member 154 disposed inside the machine body 11 is inserted through a face 151b which is given as the leading end face of the insertion direction F1 to the attaching portion 150 inside the machine body 11 when the coin cassette 151 is in the first arrangement posture. Then, when the coin cassette 151 is inserted from forward into the attaching portion 150, the first shutter opening member 154 is inserted into the first insertion hole 155, by which a first shutter opening/closing mechanism is actuated to open the first shutter 153. Further, when the coin cassette 151 is removed forward from the attaching portion 150, the first shutter opening member 154 is removed from the first insertion hole 155, by which the first shutter opening/closing mechanism automatically closes the first shutter 153.

With reference, for example, to FIGS. 1, 2, 9, 16 and 17, a second coin acceptance port 156 located below the release port 123 of the ejected-coin temporary storage portion 121 to accept coins is formed long in a width direction on a face 151c which is given as the upper face when the coin cassette 151 is in the second arrangement posture. A second shutter 157 is arranged inside the second coin acceptance port 156 so as to be opened and closed, and a second opening/closing mechanism (not illustrated) for opening and closing the second shutter 157 is arranged inside the coin cassette 151. A second insertion hole 159 into which a second shutter opening member 158 disposed inside the coin-collector installing portion 22 is inserted is formed on a face 151a which is given as the leading end face of the insertion direction F2 to the coin-collector installing portion 22 of the machine body 11 when the coin cassette 151 is in the second arrangement posture. Then, when the coin cassette 151 is inserted from forward into the coin-collector installing portion 22, the second shutter opening member 158 is inserted into the second insertion hole 159, by which a second shutter opening/closing mechanism is actuated to open the second shutter 157. Further, when the coin cassette 151 is removed by being pulled forward from the coin-collector installing portion 22, the second shutter opening member 158 is removed from the second insertion hole 159, by which the second shutter opening/closing mechanism automatically closes the second shutter 157. Next, as illustrated in FIG. 2, FIG. 16 and FIG. 17, the coin-collector installing portion 22 is provided at the front lower part of the machine body 11 or at the center in a width direction, and the coin collector 21 is arranged so as to be detachably attached from forward. The coin-collector installing portion 22 is provided with stoppers 160 and 161 for positioning the coin collector 21 respectively behind the coin-collector installing portion 22 and on the left side of the coin-collector installing portion 22.

A carton 162 is used as the coin collector 21 for collecting dispensed coins and recovered coins, and a coin cassette 151 at the coin collective accommodation portion 20 may also be used for collecting recovered coins. Both of the carton 162 and the coin cassette 151 can be arranged at the coin-collector installing portion 22 so as to be detachably attached to the portion 22.

Then, as illustrated in FIG. 1 and FIG. 16, the opening and closing cover 10 of the machine body 11 is provided at an anterior region of the pooling hopper portion 13 with an input port 164 for inputting coins to the pooling hopper portion 13; at an anterior region of the movable hopper frame portion 30 with an opening portion 165 for allowing the movable hopper frame portion 30 to be opened and moved; at an anterior region of the coin cassette 151 with an attaching/detaching port (not illustrated) which can be detachably attached to the coin cassette 151; and at an anterior region of the deposited/rejected coin accommodating portion 16 with an ejection port (not illustrated) for taking out deposited/rejected coins from the deposited/rejected coin accommodating portion 16.

Inside an input port 164 formed is an input port frame 164*a* for guiding coins input into the pooling hopper portion 13 from the upper part of the hopper frame 28 in such a posture that the upper part is tilted toward the back part, and an input port shutter 166 for opening and closing the input port 164 is arranged on the back part side of the input port frame 164*a*. The input port shutter 166 is disposed so as to slide in a vertical direction with respect to the opening and closing cover 10, opening the input port 164 when coins are deposited or replenished, and closing the input port 164 when coins are dispensed.

Further, as illustrated in FIG. 1 and FIG. 2, arranged is a hopper cover 167 which opens and closes the central region of the upper brim lower in height of the hopper frame 28. The hopper cover 167 is disposed at the partition frame 23 so as to slide according to the width direction of the machine body 11. In a normal use state where the partition frame 23 is at a partition position, the hopper cover 167 retracts so as to slide toward a lateral direction from the central region of the upper brim lower in height of the hopper frame 28. On the other hand, the hopper cover 167 is arranged so as to slide toward the central region of the upper brim lower in height of the hopper frame 28 when the partition frame 23 is unlocked and opened, thereby preventing coins from being dropped from the central region of the upper brim lower in height of the hopper frame 28, when the partition frame 23 is opened so as to tilt forward in a state that coins are inside the hopper frame 28.

Next, FIG. 19 is a block diagram illustrating a control process for controlling the coin depositing and dispensing machine. In the block diagram, a control portion 170 inputs signals from superior machine signals from an operation instructing portion 171 for instructing respective processes such as deposit, dispensing, replenishing, and recovery of coins and various types of modes, a display portion 172 for displaying an instruction state of respective processes such as deposit, dispensing, replenishing, and recovery of coins as well as an amount of coins, hopper sensors 173 including a plurality of sensors for detecting coins inside the pooling hopper portion 13, and passage sensors 174 including a plurality of sensors for detecting coins at a passage, for example, a coin identifying and sorting passage 15, thereby controlling individual motors M1 to M9.

Then, the control portion 170 is provided with control means 175 which controls so as to send coins at the coin collective and temporary storage portion 18 to an accommodating route during accommodation of coins or to a returning route during returning of coins, when instructions for accommodating deposited coins or instructions for returning deposited coins are given after being deposited and temporarily-stored coins are temporarily stored at the coin collective and temporary storage portion 18.

In other words, in accommodation and control of coins by the control means 175, a non-circulation accommodation mode and a circulation accommodation mode can be selected and established. In the non-circulation accommodation mode, when instructions for accommodating deposited coins are given, deposited and temporarily-stored coins at the coin collective and temporary storage portion 18 are sent by the release means 19 to the coin collective accommodation portion 20 on the first release side. Further, in the circulation accommodation mode, when instructions for accommodating deposited coins are given, deposited and temporarily-stored coins at the coin collective and temporary storage portion 18 are sent by the release means 19 to the pooling hopper portion 13 side, which is on the second release side, the tilted disk 27 of the pooling hopper portion 13 and the coin identifying and sorting passage 15 are actuated in a state that the movable hopper frame portion 30 is closed, by which coins of the denomination necessary for replenishing are diverged at the denomination-specific diverging portion 86 corresponding to the denomination concerned and replenished to the corresponding denomination-specific accommodating portion 105, coins of the denomination not necessary for replenishing are temporarily stored at the coin collective and temporary storage portion 18 via the temporary storage coin taking-out portion 87, and all the coins at the pooling hopper portion 13 are sent to the corresponding denomination-specific diverging portion 86 or the temporary storage coin taking-out portion 87, thereafter, the coins temporarily stored at the coin collective and temporary storage portion 18 are sent by the release means 19 to the coin collective accommodation portion 20, which is on the first release side. It is noted that the above-described flow of coins is an accommodating route.

Further, in controlling the return of coins by the control means 175, when instructions for returning deposited coins are given, deposited and temporarily-stored coins at the coin collective and temporary storage portion 18 are sent by the release means 19 to the pooling hopper portion 13 side, which is on the second release side, and also released downward to the pooling hopper portion 13 through the movable hopper frame portion 30 which is in an opening posture. It is noted that the above-described flow of the coins is a returning route.

Still further, the control means 175 has functions by which foreign object 78 separated at the foreign object separating portion 79 and received and accommodated at the pooling hopper portion 13 is released to the coin-collector installing portion 22 by opening the movable hopper frame portion 30.

Next, a description will be describing operation of the inventive coin depositing and dispensing machine of the present embodiment.

First, a description will be made for individual processes by a coin depositing and dispensing machine with reference to FIG. 19 to FIG. 27. The coin depositing and dispensing machine is to be operated, for example, by a teller or an employee of banking facilities, for the purpose of carrying out a depositing process of deposited coins which are received from customers or a dispensing process of paying out dispensed coins to customers.

Figure 20:
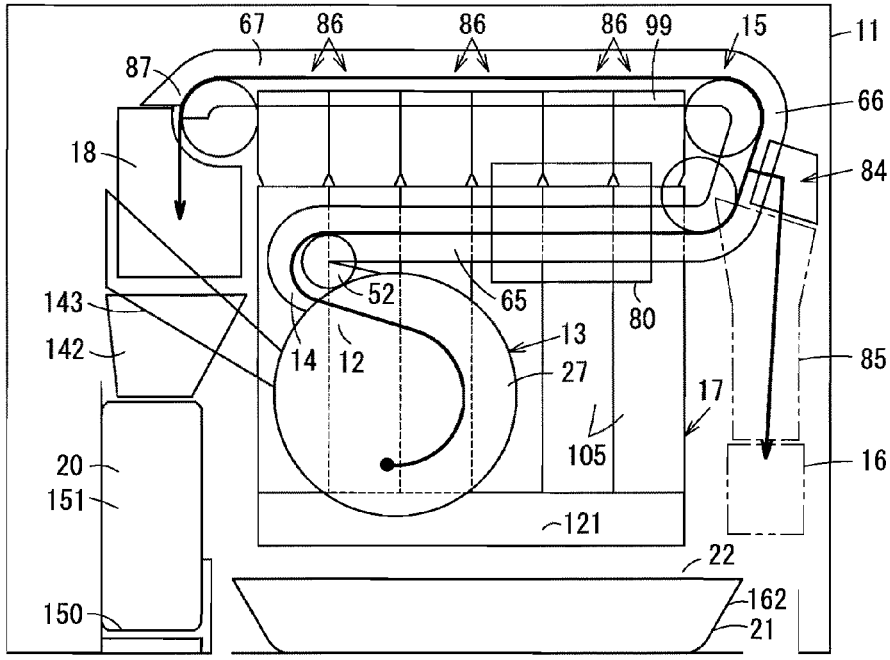
FIG. 20 provides an explanatory view of processes from counting of deposited coins to temporary storage of the coins in the coin depositing and dispensing machine of FIG. 2.

FIG. 20 shows processes from counting of deposited coins to temporary storage of coins in a depositing process. The depositing process is instructed at the operation instructing portion 171 of FIG. 19, and deposited coins received from customers are input from the input port 164 on the opening and closing cover 10 of the machine body 11 to the pooling hopper portion 13, by which deposited coins input to the pooling hopper portion 13 are detected by hopper sensors 173 to start the depositing process. The depositing process is started, by which the tilted disk 27 at the pooling hopper portion 13, the delivery circular plate 52 on the coin-sending-direction changing passage 14 and the belt 71 on the coin identifying and sorting passage 15 are respectively rotated.

Deposited coins inside the pooling hopper portion 13 are fed from the coin feeding port 12 to the coin-sending-direction changing passage 14 one by one separately by the tilted disk 27 at the pooling hopper portion 13. Then, the deposited coins fed from the coin feeding port 12 by the delivery circular plate 52 on the coin-sending-direction changing passage 14 are received one by one separately and delivered to a space between projections 72 of the belt 71 on the coin identifying and sorting passage 15 and conveyed along the coin identifying and sorting passage 15 one by one separately by the projections 72 of the belt 71 on the coin identifying and sorting passage 15.

Deposited coins conveyed at a first passage region 65 on the coin identifying and sorting passage 15 are identified by using a coin identification portion 80.

Deposited coins identified to be authentic through the result of identification by the coin identification portion 80 are conveyed from the first passage region 65 through the return passage region 66 to the terminal end of the second passage region 67, taken out from the temporary storage coin taking-out portion 87 on the terminal end of the second passage region 67 and accommodated at a coin collective and temporary storage portion 18. In this instance, at the coin collective and temporary storage portion 18, the coin collective and temporary storage frame 130 and the shutter 132 are at a temporary storage position, thereby collectively and temporarily storing the deposited coins accepted from the temporary storage coin taking-out portion 87 on the terminal end of the second passage region 67.

Deposited/rejected coins which are identified to be rejected coins as the result of identification by the coin identification portion 80 are diverged at the deposited/rejected coin diverging portion 84 in a return passage region, and guided through the deposited/rejected coin chute 85 to the deposited/rejected coin accommodating portion 16 so that they can be taken out from an ejection port on the opening and closing cover 10. Then, if the deposited coins are not detected any more by hopper sensors 173 at the pooling hopper portion 13 or the coins are not identified for a predetermined period of time by the coin identification portion 80, all deposited coins which have been so far input are considered to be completed for processes from the counting of deposited coins to the temporary storage. Therefore, the tilted disk 27 at the pooling hopper portion 13, the delivery circular plate 52 on the coin-sending-direction changing passage 14 and the belt 71 on the coin identifying and sorting passage 15 are respectively halted. Further, the result of identification is displayed at the display portion 172, thereby confirming the accommodation or return of the deposited coins. Where rejected coins are found, deposited/rejected coins are taken out from the deposited/rejected coin accommodating portion 16 and returned to customers.

Further, in a case where deposited and accommodated coins are not identified for a predetermined period of time at the coin identification portion 80 regardless of the fact that coins are detected by the hopper sensors 173 at the pooling hopper portion 13, the tilted disk 27 is once halted and subjected to a normal rotation and a reverse rotation repeatedly for a predetermined period of time or at a predetermined number of times. In the meantime, if the coins are fed from the pooling hopper portion 13 and detected by the coin identification portion 80, the tilted disk 27 is returned to a normal rotation. When the tilted disk 27 is rotated reversely, guide portions 38 mounted on a coin picking-up projection 36 and a coin collapsing projection 39 act to prevent deposited and accommodated coins from being caught by a pin 37, thereby preventing the occurrence of jamming of coins.

Further, where a foreign object 78 is input into the pooling hopper portion 13, together with deposited coins, the foreign object 78 is separated at a foreign object separating portion 79 provided in a region further upstream from the coin identification portion 80 at the first passage region 65 on the coin identifying and sorting passage 15, and received and accommodated at the pooling hopper portion 13. Therefore, the coin identification portion 80 fails in identifying deposited and accommodated coins for a predetermined period of time regardless of the fact that coins are detected by hopper sensors 173 at the pooling hopper portion 13. Thus, the tilted disk 27 is once halted and subjected to a normal rotation and a reverse rotation repeatedly for a predetermined period of time or at a predetermined number of times, but the coin identification portion 80 continues to fail in detecting deposited and accommodated coins. If the coin identification portion 80 still fails in detecting the deposited and accommodated coins even after the tilted disk 27 is subjected to a normal rotation and a reverse rotation repeatedly for a predetermined period of time or at a predetermined number of times, it is judged that a foreign object 78 is present. Then, the movable hopper frame portion 30 at the pooling hopper portion 13 is opened to release the foreign object 78 to a carton 162 below. In this instance, the tilted disk 27 is rotated in a normal direction and in a reverse direction, by which the foreign object 78 can be released more reliably. It is, therefore, possible to prevent the occurrence of jamming of coins at the coin identifying and sorting passage 15 due to the foreign object 78 and easily take out the foreign object 78.

In the deposited-coin identification and temporary storage process, which is a depositing process, where coins are jammed at regions such as a region of the pooling hopper portion 13 on the front face side of the partition frame 23, a region of the coin-sending-direction changing passage 14 and a region of the coin identifying and sorting passage 15 or where coins are jammed at a coin collective and temporary storage portion 18, an employee opens the opening and closing cover 10 on the machine body 11 so as to be tilted forward, thereby exposing regions such as a region of the pooling hopper portion 13 on the front face side of the partition frame 23 facing the front face side of the machine body 11, a region of the coin-sending-direction changing passage 14 and a region of the coin identifying and sorting passage 15 or the coin collective and temporary storage portion 18. The opening and closing cover 10 can be opened directly without an unlocking operation by using a key, thus making it possible to quickly eliminate jamming of coins by removing jammed coins. After removal of the jammed coins, the opening and closing cover 10 is closed onto the machine body 11 and a due process is resumed. Alternatively, as will be described when deposited coins are returned, the deposited coins are once returned to resume the deposited-coin identification and temporary storage process. In this instance, the partition frame 23 is locked by a partition position which closes the front opening 11*a* on the machine body 11 and positions in front of the denomination-specific coin accumulating and ejecting portion 17 inside the machine body 11 to partition the denomination-specific coin accumulating and ejecting portion 17 from the outside of the machine body 11. Therefore, an employee is kept away from coins at the denomination-specific coin accumulating and ejecting portion 17. It is noted that the opening and closing cover 10 can also be opened in a deposited-coin circulation process or a coin replenishment process, which will be described later.

Figure 21:
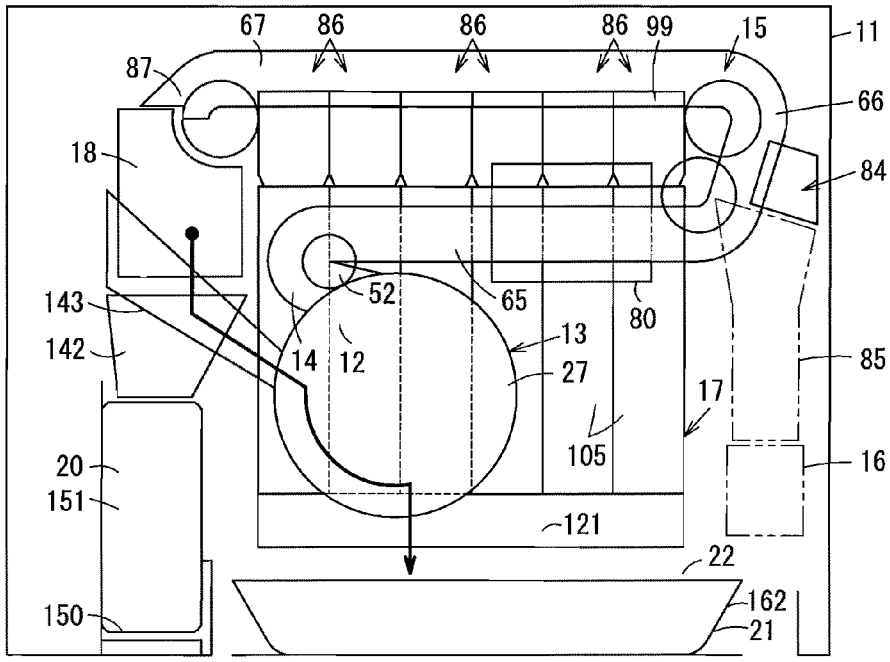
FIG. 21 provides an explanatory view of a process of returning deposited coins in the coin depositing and dispensing machine of FIG. 2.

FIG. 21 shows a process of returning deposited coins after temporary storage in a depositing process. Instructions are given for returning the deposited coins by the operation instructing portion 171, by which deposited/returned coins inside the coin collective and temporary storage portion 18 are moved to the second release side position at the coin collective and temporary storage portion 18, released at the pooling hopper portion 13 side, which is on the second release side, and sent through the second release chute 143 to the pooling hopper portion 13.

The movable hopper frame portion 30 at the pooling hopper portion 13 is opened, and deposited/returned coins inside the pooling hopper portion 13 are released from the release port 29 of the hopper frame 28 to the coin-collector installing portion 22 below and accepted at a carton 162 previously arranged at the coin-collector installing portion 22. The carton 162 is taken out from the coin-collector installing portion 22 on the machine body 11 to return the deposited/returned coins inside the carton 162. Thereafter, the coin collective and temporary storage portion 18 is returned to the temporary storage position, and the movable hopper frame portion 30 at the pooling hopper portion 13 is closed to complete a depositing process.

Figure 22:
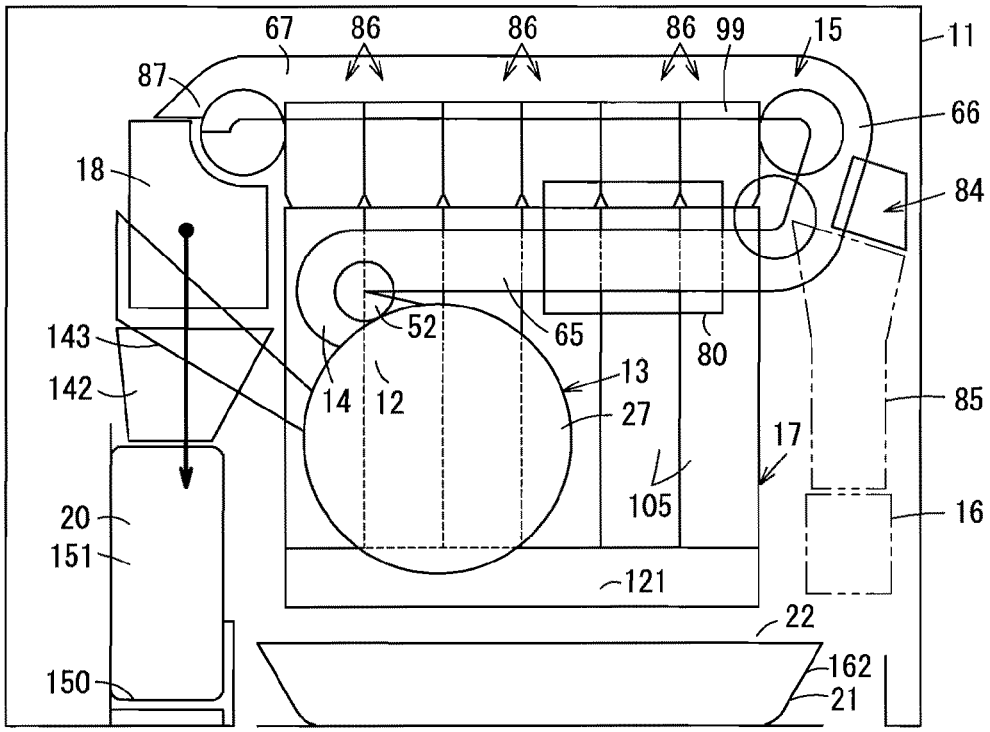
FIG. 22 provides an explanatory view of a process of deposited coin non-circulation accommodation in the coin depositing and dispensing machine of FIG. 2.

FIG. 22 shows the deposited coin non-circulation accommodation process after temporary storage, which is a depositing process. Where a deposited-coin non-circulation accommodation mode is set in advance, instructions are given for accommodating deposited coins by the operation instructing portion 171, by which deposited and accommodated coins inside the coin collective and temporary storage portion 18 are moved to a first release side at the coin collective and temporary storage portion 18, released to the coin collective accommodation portion 20, which is on the first release side, and accommodated through the first release chute 142 at the coin collective accommodation portion 20, that is, the coin cassette 151. Thereafter, the coin collective and temporary storage portion 18 is returned to the temporary storage position to complete the depositing process. The coin cassette 151 is arranged as a first arrangement posture so as to be inserted from forward into the attaching portion 150 inside the machine body 11, by which the first shutter opening member 154 is inserted into the first insertion hole 155. Then, the first shutter opening/closing mechanism is actuated, thereby the first shutter 153 is opened and moved to open a first coin acceptance port 152. Then, deposited and accommodated coins are received from the first coin acceptance port 152 and accommodated.

Figure 23:
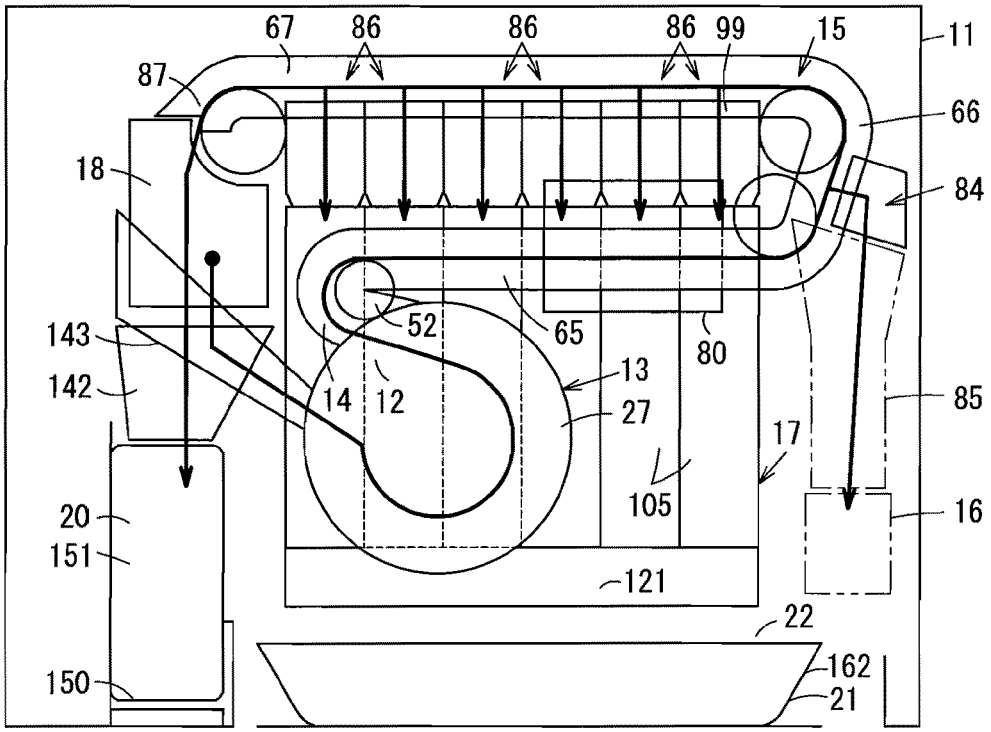
FIG. 23 provides an explanatory view of a process of deposited coin circulation accommodation in the coin depositing and dispensing machine of FIG. 2.

FIG. 23 shows the deposited coin circulation accommodation process after temporary storage, which is a depositing process. Where a deposited-coin circulation accommodation mode is set in advance, instructions are given for accommodating deposited coins by the operation instructing portion 171, by which deposited and accommodated coins inside the coin collective and temporary storage portion 18 are moved to a second release side position at the coin collective and temporary storage portion 18, released to the pooling hopper portion 13 side, which is a second release side, and sent through the second release chute 143 to the pooling hopper portion 13.

Thereafter, the coin collective and temporary storage portion 18 is moved to the first release side position where deposited and accommodated coins are released to the coin collective accommodation portion 20, thereby rotating again respectively the tilted disk 27 at the pooling hopper portion 13, the delivery circular plate 52 on the coin-sending-direction changing passage 14 and the belt 71 on the coin identifying and sorting passage 15.

Deposited and accommodated coins inside the pooling hopper portion 13 are fed one by one separately from the coin feeding port 12 to the coin-sending-direction changing passage 14 by the tilted disk 27 at the pooling hopper portion 13, then, the deposited and accommodated coins fed from the coin feeding port 12 by the delivery circular plate 52 on the coin-sending-direction changing passage 14 are received one by one separately and delivered to a space between projections 72 on the belt 71 of the coin identifying and sorting passage 15. Then, the deposited and accommodated coins are pushed and conveyed one by one separately along the coin identifying and sorting passage 15 by the projections 72 on the belt 71 of the coin identifying and sorting passage 15.

Deposited and accommodated coins, which are conveyed at the first passage region 65 on the coin identifying and sorting passage 15, are identified by the coin identification portion 80.

In this instance, as shown in FIG. 12 (a), (b), in the denomination-specific coin accumulating and ejecting portion 17, a vibration motor M9 is driven to rotate respective vibration cams 118 in an integrated manner by a supporting shaft 117. Each of the vibration cams 118 is rotated, by which an ejection member 111 is moved vertically, together with a guide roller 112, with a connecting shaft 116 being used as a support point, thereby imparting directly a vertical vibration to accumulated coins on the ejection member 111. As a result, coins received from the upper part of the denomination-specific accommodating portion 105 are dropped onto the accumulated coins which are being vibrated in a vertical direction. Therefore, these coins are subjected to the vibration, easily collapse and accumulate duly, without being erected.

Deposited and accommodated coins of the denomination, which are filled at the denomination-specific accommodating portion 105 in the denomination-specific coin accumulating and ejecting portion 17, that is, overflow coins, are not diverged by the corresponding denomination-specific diverging portion 86 but allowed to pass, taken out from the temporary storage coin taking-out portion 87 at the terminal end of the second passage region 67, and accommodated at the coin collective accommodation portion 20 through the coin collective and temporary storage portion 18 which has been moved to the first release side position for releasing the deposited and accommodated coins to the coin collective accommodation portion 20.

Deposited/rejected coins, which are identified to be rejected coins as a result of identification by the coin identification portion 80, are diverged at the deposited/rejected coin diverging portion 84 in a return passage region, and guided through the deposited/rejected coin chute 85 to the deposited/rejected coin accommodating portion 16. Then, if the deposited coins are not detected any more by hopper sensors 173 at the pooling hopper portion 13 or the coins are not identified for a predetermined period of time by the coin identification portion 80, all deposited and accommodated coins are considered to be completed for an accommodating process. Therefore, the coin collective and temporary storage portion 18 is returned to a temporary storage position, and the tilted disk 27 at the pooling hopper portion 13, the delivery circular plate 52 on the coin-sending-direction changing passage 14 and the belt 71 on the coin identifying and sorting passage region 15 are respectively halted to terminate a depositing process. Where rejected coins are found, deposited/rejected coins are taken out from the deposited/rejected coin accommodating portion 16 for recovery. Further, where a foreign object 78 is found, the foreign object 78 is released to a carton 162 after a similar process as shown in FIG. 20, and a teller is instructed to remove the carton 162 at the display portion 172.

Deposited and accommodated coins taken out from the temporary storage coin taking-out portion 87 at the terminal end of the second passage region 67, that is, overflow coins, are temporarily stored at the coin collective and temporary storage portion 18 and may be accommodated at the coin collective accommodation portion 20 after deposited coins are not detected any more by hopper sensors 173 at the pooling hopper portion 13 and deposited and accommodated coins are not identified at the coin identification portion 80 for a predetermined period of time.

Figure 24:
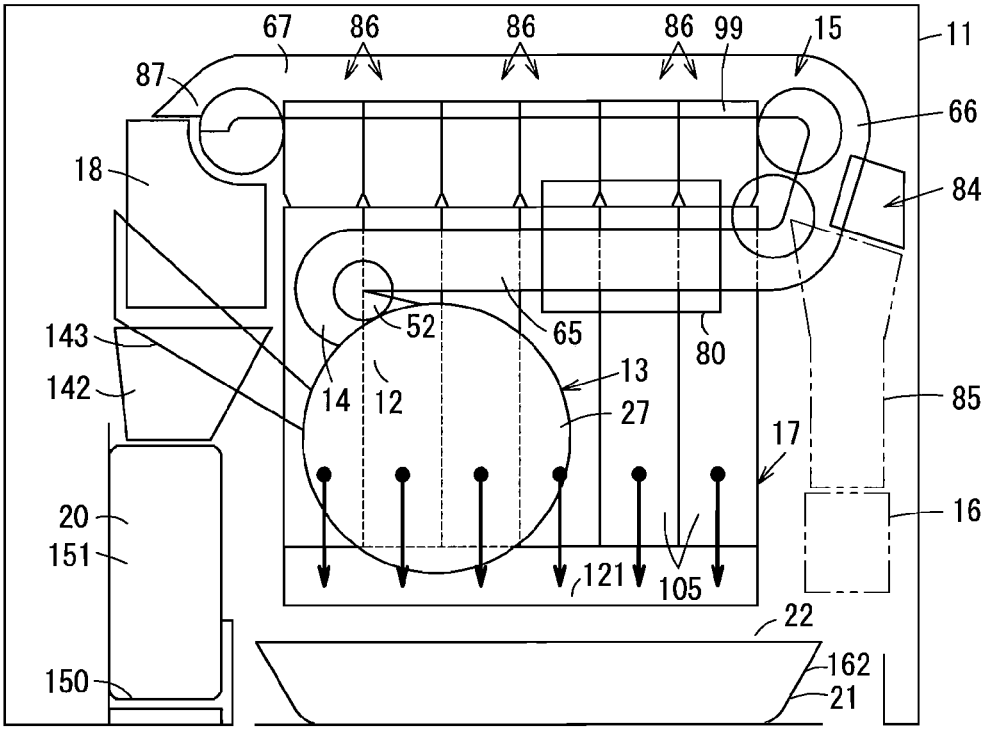
FIG. 24 provides an explanatory view of processes from counting of dispensed coins to temporary storage of the coins in the coin depositing and dispensing machine of FIG. 2.

FIG. 24 shows processes from counting of dispensed coins in a dispensing process to a temporary storage process. Instructions for the dispensing process are given from an operation instructing portion 171 to input a dispensing amount, thereby actuating a coin ejecting portion 106 which handles dispensed coins of the denomination concerned in the denomination-specific coin accumulating and ejecting portion 17. Coins at the lower part inside the denomination-specific accommodating portion 105 are ejected one by one from a coin ejecting port 109 by the actuated coin ejecting portion 106, and coins ejected from the coin ejecting port 109 are detected by a count sensor S2 to count the number of the coins. The coins ejected from the coin ejecting port 109 are accommodated at an ejected-coin temporary storage portion 121. In this instance, in the ejected-coin temporary storage portion 121, since a release port 123 on an ejected-coin temporary storage frame 122 is closed by a shutter 124, ejected coins are stored collectively and temporarily.

Figure 25:
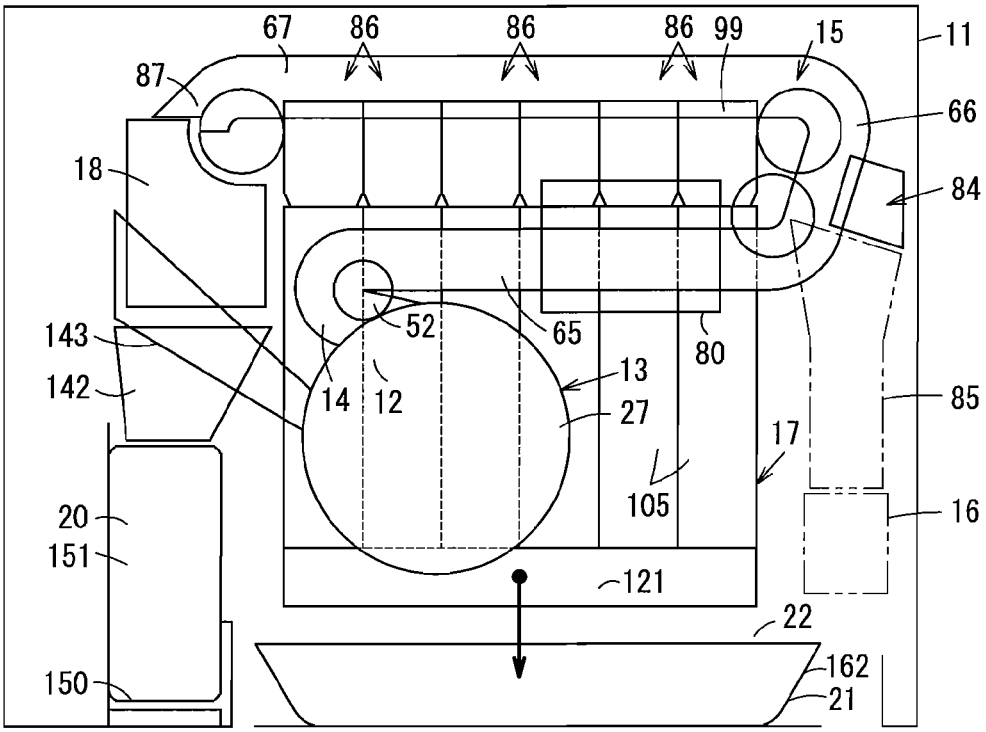
FIG. 25 provides an explanatory view of a process of dispensed coin release in the coin depositing and dispensing machine of FIG. 2.

FIG. 25 shows a process of dispensed-coin release, which is a dispensing process. After coins corresponding to an amount to be dispensed are completely ejected from the denomination-specific coin accumulating and ejecting portion 17, a shutter 124 of the ejected-coin temporary storage frame 122 is opened, by which ejected coins temporarily stored in the ejected-coin temporary storage portion 121 are released from a release port 123 on the ejected-coin temporary storage frame 122 to the coin-collector installing portion 22 below and received and accommodated on a carton 162 arranged previously at the coin-collector installing portion 22. The carton 162 is taken out from the coin-collector installing portion 22 of the machine body 11, and the ejected coins inside the carton 162 are paid out to customers. Thereafter, the shutter 124 is returned to a state that the release port 123 on the ejected-coin temporary storage frame 122 is closed, thereby completing the dispensing process.

As described above, ejected coins ejected from the denomination-specific coin accumulating and ejecting portion 17 are temporarily stored at the ejected-coin temporary storage portion 121, thereby making it possible to release the coins to a carton 162 when an amount of coins instructed to be dispensed is in agreement with an amount of coins actually ejected and prevent a difference in calculation between the amount of coins instructed to be dispensed and the amount of coins actually ejected.

Further, where coins are jammed at the denomination-specific coin accumulating and ejecting portion 17 during dispensing coins (deposit, replenishing, and recovery, etc., which will be described later, of coins), an employee borrows the key from a supervisor or others who are in charge of a coin depositing and dispensing machine or brings the key from a predetermined custodial site. Thereafter, the opening and closing cover 10 of the machine body 11 is opened so as to be tilted forward, a hopper cover 167 is allowed to slide to the central region of the upper brim lower in height of the hopper frame 28 and closed. Then, the locking means 24 of the partition frame 23 is unlocked by using the key, and the partition frame 23 is opened so as to be tilted forward. Thereby, the denomination-specific coin accumulating and ejecting portion 17 on the back part side of the partition frame 23 is exposed to eliminate jamming of coins.

After eliminating jamming of coins, the partition frame 23 is tilted backward and moved to a partition position which closes the front opening 11*a* on the machine body 11 and positions in front of the denomination-specific coin accumulating and ejecting portion 17 inside the machine body 11 to partition the denomination-specific coin accumulating and ejecting portion 17 from the outside of the machine body 11. Then, the locking means 24 of the partition frame 23 positioned at the partition position is locked by using the key, the opening and closing cover 10 is closed onto the machine body 11. A dispensing process is continuously resumed, or the process is once reset to commence again a new dispensing process.

Figure 26:
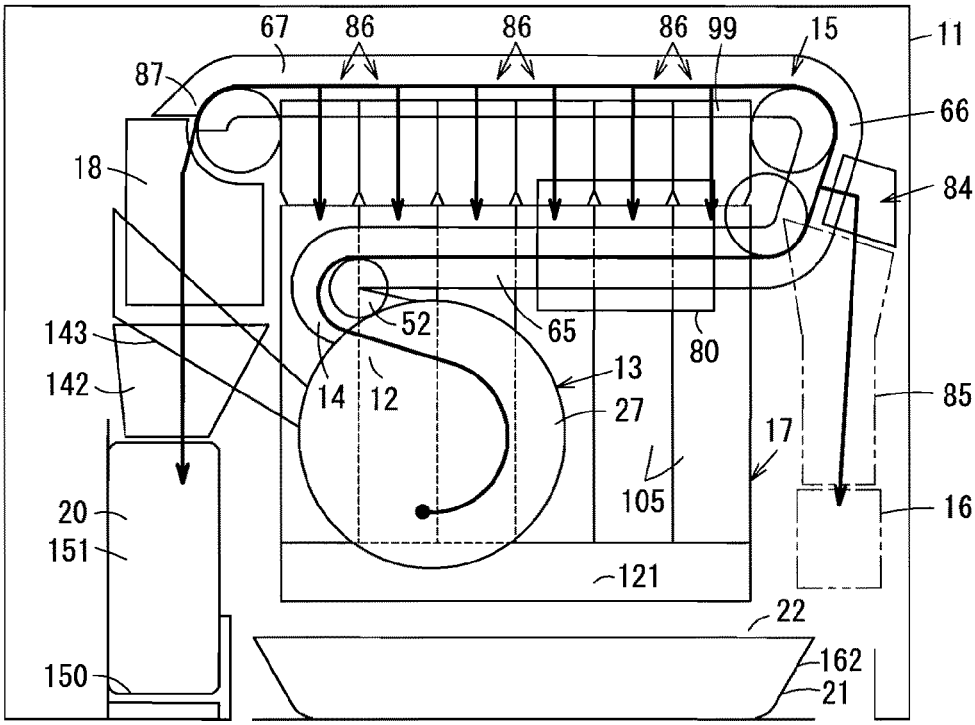
FIG. 26 provides an explanatory view of processes of load counting and replenishment counting in the coin depositing and dispensing machine of FIG. 2.

FIG. 26 shows a process of load counting in an initial replenishment when coins are not accommodated inside the machine body 11, which is a replenishment process, and a process of replenishment counting in a halfway replenishment when coins are decreased in number in the machine body 11.

Instructions for the replenishment process are given at the operation instructing portion 171, by which the coin collective and temporary storage portion 18 is moved to a first release side position which releases deposited and accommodated coins to the coin collective accommodation portion 20. Replenished coins are input into the pooling hopper portion 13, by which replenished coins thus input into the pooling hopper portion 13 are detected by hopper sensors 173 to commence a replenishment process. The tilted disk 27 at the pooling hopper portion 13, the delivery circular plate 52 on the coin-sending-direction changing passage 14 and the belt 71 on the coin identifying and sorting passage 15 are respectively rotated upon commencement of the replenishment process.

Replenished coins inside the pooling hopper portion 13 are fed one by one separately from the coin feeding port 12 to the coin-sending-direction changing passage 14 by using the tilted disk 27 at the pooling hopper portion 13, then, the replenished coins fed from the coin feeding port 12 by the delivery circular plate 52 on the coin-sending-direction changing passage 14 are received one by one separately and delivered to a space between projections 72 on the belt 71 of the coin identifying and sorting passage 15. Then, the replenished coins are pushed and conveyed one by one separately along the coin identifying and sorting passage 15 by the projections 72 of the belt 71 on the coin identifying and sorting passage 15.

Replenished coins conveyed at the first passage region 65 on the coin identifying and sorting passage 15 are identified by the coin identification portion 80.

Replenished coins which are identified to be authentic as the result of identification by the coin identification portion 80 are conveyed from the first passage region 65 through the return passage region 66 to a second passage region 67. Then, the coins are diverged from the second passage region 67 at the denomination-specific diverging portion 86 of the corresponding denomination, and accommodated through the denomination-specific chute 99 at the denomination-specific accommodating portion 105 in the denomination-specific coin accumulating and ejecting portion 17.

In this instance as well, the vibration cam 118 is rotated, by which coins accumulated inside the denomination-specific accommodating portion 105 are given a vertical vibration, thereby making it possible to prevent replenished coins falling down into the denomination-specific accommodating portion 105 from being erected and accumulate them reliably.

Deposited and accommodated coins of the denomination which are filled at the denomination-specific accommodating portion 105 in the denomination-specific coin accumulating and ejecting portion 17, that is, overflow coins, are not diverged by the corresponding denomination-specific diverging portion 86 but allowed to pass, taken out from the temporary storage coin taking-out portion 87 at the terminal end of the second passage region 67, and accommodated at the coin collective accommodation portion 20 through the coin collective and temporary storage portion 18 which has been moved to the first release side position for releasing the deposited and accommodated coins to the coin collective accommodation portion 20.

Replenished and rejected coins which are identified to be rejected coins as the result of identification by the coin identification portion 80 are diverged at the deposited/rejected coin diverging portion 84 in a return passage region and accommodated through the deposited/rejected coin chute 85 at the deposited/rejected coin accommodating portion 16.

Then, if the deposited coins are not detected any more by hopper sensors 173 at the pooling hopper portion 13 or the coins are not identified for a predetermined period of time by the coin identification portion 80, all replenished coins that have been so far input are considered to be completed for a replenishment process. Therefore, the coin collective and temporary storage portion 18 is returned to a temporary storage position. Then, the tilted disk 27 at the pooling hopper portion 13, the delivery circular plate 52 on the coin-sending-direction changing passage 14 and the belt 71 on the coin identifying and sorting passage 15 are respectively halted to terminate the replenishment process. Where rejected coins are found, the deposited/rejected coin accommodating portion 16 is withdrawn from the machine body 11 to take out replenished and rejected coins from the deposited/rejected coin accommodating portion 16 for recovering them.

Further, in a case where replenished coins are not identified for a predetermined period of time at the coin identification portion 80 regardless of the fact that the coins are detected by the hopper sensors 173 at the pooling hopper portion 13, the tilted disk 27 is once halted and subjected to a normal rotation and a reverse rotation repeatedly for a predetermined period of time or at a predetermined number of times. In the meantime, if the replenished coins are fed from the pooling hopper portion 13 and detected by the coin identification portion 80, the tilted disk 27 is returned to a normal rotation. Further, where a foreign object 78 is input into the pooling hopper portion 13, together with deposited coins, the foreign object 78 is separated at the foreign object separating portion 79 provided further upstream from the coin identification portion 80 at the first passage region 65 on the coin identifying and sorting passage 15 and accepted at the pooling hopper portion 13. Therefore, the coin identification portion 80 fails in identifying replenished coins for a predetermined period of time regardless of the fact that the coins are detected by hopper sensors 173 at the pooling hopper portion 13. Thus, the tilted disk 27 is once halted and subjected to a normal rotation and a reverse rotation repeatedly for a predetermined period of time or at a predetermined number of times, but the coin identification portion 80 continues to fail in detecting the replenished coins. If the coin identification portion 80 still fails in detecting the replenished coins even after the tilted disk 27 is subjected to a normal rotation and a reverse rotation repeatedly for a predetermined period of time or at a predetermined number of times, it is judged that a foreign object 78 is present. Then, the movable hopper frame portion 30 at the pooling hopper portion 13 is opened to release the foreign object 78 to a carton 162 below. In this instance, the tilted disk 27 is rotated in a normal direction and in a reverse direction, by which the foreign object 78 can be released more reliably. It is, therefore, possible to prevent the occurrence of jamming of coins at the coin identifying and sorting passage 15 due to a foreign object 78 and take out the foreign object 78 easily.

Replenished coins taken out from the temporary storage coin taking-out portion 87 at the terminal end of the second passage region 67, that is, overflow coins, are temporarily stored at the coin collective and temporary storage portion 18 and may be accommodated at the coin collective accommodation portion 20 after the replenished coins are not detected by hopper sensors 173 at the pooling hopper portion 13 and the replenished coins are not identified for a predetermined period of time at the coin identification portion 80.

Figure 27:
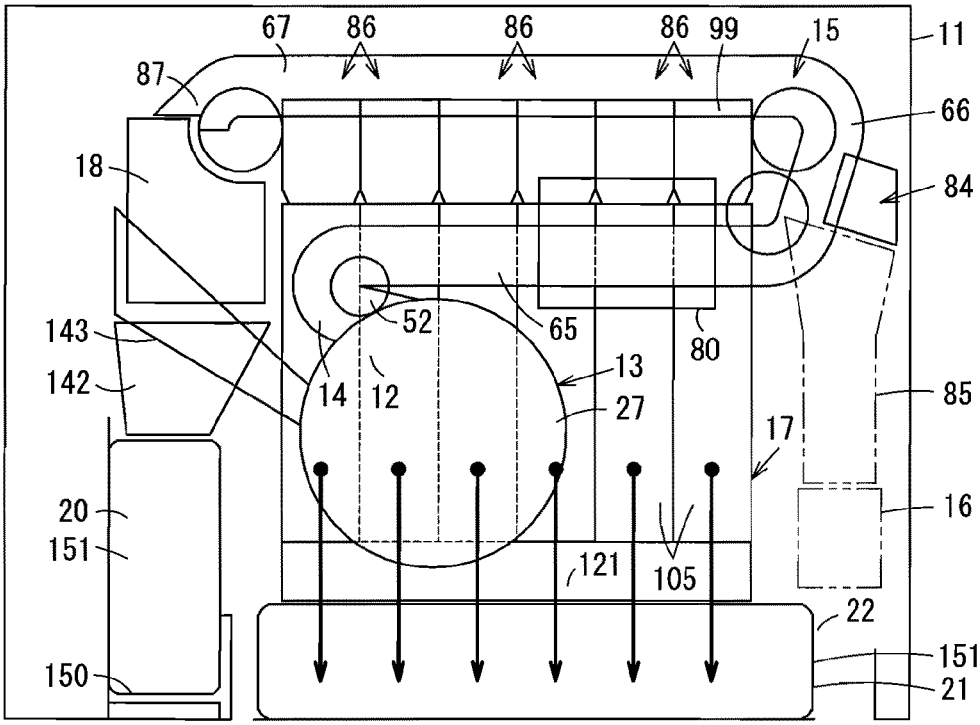
FIG. 27 provides an explanatory view of a process of recovery in the coin depositing and dispensing machine of FIG. 2.

FIG. 27 shows a recovery process in which a coin cassette 151 is used.

The coin cassette 151 arranged at the attaching portion 150 inside the machine body 11 is drawn out. The drawn-out coin cassette 151 is removed from a first shutter opening member 154, by which a first shutter opening/closing mechanism automatically closes a first shutter 153. As a result, coins accommodated inside the coin cassette 151 are secured for the accommodation state.

The removed coin cassette 151 is given as a second arrangement posture, inserted from forward into a coin-collector installing portion 22 on the machine body 11 and arranged therein. When the coin cassette 151 is inserted from forward into the coin-collector installing portion 22, a second shutter opening member 158 is inserted into a second insertion hole 159, by which a second shutter opening/closing mechanism is actuated to open and move a second shutter 157, thereby releasing a second coin acceptance port 156. The second coin acceptance port 156 is located below in opposition to the release port 123 at the ejected-coin temporary storage portion 121.

Instructions for the recovery process are given at the operation instructing portion 171, by which the coin ejecting portion 106 at the denomination-specific coin accumulating and ejecting portion 17 is actuated after the shutter 124 of the ejected-coin temporary storage portion 121 is opened. Then, recovered coins at the lower part inside the denomination-specific accommodating portion 105 are ejected one by one by the coin ejecting portion 106 from a coin ejecting port 109, and the recovered coins ejected from the coin ejecting port 109 are detected by a count sensor S2 to count the number of these coins. Recovered coins ejected from the coin ejecting port 109 are received and accommodated through the ejected-coin temporary storage portion 121 at which a shutter 124 is opened from the second coin acceptance port 156 on the coin cassette 151 arranged at the coin-collector installing portion 22. After all the recovered coins inside the denomination-specific coin accumulating and ejecting portion 17 are ejected, the shutter 124 of the ejected-coin temporary storage portion 121 is closed to terminate the recovery process.

Then, the coin cassette 151 in which accommodated coins are accommodated at the time of the first arrangement posture and recovered coins are accommodated at the time of the second arrangement posture is drawn forward from the coin-collector installing portion 22 on the machine body 11 to recover the coins. When the coin cassette 151 is drawn forward from the coin-collector installing portion 22, the second shutter opening member 158 is removed from the second insertion hole 159, by which the second shutter opening/closing mechanism automatically closes the second shutter 157.

It is noted that a carton 162 is arranged at the coin-collector installing portion 22 and coins may be recovered on the carton 162 in a recovery process. In this instance, recovered coins that have been ejected from a denomination-specific coin accumulating and ejecting portion 17 are temporarily stored at an ejected-coin temporary storage portion 121. When a predetermined number of recovered coins are temporarily stored at the ejected-coin temporary storage portion 121, ejection of recovered coins from the denomination-specific coin accumulating and ejecting portion 17 is once discontinued to open the shutter 124, thereby recovered coins inside the ejected-coin temporary storage portion 121 are released to the carton 162. Thereafter, the shutter 124 is closed to resume the ejection of recovered coins from the denomination-specific coin accumulating and ejecting portion 17. Above-described recovery motions may be repeated several times. It is, therefore, possible to release the recovered coins to the carton 162 after recovered coins are temporarily stored at the ejected-coin temporary storage portion 121 in an amount corresponding to an accommodating capacity of the carton 162 and also prevent the overflow of the recovered coins from the carton 162 due to an excessive amount of the recovered coins.

As described above, according to the coin depositing and dispensing machine, the partition frame 23 having the pooling hopper portion 13 and the coin identifying and sorting passage 15 on the front face is provided so as to be opened and closed between a partitioning position which is located in front of the denomination-specific coin accumulating and ejecting portion 17 inside the machine body 11 to partition the denomination-specific coin accumulating and ejecting portion 17 from the outside of the machine body 11 and an open position at which the denomination-specific coin accumulating and ejecting portion 17 is exposed to the outside of the machine body 11, the locking means 24 is used to lock at the partition position, thereby, coins located in a region of the pooling hopper portion 13 and a region of the coin identifying and sorting passage 15 are given as those outside the machine body which can be operated freely even in a state that the partition frame 23 is locked by the locking means 24, and coins at the denomination-specific coin accumulating and ejecting portion 17 are given as those inside the machine body which can be operated by unlocking the locking means 24 and opening the partition frame 23, thus making it possible to clearly differentiate the former from the latter. As a result, it is possible to easily eliminate jamming of coins in a region of the pooling hopper portion 13 and a region of the coin identifying and sorting passage 15 in a deposited-coin identification and temporary storage process during deposit of coins without an unlocking operation.

Coins at the coin collective and temporary storage portion 18 can be taken out as those outside the machine body. Further, coins at the coin collective accommodation portion 20 constituted with a coin cassette 151 detachably attached to the machine body 11 can be easily recovered as those inside the machine body.

Next, a description will be made for motions of feeding, separating and conveying coins from the pooling hopper portion 13 to the coin identifying and sorting passage 15 by referring to FIG. 28 to FIG. 30.

Figure 28:
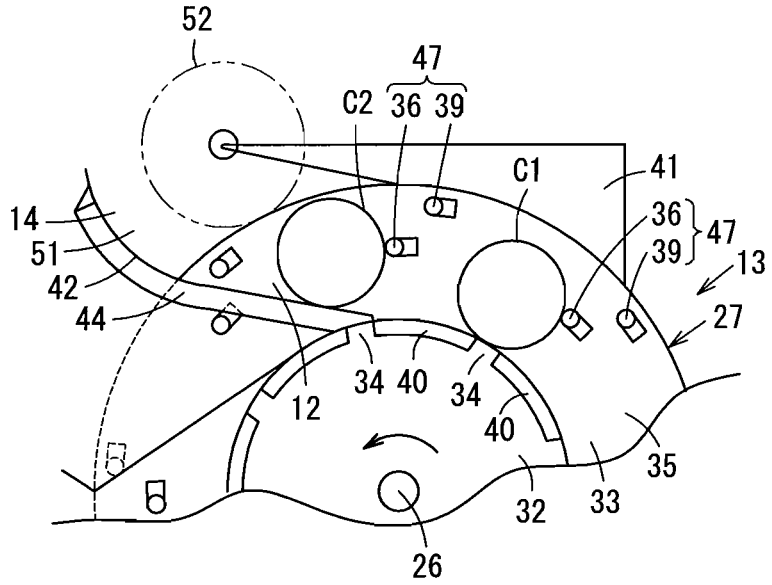
FIG. 28 provides an explanatory view of motions of feeding coins from the pooling hopper portion to the coin identifying and sorting passage of FIG. 2.

As illustrated in FIG. 28, the tilted disk 27 is rotated in a normal direction, thereby, one coin (C1), the back face of which is retained at the coin face retaining portion 35 in a lower region of the pooling hopper portion 13, is retained between a coin circumference retaining portion 34 and a coin picking-up projection 36, picked up at an upper part region of the tilted disk 27 and sent to a coin feeding port 12.

In this instance, in an attempt to pick up a plurality of coins accumulated in a bridge form between the coin circumference retaining portion 34 and the coin picking-up projection 36, only one coin is retained between the coin circumference retaining portion 34 and the coin picking-up projection 36, and the coins accumulated in a bridge form will fall down. In particular, since a sliding portion 40 is provided between a plurality of coin circumference retaining portions 34 in a circumferential direction, the coins accumulated in a bridge form reliably fall down through the sliding portion 40 at an earlier timing. It is, therefore, possible to send to the coin feeding port 12 only one of the coins retained between the coin circumference retaining portion 34 and the coin picking-up projection 36 and also prevent coins from jamming between the coin circumference retaining portion 34 and the coin picking-up projection 36 in the vicinity of the coin feeding port 12.

Coins (C2) picked up at an upper part region of the tilted disk 27 and sent to the coin feeding port 12 are received at the coin guide member 42 from the coin circumference retaining portion 34. Then, one of the coins is retained between the coin guide member 42 and the coin picking-up projection 36 and fed from the coin feeding port 12 to the coin-sending-direction changing passage 14 outside the circumference of the tilted disk 27.

In this instance, a thickness-direction regulating guide portion 44 of the coin guide member 42 acts to make coins sent in a multi-layered form in a thickness direction to a single layer of coins in contact with the coin face retaining portion 35, thereby sending them to the coin-sending-direction changing passage 14 and also allowing remaining coins to slide down. Therefore, the coins can be conveyed one by one separately to the coin-sending-direction changing passage 14, making it possible to prevent the occurrence of jamming of coins in the vicinity of the coin feeding port 12. Further, since coins slid down from the thickness-direction regulating guide portion 44 are received and accommodated at the pooling hopper portion 13, the slid-down coins can also be fed.

Figure 29:
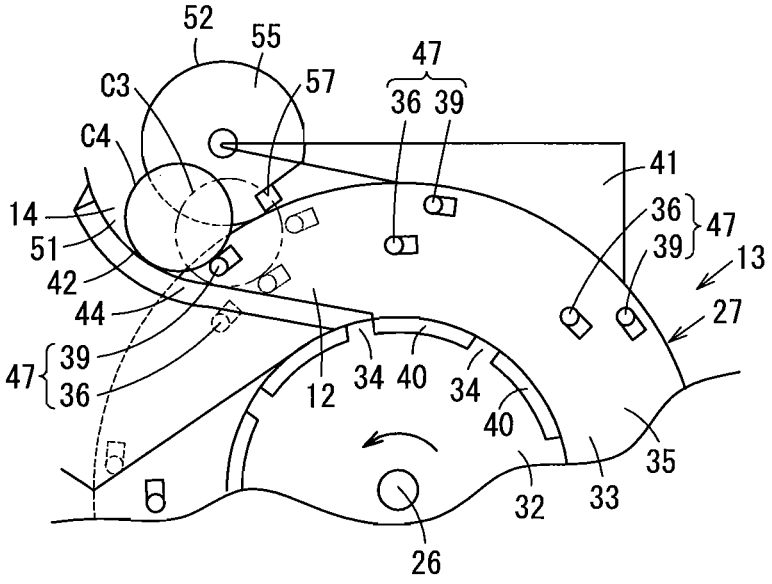
FIG. 29 provides an explanatory view of motions of feeding coins from the pooling hopper portion to the coin identifying and sorting passage following the motions illustrated in FIG. 28.

As illustrated in FIG. 29, coins (C3) fed from the coin feeding port 12 to the coin-sending-direction changing passage 14 are retained between the coin collapsing projection 39 and the coin guide member 42 and fed by the coin collapsing projection 39 continuing from the coin picking-up projection 36. Then, coins (C4) retained between the coin collapsing projection 39 and the coin guide member 42 and fed from the coin feeding port 12 to the coin-sending-direction changing passage 14 by the coin collapsing projection 39 are delivered to a delivery projection 57 of a delivery circular plate 52.

In this instance, if coins are accumulated in a bridge form between the coin guide member 42 and the coin picking-up projection 36 at a region leading to the coin feeding port 12 from which coins are fed outward from the tilted disk 27 or at a region in the vicinity of the coin feeding port 12, the bridge of coins can be collapsed by the coin collapsing projection 39 to prevent the occurrence of jamming of coins. Further, the delivery projection 57 on the delivery circular plate 52 can be buried into the rotational face portion 55 against an urging force derived from a spring, even if the delivery projection 57 bites a coin that remains between the delivery projection 57 and the coin guide member 42. Therefore, it is possible to prevent the occurrence of jamming of coins.

Figure 30:
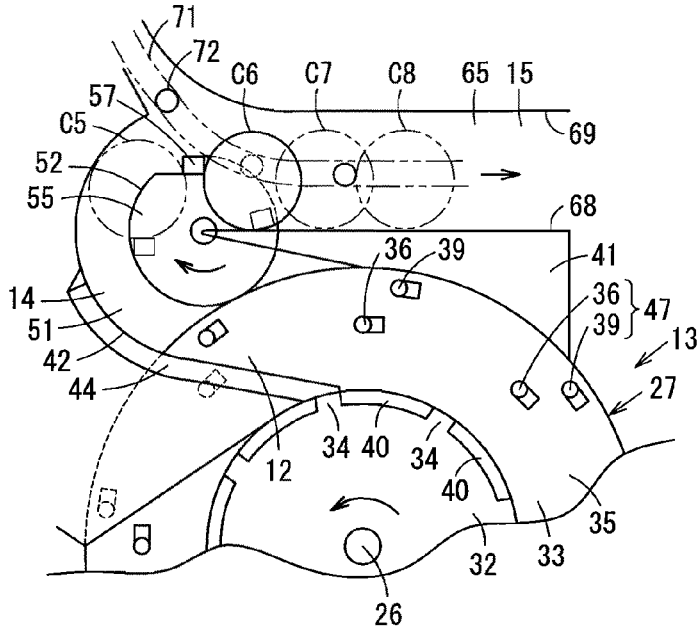
FIG. 30 provides an explanatory view of motions of feeding coins from the pooling hopper portion to the coin identifying and sorting passage following the motions illustrated in FIG. 29.

As illustrated in FIG. 30, coins (C5) fed to a coin-sending-direction changing passage 14 are conveyed along the coin-sending-direction changing passage 14 formed approximately in a letter U shape, with the coins pushed by the delivery projection 57 on the delivery circular plate 52, and the coins C5 are changed in the conveying direction so that they move to the left from the upper left.

Coins (C6) conveyed to the starting end region of the coin identifying and sorting passage 15, while being pushed by the delivery projection 57 on the delivery circular plate 52, enter between the passage face 51 and the belt 71 and also between projections 72 in a longitudinal direction of the belt 71.

The delivery projection 57 on the delivery circular plate 52 conveys coins (C7) to the starting end region of the coin identifying and sorting passage 15, thereafter, leaves from the coins (C7), and then moves to receive coins fed from the coin feeding port 12. Projections 72 on the belt 71 are in contact with coins (C8) from which the delivery projection 57 on the delivery circular plate 52 leaves and conveys the coins (C8) along the coin identifying and sorting passage 15, while pushing the coins by the projections 72.

As described above, the delivery circular plate 52 is provided so as to face the coin feeding port 12 at an outer circumference of the tilted disk 27. A rotational face portion 55 which is approximately flush with the coin face retaining portion 35 of the tilted disk 27 and able to rotate at the center of the rotational axis line 53 parallel with the rotational axis line 25 of the tilted disk 27 is provided at the delivery circular plate 52. At least one delivery projection 57 which projects to a predetermined extent to the front face side from the rotational face portion 55 and can be buried into the rotational face portion 55, when pressed to the rotational face portion 55 side, is provided at a predetermined radial region from the rotational axis line 53 at the rotational face portion 55, by which the delivery projection 57 is brought into contact with coins fed from the coin feeding port 12. These coins are conveyed to the coin identifying and sorting passage 15 in a state that they are separated one by one, thus making it possible to prevent the occurrence of jamming of coins and also increase a capacity of accommodating coins, without making the pooling hopper portion 13 large.

Further, the delivery circular plate 52 is provided between the coin feeding port 12, the coin-sending-direction changing passage and the vicinity of the inlet of the coin passage. Coins are sent one by one separately to the belt 71 on the coin identifying and sorting passage 15 by the delivery projection 57 on the delivery circular plate 52, thereby making it possible to convey the coins by the belt 71 reliably in a state that they are separated one by one and also secure the handling of the coins on the coin identifying and sorting passage 15.

Still further, since the coin-sending-direction changing passage 14 is provided between the coin feeding port 12 and the inlet of the coin identifying and sorting passage 15, there is no chance that the pooling hopper portion 13 and the coin identifying and sorting passage 15 are arranged together in a width direction of the machine body 11. Therefore, the coin identifying and sorting passage 15 can be provided partially at the upper part of the pooling hopper portion 13 to make the machine body small.

Figure 31:
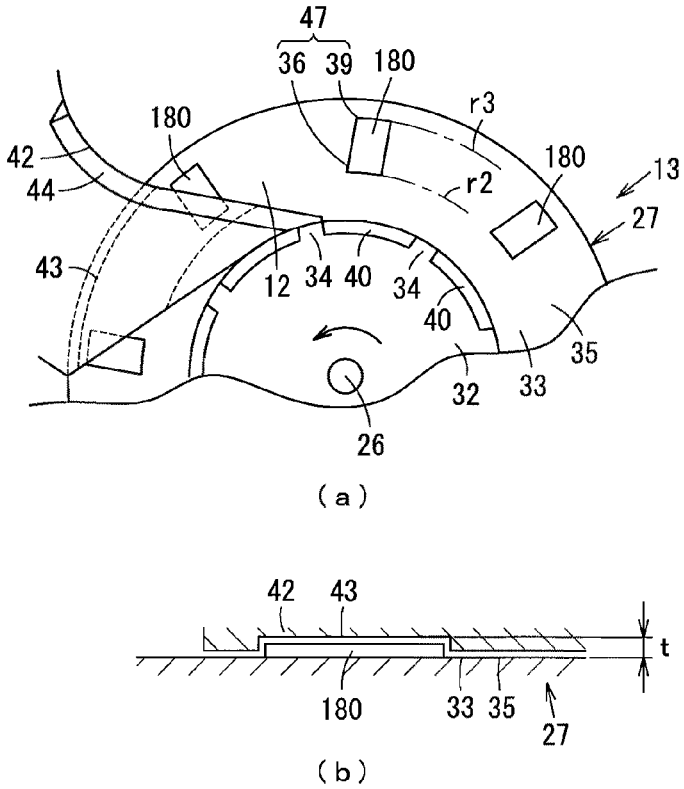
FIGS. 31(*a*) and 31(*b*) illustrate a tilted disk and a coin guide member used in another embodiment of the present invention in which FIG. 31(*a*) provides a front view and FIG. 31(*b*) provides a sectional view.

Another embodiment of the present invention is illustrated in FIGS. 31(*a*), 31(*b*).

This second embodiment provides another example of the coin picking-up and feeding projected portion 47. More specifically, a projected portion 180 which is available solely in a radial direction and projected to the front face side of the tilted disk 27 in such a dimension that is smaller than a minimum thickness of the coin is fixed and arranged circumferentially at a predetermined pitch in a range of a second predetermined radial region r2 to a third predetermined radial region r3 from the rotational axis 26, which is the rotational axis line 25 at the coin face retaining portion 35 on the tilted disk 27. Therefore, each of the projected portions 180 is provided with both functions of the coin picking-up projection 36 and the coin collapsing projection 39 in an integrated manner. In corresponding to the projected portion 180, a groove 43 of the coin guide member 42 is also formed solely in a radial direction. A clearance t between the groove 43 and the coin face retaining portion 35 on the tilted disk 27 is designed to be smaller in dimension than a minimum thickness of the coin to be handled so that the coin will not enter into the groove 43.

Figure 32:
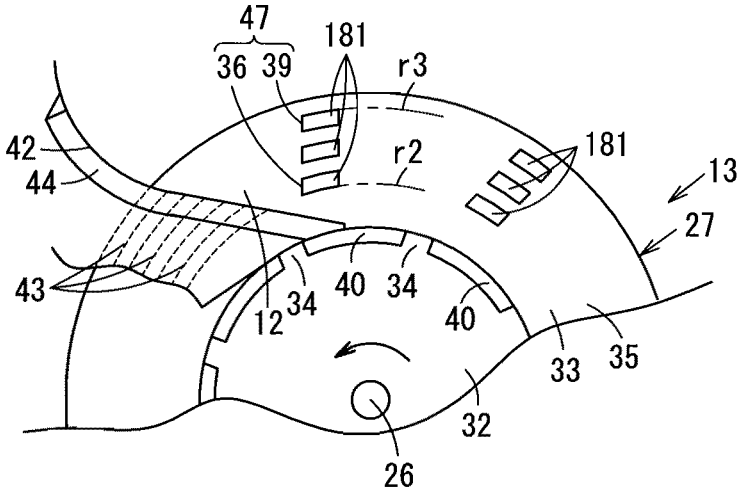
FIGS. 32(*a*) and 32(*b*) illustrate a tilted disk and a coin guide member used in yet another embodiment of the present invention in which FIG. 32(*a*) provides a front view and FIG. 32(*b*) provides a sectional view.
Figure 32:
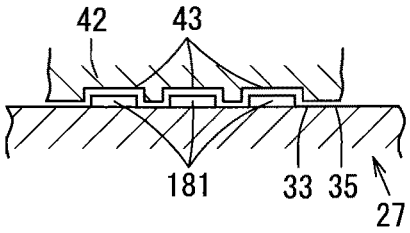

Another embodiment of the present invention is illustrated in FIGS. 32(*a*), 32(*b*).

This embodiment provides another example of the coin picking-up and feeding projected portion 47. More specifically, projected portions 181, which are available in three in a radial direction and projected to the front face side of the tilted disk 27, are fixed and arranged circumferentially at a predetermined pitch in a range of the second predetermined radial region r2 to the third predetermined radial region r3 from the rotational axis 26, which is the rotational axis line 25 at the coin face retaining portion 35 on the tilted disk 27. Therefore, these projected portions 181 which are available in three in a radial direction are provided with both functions of the coin picking-up projection 36 and the coin collapsing projection 39.

In accordance with the projected portions 181, three grooves 43 of the coin guide member 42 are also formed in a radial direction. These grooves 43 are narrow in width and there is no chance that a coin enters into the grooves 43.

The projected portions 181 may be available in three or more in a radical direction.

Figure 33:
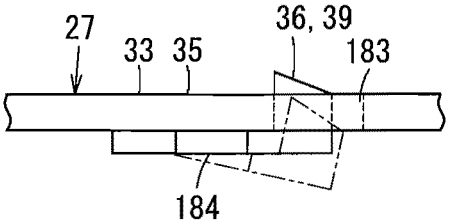
FIG. 33 provides a side view illustrating a coin picking-up projection of a tilted disk used in another embodiment of the present invention.

Another embodiment of the present invention 4 is illustrated in FIG. 33.

A hole portion 183 which allows each of the coin picking-up projections 36 and each of the coin collapsing projections 39 to project and retract to the front face side from the back part side is provided on the tilted disk 27. Further, a blade spring 184 which supports each of the coin picking-up projections 36 and each of the coin collapsing projections 39 and allows them to project to the front face side of the tilted disk 27 is arranged on the back face side of the tilted disk 27.

Where an excessive force is applied to the coin picking-up projection 36 and the coin collapsing projection 39 in contact with coins during a normal rotation of the tilted disk 27, the coin picking-up projection 36 and the coin collapsing projection 39 are able to retract to the back face side of the tilted disk 27 against an urging force derived from the blade spring 184, thereby making it possible to prevent the occurrence of jamming of coins.

Figure 34:
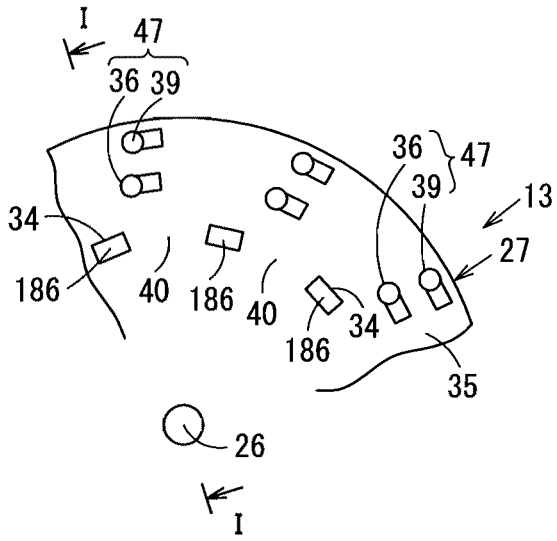
FIGS. 34(*a*) and 34(*b*) illustrate a tilted disk used in another embodiment of the present invention in which FIG. 34(*a*) provides a front view and FIG. 34(*b*) provides a sectional view of the tilted disk indicated by the arrow I-I given in FIG. 34(*a*).
Figure 34:
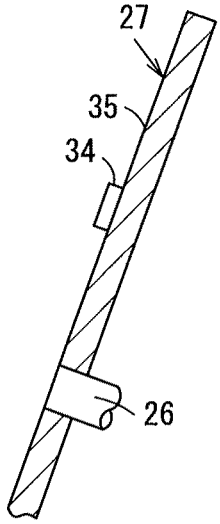

Another embodiment of the present invention is illustrated in FIGS. 34(*a*), 34(*b*).

The front face side of the tilted disk 27 is formed in a planar shape which is flush with a coin face retaining portion 35. A coin circumference retaining portion 34 is formed with a coin face retaining projection 186 which projects to the front face side of the tilted disk 27, and a sliding portion 40 is formed between the coin face retaining projections 186 in a circumferential direction.

Figure 35:
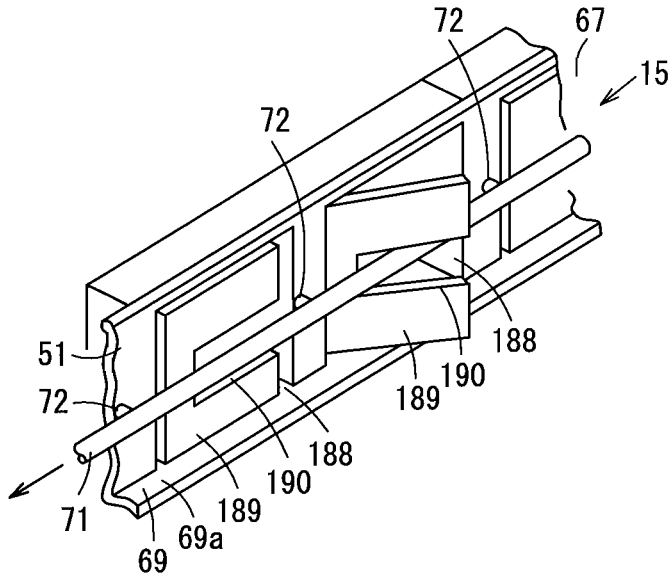
FIG. 35 provides a perspective view illustrating a denomination-specific diverging portion of a coin identifying and sorting passage for another embodiment of the present invention.
Figure 36:
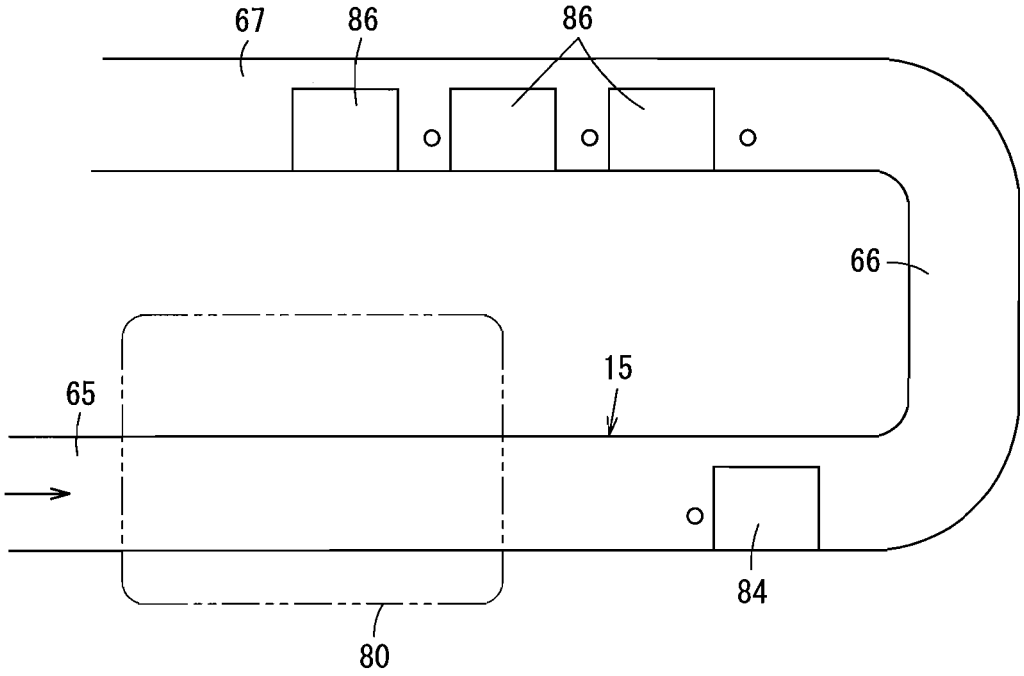
FIG. 36 provides a front view of the coin identifying and sorting passage of FIG. 35

Another embodiment of the present invention is illustrated in FIG. 35 and FIG. 36. An opening 188 which diverges coins to a passage face 51 is formed at each of denomination-specific diverging portions 86 on the coin identifying and sorting passage 15, and a diverging member 189 for diverging coins is arranged at the opening 188. The diverging member 189 swings between a diverging position at which the upstream side can move into a passage in a projectable and retractable manner, with the downstream side in a conveying direction being given as a support point, and projects into the passage by driving means such as a motor and a solenoid (not illustrated), thereby taking coins conveyed into the opening 188 to diverge the coins and a retracting position at which the diverging member 189 retracts into the opening 188 and allows the coins to pass. A notch 190 is formed at the diverging member 189 for preventing interference with the belt 71.

The structure of the denomination-specific diverging portion 86 is also applicable to a deposited/rejected coin diverging portion 84. The deposited/rejected coin diverging portion 84 may be arranged at a first passage region 65 on the coin identifying and sorting passage 15.

It should be noted that the deposited/rejected coin diverging portion 84 and each of the denomination-specific diverging portions 86 may be arranged only at a second passage region 67 on the coin identifying and sorting passage 15.

Further, regarding the pooling hopper portion 13, the tilted disk 27 may be or may not be provided with a rotational axis 26. Where the tilted disk 27 is not provided with the rotational axis 26, a plurality of rollers for positioning the tilted disk 27 and keeping the posture thereof and driving rollers for rotating the tilted disk 27 are provided on the circumference of the tilted disk 27.

The tilted disk 27 may be provided with a coin circumference retaining portion 34 over an entire circumferential direction, in place of a sliding portion 40.

The movable hopper frame portion 30 which can be opened and closed at the pooling hopper portion 13 may be formed not only at the lower region of the hopper frame 28 but also over the entire hopper frame 28.

The movable hopper frame portion 30, which is opened during returning deposited coins, may be put in an opening posture when instructions for returning deposited coins are given, or it may be put in an opening posture before the instructions for returning deposited coins are given.

Further, the delivery circular plate 52 on the coin-sending-direction changing passage 14 may be arranged at the feeding port 12 and a vicinity of the inlet on the coin identifying and sorting passage 15. In other words, as in the above-described embodiment, the delivery circular plate 52 may be arranged between the feeding port 12 and the interior of the inlet on the coin identifying and sorting passage 15, or arranged at the feeding port 12 and the vicinity in front of the inlet on the coin identifying and sorting passage 15, thereby allowing coins released from the delivery circular plate 52 to slide downward obliquely to a slight extent by using a guide piece, thereafter sending the coins to the belt 71 on the coin identifying and sorting passage 15.

Still further, regarding the coin identifying and sorting passage 15, that is, regarding a first passage region 65 which conveys coins at a region further above the pooling hopper portion 13 from one side to the other side in a width direction of the machine body 11, in the above-described embodiment, the starting end region of the first passage region 65 is provided at the upper region of the pooling hopper portion 13, and, in particular, the starting end region of the first passage region 65 is provided immediately above the pooling hopper portion 13. The starting end of the first passage region 65 is not restricted thereto and may be provided above the pooling hopper portion 13 or above apart from a position immediately above the pooling hopper portion 13. It is also possible that the coin-sending-direction changing passage 14 is not provided and the starting end of the first passage region 65 which faces the coin feeding port 12 of the pooling hopper portion 13 is arranged opposite.

Still further, regarding the release means 19 of the coin collective and temporary storage portion 18, an accommodation release port on the accommodation side and an accommodation shutter for opening and closing the accommodation release port as well as a return release port on the return side and a return shutter for opening and closing the return release port may be respectively provided. Alternatively, the release port and the shutter at the coin collective and temporary storage portion 18 are provided solely respectively, and a release opening/closing piece for changing over to the accommodation side and to the return side may be provided halfway on a chute for receiving coins released from the coin collective and temporary storage portion 18. Further, the release port and the shutter at the coin collective and temporary storage portion 18 are provided solely respectively, and an accommodation release port on the accommodation side and an accommodation release port shutter for opening and closing the accommodation release port as well as a return release port on the return side and a return release port shutter for opening and closing the return release port may be respectively provided halfway on a chute for receiving coins released from the coin collective and temporary storage portion 18.

Still further, the locking means 24 of the partition frame 23 is not restricted to such a structure that is locked or unlocked by using a key but also includes a structure that can be locked or unlocked by using cards such as a magnetic card and an IC card.

Still further, the denomination-specific coin accumulating and ejecting portion 17 is not restricted to a type which accepts coins from the upper part and ejects them from the lower part, but also including a type which accepts coins from the upper part and ejects them from the upper part.

Another object of the present invention is to provide a coin depositing and dispensing machine which is simple in structure, available in a smaller size and at a lower cost and also capable of preventing a miscalculation of an amount of dispensed coins. In order to attain the above object, a coin depositing and dispensing machine according to the present invention constituted as follows.

"The coin depositing and dispensing machine is provided with:

a machine body;

a pooling hopper portion arranged on the front face side of the machine body, and provided with a tilted disk capable of rotating at the center of a rotational axis line in such a posture that the upper part is tilted toward the back part and a hopper frame for pooling coins between the hopper frame and the front face of the tilted disk, in which a coin feeding port is formed in the upper part region of the circumferential face on the tilted disk, a movable hopper frame portion capable of being opened and closed by movable hopper-frame portion opening/closing means is mounted at least at a lower region of the hopper frame;

a coin identifying and sorting passage which accepts coins fed from the coin feeding port of the pooling hopper portion and conveys them, and is provided with a first passage region for conveying coins from one side to the other side in a width direction of the machine body at a region above the pooling hopper portion, a return passage region for conveying the coins in a direction from the terminal end of the first passage region to upward and also returning the coins to one side in a width direction of the machine body, and a second passage region for conveying the coins from the terminal end of the return passage region to one side in a width direction of the machine body, in which a coin identification portion is formed at the first passage region, a denomination-specific diverging portion is formed at least at any one of the passage regions such as the first passage region, the return passage region and the second passage region, and a temporary storage coin taking-out portion for taking out temporarily stored coins from the second passage region is at the terminal end region of the second passage region;

a coin collective and temporary storage portion which is provided below a temporary storage coin taking-out portion at the coin identifying and sorting passage, collectively and temporarily storing coins taken out from the temporary storage coin taking-out portion to the second passage region, and releasing deposited and temporarily stored coins when instructions for accommodating deposited coins are given and when instructions for returning deposited coins are given;

release means for sending deposited and temporarily-stored coins at the coin collective and temporary storage portion by changing over to a first release side and to a second release side, which is on the pooling hopper portion side;

a coin collective accommodation portion for collectively accommodating coins released by the release means to the first release side;

a denomination-specific coin accumulating and ejecting portion which is arranged along a width direction of the machine body at the back part region of the coin identifying and sorting passage and provided with a denomination-specific accommodating portion for accommodating coins diverged at each of the denomination-specific diverging portions in an accumulated state according to their denominations and a coin ejecting portion for ejecting coins to the lower part of the denomination-specific accommodating portion;

control means for sending deposited and temporarily-stored coins at the coin collective and temporary storage portion to the coin collective accommodation portion on the first release side by the release means when the instructions for accommodating deposited coins are given, sending deposited and temporarily-stored coins at the coin collective and temporary storage portion to the pooling hopper portion side on the second release side by the release means when the instructions for returning deposited coins are given, and releasing the coins below the pooling hopper portion through an opening posture of the movable hopper frame portion by the movable hopper frame portion opening/closing means; and a coin-collector installing portion mounted on the lower front face side of the machine body, and in which a coin collector for collecting ejected coins ejected from the denomination-specific coin accumulating and ejecting portion and deposited/returned coins released below the pooling hopper portion when the instructions for returning deposited coins are given is arranged so as to be detachably attached, in which the pooling hopper portion, the coin identifying and sorting passage, the coin collective and temporary storage portion, and the coin collective accommodation portion are arranged on the front face side of the machine body."

According to the above-described constitution of the coin depositing and dispensing machine, a tilted disk and a pooling hopper portion having a hopper frame, the lower region of which can be opened and closed, are arranged on the front face side of a machine body, a first passage region, a return passage region and a second passage region on a coin identifying and sorting passage capable of conveying coins fed from the pooling hopper portion, identifying, and sorting them are arranged on the front face side of the machine body in a width direction, a coin collective and temporary storage portion for collectively and temporarily storing coins taken out from the terminal end of the second passage region on the coin identifying and sorting passage is arranged on the front face of the machine body, release means is provided for sending coins at the coin collective and temporary storage portion to the first release side when instructions for accommodating deposited coins are given and to the pooling hopper portion which is the second release side when instructions for returning deposited coins are given, a coin collective accommodation portion for collectively accommodating coins sent to the first release side by the release means is arranged on the front face side of the machine body, a denomination-specific coin accumulating and ejecting portion capable of accommodating in an accumulated state according to their denominations coins diverged according to their denominations by the coin identifying and sorting passage and also ejecting the accommodated coins is arranged in a width direction of the machine body at the back part region of the coin identifying and sorting passage, and a coin-collector installing portion to which a coin collector is arranged so as to be detachably attached for collecting ejected coins ejected from the denomination-specific coin accumulating and ejecting portion and deposited/returned coins sent to the pooling hopper portion when instructions for returning deposited coins are given and released below from the pooling hopper portion is provided at the front lower part of the machine body. Therefore, it is possible to make the machine simpler in structure, available in a smaller size and at a lower cost than a conventional machine. It is also possible to prevent dispensed coins from remaining thereon and also prevent a miscalculation of an amount of dispensed coins.

Further, "The coin depositing and dispensing machine is provided with:

a machine body;

a pooling hopper portion arranged on the front face side of the machine body, and provided with a tilted disk capable of rotating at the center of a rotational axis line in such a posture that the upper part is tilted toward the back part and a hopper frame for pooling coins between the hopper frame and the front face of the tilted disk, in which a coin feeding port is formed in the upper part region of the circumferential face on the tilted disk, a movable hopper frame portion capable of being opened and closed by movable hopper-frame portion opening/closing means is mounted at least at a lower region of the hopper frame;

a coin identifying and sorting passage which accepts coins fed from the coin feeding port of the pooling hopper portion and conveys them, and is provided with a first passage region for conveying coins from one side to the other side in a width direction of the machine body at a region above the pooling hopper portion, a return passage region for conveying the coins in a direction from the terminal end of the first passage region to upward and also returning the coins to one side in a width direction of the machine body, and a second passage region for conveying the coins from the terminal end of the return passage region to one side in a width direction of the machine body, in which a coin identification portion is formed at the first passage region, a denomination-specific diverging portion is formed at least at any one of the passage regions such as the first passage region, the return passage region and the second passage region, and a temporary storage coin taking-out portion for taking out temporarily stored coins from the second passage region is at the terminal end region of the second passage region;

a coin collective and temporary storage portion which is provided below a temporary storage coin taking-out portion at the coin identifying and sorting passage, collectively and temporarily storing coins taken out from the temporary storage coin taking-out portion to the second passage region, and releasing deposited and temporarily stored coins when instructions for accommodating deposited coins are given and when instructions for returning deposited coins are given;

release means for sending deposited and temporarily-stored coins at the coin collective and temporary storage portion by changing over to a first release side and to a second release side, which is on the pooling hopper portion side;

a coin collective accommodation portion for collectively accommodating coins released by the release means to the first release side;

a denomination-specific coin accumulating and ejecting portion which is arranged along a width direction of the machine body at the back part region of the coin identifying and sorting passage and provided with a denomination-specific accommodating portion for accommodating coins diverged at each of the denomination-specific diverging portions in an accumulated state according to their denominations and a coin ejecting portion for ejecting coins to the lower part of the denomination-specific accommodating portion;

control means for sending deposited and temporarily-stored coins at the coin collective and temporary storage portion to the pooling hopper portion side which is the second release side by the release means when the instructions for accommodating deposited coins are given, diverging coins of the denomination which needs the replenishment at the corresponding denomination-specific diverging portion through actions of the tilted disk at the pooling hopper portion and the coin identifying and sorting passage in a state that the movable hopper frame portion is closed and replenishing these coins to the corresponding denomination-specific accommodating portion, sending coins of the denomination which do not need the replenishment to the coin collective accommodation portion on the first release side through the temporary storage coin taking-out portion, the coin collective and temporary storage portion and the release means, sending deposited and temporarily-stored coins at the coin collective and temporary storage portion to the pooling hopper portion side on the second release side by the release means when instructions for returning deposited coin are given, and releasing the coins below the pooling hopper portion through an opening posture of the movable hopper frame portion by the movable hopper frame portion opening/closing means; and a coin-collector installing portion mounted on the lower front face side of the machine body, and in which a coin collector for collecting ejected coins ejected from the denomination-specific coin accumulating and ejecting portion and deposited/returned coins released below the pooling hopper portion when the instructions for returning deposited coins are given is arranged so as to be detachably attached, in which the pooling hopper portion, the coin identifying and sorting passage, the coin collective and temporary storage portion, and the coin collective accommodation portion are arranged on the front face side of the machine body."

According to the above-described constitution of the coin depositing and dispensing machine, a tilted disk and a pooling hopper portion having a hopper frame, the lower region of which can be opened and closed, are arranged on the front face side of a machine body, a first passage region, a return passage region and a second passage region on a coin identifying and sorting passage capable of conveying coins fed from the pooling hopper portion, identifying, and sorting them are arranged on the front face side of the machine body in a width direction, a coin collective and temporary storage portion for collectively and temporarily storing coins taken out from the terminal end of the second passage region on the coin identifying and sorting passage is arranged on the front face of the machine body, release means is provided for sending coins at the coin collective and temporary storage portion to the pooling hopper portion, which is the first release side or the second release side, a coin collective accommodation portion for collectively accommodating coins sent to the first release side through the release means is arranged on the front face side of the machine body, a denomination-specific coin accumulating and ejecting portion capable of accommodating in an accumulated state according to their denominations coins diverged according to their denominations by the coin identifying and sorting passage and also ejecting the accommodated coins is arranged in a width direction of the machine body at the back part region of the coin identifying and sorting passage, and a coin-collector installing portion to which a coin collector is arranged so as to be detachably attached for collecting ejected coins ejected from the denomination-specific coin accumulating and ejecting portion and deposited/returned coins sent to the pooling hopper portion when instructions for returning deposited coins are given and released below from the pooling hopper portion is provided at the lower front face side of the machine body. Therefore, it is possible to make the machine simpler in structure, available in a smaller size and at a lower cost than a conventional machine. It is also possible to prevent dispensed coins from remaining thereon and also prevent a difference in calculation of an amount of dispensed coins. Further, when instructions for accommodating deposited coins are given, deposited and temporarily-stored coins at the coin collective and temporary storage portion are sent by the release means to the pooling hopper portion on the second release side and again sent from the pooling hopper portion to the coin identifying and sorting passage, by which coins of the denomination which needs the replenishment can be diverged and replenished to the denomination-specific coin accumulating and ejecting portion.

Further, "the ejected-coin temporary storage portion for temporarily storing coins ejected from the denomination-specific coin accumulating and ejecting portion and also releasing the temporarily stored ejected coins to the coin-collector installing portion facing the lower part is provided at the lower part of the denomination-specific coin accumulating and ejecting portion." According to this constitution, the coins ejected from the denomination-specific coin accumulating and ejecting portion are temporarily stored at the ejected-coin temporary storage portion. Therefore, for example, where the ejected coins are dispensed coins, it is possible to release them to the coin collector at the time when an amount of coins instructed to be dispensed is in agreement with an actual amount of the coins and also prevent a difference in calculation between an amount of coins to be dispensed and an actual amount of dispensed coins. Further, where the ejected coins are recovered coins, it is possible to store temporarily the coins in an amount corresponding to a capacity of the coin collector at the ejected-coin temporary storage portion and thereafter release the coins to the coin collector and also prevent the overflow of the coins from the coin collector due to an excessive amount of the coins.

"At any one of a downstream region from the coin identification portion at the first passage region on the coin identifying and sorting passage, a return passage region and a vicinity of the other side of the second passage region, a deposited/rejected coin diverging portion for diverging deposited/rejected coins is provided, and a deposited/rejected coin accommodating portion for accommodating the deposited/rejected coins diverged by the deposited/rejected coin diverging portion and taking them out from the front face of the machine body is provided." According to this constitution, since the deposited/rejected coins diverged by the deposited/rejected coin diverging portion on the coin identifying and sorting passage are accommodated into the deposited/rejected coin accommodating portion from which the coins can be taken out from the front face of the machine body, it is possible to save time in recovering the deposited/rejected coins and also prevent the deposited/rejected coins from remaining thereon.

"A foreign object separating portion for separating a foreign object to accept it at the pooling hopper portion is provided upstream from the coin identification portion of the first passage region on the coin identifying and sorting passage, and control means is used to release the foreign object separated by the foreign object separating portion and accepted at the pooling hopper portion to the coin-collector installing portion by opening the movable hopper frame portion at a predetermined timing by the movable hopper frame portion opening/closing means." According to this constitution, a foreign object is separated by the foreign object separating portion provided upstream from the coin identification portion at the first passage region on the coin identifying and sorting passage and accepted at the pooling hopper portion, and the foreign object accepted at the pooling hopper portion is released to a coin collector by opening the movable hopper frame portion at a predetermined timing. It is, therefore, possible to prevent jamming of coins from occurring on the coin identifying and sorting passage due to a foreign object and also remove the foreign object easily.

"A denomination-specific diverging portion is provided on the second passage region." According to this constitution, since the denomination-specific diverging portion is provided at a second passage region higher than a first passage region and coins are sent from the denomination-specific diverging portion at the second passage region to the upper part region of the denomination-specific coin accumulating and ejecting portion, it is possible to increase a capacity of coins accommodated at the denomination-specific coin accumulating and ejecting portion and set the height of the coin ejecting portion in any way without decrease in a capacity of coins accommodated.

"A deposited/rejected coin diverging portion is provided downstream from the coin identification portion at the first passage region, and the denomination-specific diverging portion is provided at the second passage region." According to this constitution, after deposited/rejected coins are diverged at the deposited/rejected coin diverging portion downstream from the coin identification portion at the first passage region, authentic coins are diverged by the denomination-specific diverging portion at the second passage region, thus making it possible to diverge the authentic coins reliably. "A coin-sending-direction changing passage which is approximately in the shape of a letter U for sending coins to the starting end region on a coin identifying and sorting passage immediately above the pooling hopper portion by changing the direction of the coins fed from a coin feeding port on the pooling hopper portion is provided between the coin feeding port on the pooling hopper portion and the starting end region on the coin identifying and sorting passage." According to this constitution, the coin-sending-direction changing passage which is approximately in the shape of a letter U for sending coins to the starting end region on the coin identifying and sorting passage immediately above a pooling hopper portion by changing the direction of the coins fed from a coin feeding port on the pooling hopper portion is provided between the coin feeding port on the pooling hopper portion and the starting end region on the coin identifying and sorting passage. It is, therefore, possible to decrease the length of the coin-sending-direction changing passage in a width direction of the machine body and also make the machine smaller in a width direction.

"A delivery circular plate having delivery projections for sending one by one separately coins fed from the coin feeding port of the pooling hopper portion to the coin identifying and sorting passage is provided on the coin-sending-direction changing passage, and a coin conveyor for conveying separately coins sent from the delivery circular plate in a state that the coins are separated one by one, is provided on the coin identifying and sorting passage." According to this constitution, since coins fed from the coin feeding port of the pooling hopper portion by the delivery circular plate on the coin-sending-direction changing passage are sent to the coin conveyor on the coin identifying and sorting passage in a state that the coins are separated one by one, it is possible to secure the processes such as identification and diversion on the coin identifying and sorting passage.

"A coin-sending-direction changing passage is formed approximately in the shape of a letter U so as to change the direction of coins fed from the coin feeding port of the pooling hopper portion to one side of the machine body in a width direction and send them to the other side of the machine body in a width direction, a starting end region on the coin identifying and sorting passage is given as a passage region moving toward the other side of the machine body in a width direction, and a delivery circular plate is provided between the coin-sending-direction changing passage and the starting end region of the coin identifying and sorting passage." According to this constitution, the coin-sending-direction changing passage is formed approximately in the shape of a letter U so as to change the direction of coins fed from the coin feeding port of the pooling hopper portion to one side of the machine body in a width direction and send them to the other side of the machine body in a width direction, and the starting end region on the coin identifying and sorting passage is given as a passage region moving toward the other side of the machine body in a width direction. It is, therefore, possible to decrease the length of the coin-sending-direction changing passage and that of the coin identifying and sorting passage in a width direction of the machine body and also make the machine smaller in a width direction.

Another object of the present invention is to provide equipment of feeding/separating/conveying pooled coin type which is suitable as a coin depositing and dispensing machine, capable of preventing the occurrence of jamming of a coin type and also increasing the capacity of accommodating a coin type without making large the pooling hopper portion.

In order to attain the object, the equipment of feeding/separating/conveying pooled coin type is constituted as described below. It is noted that "coin type" referred to in individual components (for example, a coin type circumference retaining portion) is equivalent to the "coin" referred to in the above-described embodiments (for example, the coin circumference retaining portion 34).

"Equipment of feeding/separating/conveying pooled coin type is provided with:

a pooling hopper portion which is provided with a tilted disk capable of rotating at the center of a rotational axis line in such a posture that the upper part is tilted toward the back part and a hopper frame for pooling a coin type between the hopper frame and the front face of the tilted disk;

a coin type circumference retaining portion which is formed on the front face of the tilted disk at a first predetermined radial region from the rotational axis line of the tilted disk, thereby placing the circumference of one coin type in a thickness direction;

a coin type face retaining portion which is formed radially outside the coin type circumference retaining portion on the front face of the tilted disk to retain back face of a coin type in which a radial dimension from the coin type circumference retaining portion is given as a dimension for retaining in a radial direction one coin type to be handled a plurality of coin type picking-up and feeding projected portions which are arranged at a predetermined pitch in a circumferential direction at a predetermined radial region in which the distance from the rotational axis line of the tilted disk at the coin type face retaining portion is greater than a first predetermined radial region and also projected to the front face side of the tilted disk, thereby retaining one coin type between itself and the coin type circumference retaining portion during rotation of the tilted disk, picking up the coin type in the upper part region of the tilted disk and feeding it outside the circumference of the tilted disk;

a coin type guide member which constitutes a coin type feeding port for feeding a coin type outside the circumference of the tilted disk in the upper part region of the tilted disk and which is arranged in close proximity to the front face of the coin type face retaining portion in the upper part region of the tilted disk so as to receive a coin type from the coin type circumference retaining portion, thereby retaining a coin type received from the coin type circumference retaining portion between itself and the coin type picking-up and feeding projected portion, and guiding them outside the circumference of the tilted disk; and a delivery projection which is provided so as to face the coin type feeding port outside the circumference of the tilted disk and in contact with a coin type fed from the coin type feeding port, thereby conveying to a subsequent step these coin types one by one separately."

According to the above-described constitution of the equipment of feeding/separating/conveying pooled coin type, the delivery projection is provided so as to face the coin type feeding port outside the circumference of the tilted disk and in contact with a coin type fed from the coin type feeding port, thereby conveying to a subsequent step these coin types one by one separately. It is, therefore, possible to prevent the occurrence of jamming of a coin type and increase the capacity of accommodating a coin type without making the pooling hopper portion larger.

Further, "the equipment of feeding/separating/conveying pooled coin type is provided with:

a pooling hopper portion which is provided with a tilted disk capable of rotating at the center of a rotational axis line in such a posture that the upper part is tilted toward the back part and a hopper frame for pooling a coin type between the hopper frame and the front face of the tilted disk;

a coin type circumference retaining portion which is formed on the front face of the tilted disk at a first predetermined radial region from the rotational axis line of the tilted disk, thereby placing the circumference of one coin type in a thickness direction;

a coin type face retaining portion which is formed radially outside the coin type circumference retaining portion on the front face of the tilted disk to retain the back face of a coin type, in which a radial dimension from the coin type circumference retaining portion is a dimension slightly larger than a maximum diameter of a coin type to be handled;

a plurality of coin type picking-up and feeding projected portions which are arranged at a predetermined pitch in a circumferential direction at a predetermined radial region in which the distance from the rotational axis line of the tilted disk at the coin type face retaining portion is greater than a first predetermined radial region and also projected to the front face side of the tilted disk, thereby retaining one coin type between itself and the coin type circumference retaining portion, irrespective of any size of the coin type from maximum-diameter to minimum-diameter to be handled during rotation of the tilted disk, picking up the coin type in the upper part region of the tilted disk and feeding it outside the circumference of the tilted disk;

a coin type guide member which constitutes a coin type feeding port for feeding a coin type outside the circumference of the tilted disk in the upper part region of the tilted disk and which is arranged in close proximity to the front face of the coin type face retaining portion in the upper part region of the tilted disk so as to receive a coin type from the coin type circumference retaining portion, thereby retaining a coin type received from the coin type circumference retaining portion between itself and the coin type picking-up and feeding projected portion, and guiding them outside the circumference of the tilted disk;

a rotational face portion which is provided so as to face the coin type feeding port outside the circumference of the tilted disk and can be rotated at the center of the rotational axis line approximately flush with the coin type face retaining portion of the tilted disk and parallel with the rotational axis line of the tilted disk; and a delivery circular plate having at least one delivery projection provided at a predetermined radial region from the rotational axis line at the rotational face portion, projected to a predetermined extent from the rotational face portion to the front face side and can be buried into the rotational face portion when pressed toward the rotational face portion, thereby brought into contact with coin type fed from the coin type feeding port to convey to a subsequent step these coin types one by one separately.

According to the constitution of the equipment of feeding/separating/conveying pooled coin type, a delivery circular plate is provided so as to face the coin type feeding port outside the circumference of the tilted disk, a rotational face portion which can be rotated at the center of the rotational axis line approximately flush with the coin type face retaining portion of the tilted disk and parallel with the rotational axis line of the tilted disk is provided on the delivery circular plate, at least one delivery projection which is projected to a predetermined extent from the rotational face portion to the front face side and can be buried into the rotational face portion when pressed to the rotational face portion side is provided at a predetermined radial region from the rotational axis line at the rotational face portion, and the delivery projection is brought into contact with coin type fed from the coin type feeding port to convey to a subsequent step the coin types one by one separately. It is, therefore, possible to prevent the occurrence of jamming of a coin type more reliably and also increase the capacity of accommodating a coin type without making the pooling hopper portion large. In particular, where various sizes of coin types from large-diameter to small diameter are mixed together, these coin types can be conveyed to a subsequent step one by one separately, thereby preventing the jamming of a coin type from occurring.

Further, "the coin type picking-up and feeding projected portion is provided with coin type picking-up projections and coin type collapsing projections. The coin type picking-up projections are formed at a second predetermined radial region in which the distance from the rotational axis line of the tilted disk is greater than a first predetermined radial region, and the coin type collapsing projections are arranged in a circumferential direction at a predetermined pitch at a third predetermined radial region radially outside the second predetermined radial region at the coin type face retaining portion and also projected toward the front face side of the tilted disk. A plurality of these coin type collapsing projections are located at a position deviated at a predetermined angle backward to the rotational direction from the coin type picking-up projections at the center of the rotational axis line of the tilted disk, corresponding to each of the coin type picking-up projections." According to this constitution, even where there are developed bridged coin types between the coin type circumference retaining portion and the coin type picking-up projection at a region leading to the coin type feeding port for feeding a coin type outside the tilted disk or a region close to the coin type feeding port, the coin type collapsing projection can be used to collapse the bridged coin types and prevent the occurrence of jamming of a coin type.

"Coin type circumference retaining portions are formed at a predetermined pitch in a circumferential direction corresponding to a plurality of coin type picking-up and feeding projected portions arranged in a circumferential direction, and the length in a circumferential direction of each of these coin type circumference retaining portions is given as a length of retaining one coin type between the corresponding coin type picking-up and feeding projected portions during rotation of the tilted disk, and a sliding portion for allowing a coin type to slide down is formed between a plurality of these coin type circumference retaining portions." According to this constitution, when coin types are retained between the coin type picking-up and feeding projected portion and the coin type circumference retaining portion and picked up, one of two bridged coin types is allowed to fall down through a sliding portion earlier and reliably, and only one coin type can be retained between the coin type picking-up and feeding projected portion and the coin type circumference retaining portion and sent to the coin type feeding port. It is, therefore, possible to prevent the occurrence of jamming of a coin type between the coin type picking-up and feeding projected portion and the coin type circumference retaining portion in the vicinity of the coin type feeding port.

"The coin type guide member which constitutes the coin type feeding port is provided with a thickness-direction regulating guide portion for converting multi-layered coin types sent in a thickness direction to single-layered coin types, with a remaining coin type allowed to slide down, and the pooling hopper portion receives and accommodates a coin type sliding down from the thickness-direction regulating guide portion of the guide member." According to this constitution, since the thickness-direction regulating guide portion of the coin type guide member, which constitutes the coin type feeding port, actuates to convert a coin type sent in a multiple layer to a single layer to send them to the delivery circular plate and also allows a remaining coin type to slide down, it is possible to convey the coin types one by one separately to a subsequent step by the delivery circular plate and also prevent the occurrence of jamming of a coin type in the vicinity of the coin type feeding port. Further, since a coin type slid down from the thickness-direction regulating guide portion is received and accommodated at the pooling hopper portion, it is possible to feed the slid-down coin type.

"A coin type passage for conveying a coin type is provided at a subsequent step of the coin type feeding port, a coin type conveyor for conveying coin types one by one separately is provided on the coin type passage, a delivery circular plate is arranged between the coin type feeding port and the vicinity of the inlet of the coin type passage, thereby coin types fed from the tilted disk are sent one by one separately by the delivery projections to the coin type conveyor on the coin type passage." According to this constitution, the delivery circular plate is provided between the coin type feeding port, the coin type-sending-direction changing passage and the vicinity of the inlet of the coin type passage, and coin types are sent one by one separately by the delivery projections of the delivery circular plate to the coin type conveyor on the coin type passage. It is, therefore, possible to convey coin types one by one separately by the coin type conveyor and handle the coin type on the coin type passage reliably.

"The coin type-sending-direction changing passage is provided between the coin type feeding port and the inlet on the coin type passage, the delivery circular plate is provided between the coin type feeding port, and the coin type-sending-direction changing passage and the vicinity of the inlet of the coin type passage. Thereby, coin types fed from the tilted disk are sent one by one separately by delivery projections via the coin type-sending-direction changing passage to the coin type conveyor on the coin type passage." According to this constitution, since the coin type-sending-direction changing passage is provided between the coin type feeding port and the inlet on the coin type passage, the pooling hopper portion or the coin type passage is not arranged together in a width direction of the equipment. It is, therefore, possible to partially provide the coin type passage at the upper part of the pooling hopper portion and make the equipment small.

"The coin type-sending-direction changing passage is formed approximately in the shape of a letter U so as to change the direction of a coin type fed from the coin type feeding port to one side of the lateral direction on the tilted disk toward the other side of the lateral direction, the starting end region of the coin type passage is provided with a lateral passage region moving to the other side of the lateral direction in continuation from the coin type-sending-direction changing passage, a foreign object separating portion for separating a foreign object is formed at the lateral passage region, a pooling hopper portion is able to receive and accommodate the foreign object separated by the foreign object separating portion, and at least the lower region thereof can be opened for releasing foreign object." According to this constitution, the foreign object separating portion is provided at a lateral conveying region on the starting end region of the coin type passage, and foreign object separated at the foreign object separating portion is received and accommodated at the pooling hopper portion. Since no foreign objects are sent to a subsequent step on the coin type passage, it is possible to prevent the occurrence of jamming of a coin type due to the foreign object sent to the subsequent step on the coin type passage. Further, the foreign object received and accommodated at the pooling hopper portion can be released by opening and closing the pooling hopper portion. Therefore, the foreign object is not jammed but can be returned.

"A machine body is provided, a pooling hopper portion is provided in the central region in a width direction of the machine body, a coin type passage is provided along a width direction of the machine body. The coin type passage is connected to a coin type-sending direction-changing passage and provided with a first passage region for conveying a coin type at a region above the pooling hopper portion from one side to the other side in a width direction of the machine body, a return passage region for conveying a coin type from the terminal end of the first passage region to an upward direction and returning them to one side in a width direction of the machine body, and a second passage region for conveying the coin type from the terminal end of the return passage region to one side in a width direction of the machine body, a coin type identification portion is provided at the first passage region and a denomination-specific coin type diverging portion is provided at the second passage region." According to this constitution, the coin type passage is provided with the first passage region, the second passage region in a width direction of the machine body and the return passage region which connects the first passage region with the second passage region. It is, therefore, possible to make the length of the machine body short in a width direction, although a whole length of the coin type passage is long, miniaturize the machine body and also give maintenance to an entire part of the coin type passage from the front face of the machine body.

It is noted that the equipment of feeding/separating/conveying pooled coin type may be applicable as a coin dispensing machine and a coin sorting machine, in addition to a coin depositing and dispensing machine. The equipment is also applicable as a medal handling machine and a token handling machine for handling medals and tokens used in games. Then, the coin type includes not only cash coins but also other types of coins and tokens.

The invention claimed is:

1. A device for feeding/separating/conveying pooled coin types, comprising:

a pooling hopper portion which is provided with a tilted disk capable of rotating at the center of a rotational axis line in such a posture that the upper part is tilted toward the back part of the tilted disc and a hopper frame for pooling a coin type between the hopper frame and the front face of the tilted disk;

a plurality of coin type picking-up and feeding projected portions which are arranged at a predetermined pitch along a circumferential direction of the tilted disk, thereby retaining one coin type during rotation of the tilted disk, picking up the coin type in the upper part region of the tilted disk and feeding it outside the circumference of the tilted disk;

a coin type guide member which constitutes a coin type feeding port for feeding a coin type outside the circumference of the tilted disk in the upper part region of the tilted disk, thereby guiding a coin type for feeding at the coin type picking-up and feeding projected portions outside the circumference of the tilted disk;

a coin type passage connected to and provided with the coin feeding port;

a coin type conveyor for conveying coin type fed from the coin feeding port to the coin passage one by one separately; and a delivery circular plate including:

a rotational face portion, which is provided so as to face the coin type feeding port outside the circumference of the tilted disk, is approximately flush with the front face of the tilted disk, and can be rotated at the center of a second rotational axis line parallel with the rotational axis line of the tilted disk; and at least one delivery projection provided at a predetermined radial region from the second rotational axis line at the rotational face portion of said delivery circular plate, projected to a predetermined extent from the rotational face portion to the front face side, in contact with a coin type fed from the coin type feeding port, thereby delivering to the coin conveyor these can types one by one separately.

2. The device as set forth in claim 1, further comprising:

a coin type circumference retaining portion formed on the front face of the tilted disk at a first predetermined radial region from the rotational axis line of the tilted disk, thereby placing the circumference of one coin type in a thickness direction of one coin type; and a coin type face retaining portion which is formed radially outside the coin type circumference retaining portion on the front face of the tilted disk to retain the back face of a coin type in which a radial dimension from the coin type circumference retaining portion is given as a dimension for retaining in a radial direction one coin type to be handled; wherein the coin type picking-up and feeding projected portions are arranged at a predetermined radial region in which the distance from the rotational axis line of the tilted disk at the coin type face retaining portion is greater than the first predetermined radial region; and the coin type guide member is arranged in close proximity to the front face of the coin type face retaining portion in the upper part region of the tilted disk to receive a coin type from the coin type circumference retaining portion, thereby retaining a coin type received from the coin type circumference retaining portion between itself and the coin type picking-up and feeding projected portion, and guiding them outside the circumference of the tilted disk.

3. The device as set forth in claim 2, wherein the coin type picking-up and feeding projected portion is provided with coin type picking-up projections and coin type collapsing projections, the coin type picking-up projections are formed at a second predetermined radial region of the predetermined radial region in which the distance from the rotational axis line of the tilted disk is greater than the first predetermined radial region, the coin type collapsing projections are arranged in a circumferential direction at a predetermined pitch at a third predetermined radial region radially outside the second predetermined radial region at the coin type face retaining portion and also projected toward the front face side of the tilted disk, and a plurality of these coin type collapsing projections are located at a position deviated at a predetermined angle backward to the rotational direction from the coin type picking-up projections at the center of the rotational axis line of the tilted disk, corresponding to each of the coin type picking-up projections.

4. The device as set forth in claim 2, wherein the coin type circumference retaining portion is formed in a plurality of positions at a predetermined pitch in a circumferential direction corresponding to a plurality of coin type picking-up and feeding projected portions arranged in the circumferential direction, the length in the circumferential direction of each of the coin type circumference retaining portions is given as a length of retaining one coin type between the corresponding coin type picking-up and feeding projected portions during rotation of the tilted disk, and a sliding portion for allowing a coin type to slide down is formed between a plurality of these coin type circumference retaining portions.

5. The device as set forth in claim 1, wherein the coin type guide member which constitutes the coin type feeding port is provided with a thickness-direction regulating guide portion for converting multi-layered coin types sent in the thickness direction to single-layered coin types, with a remaining coin type allowed to slide down, and the pooling hopper portion receives and accommodates a coin type sliding down from the thickness-direction regulating guide portion of the guide member.

6. The device as set forth in claim 1, comprising:

a coin type-sending-direction changing passage is provided between the coin type feeding port and the inlet on the coin type passage, wherein the delivery circular plate is provided between the coin type feeding port, and the coin type-sending-direction changing passage and in the vicinity of the inlet of the coin type passage, and coin types fed from the tilted disk are sent one by one separately by the delivery projections via the coin type-sending-direction changing passage to the coin type conveyor on the coin type passage.

7. The device as set forth in claim 6, wherein the coin type-sending-direction changing passage is formed approximately in a U-shape to change the direction of a coin type fed from the coin type feeding port to one side of the lateral direction on a front face of the tilted disk toward the other side of the lateral direction, the starting end region of the coin type passage is provided with a lateral passage region moving to the other side of the lateral direction in continuation from the coin type-sending-direction changing passage, a foreign object separating portion for separating a foreign object is formed at the lateral passage region, and the pooling hopper portion is able to receive and accommodate the foreign object separated by the foreign object portion, and at least the lower region thereof can be opened for releasing the foreign object.

* * * * *